US011692756B2

(12) United States Patent
Park et al.

(10) Patent No.: US 11,692,756 B2
(45) Date of Patent: Jul. 4, 2023

(54) REFRIGERATOR

(71) Applicant: LG Electronics Inc., Seoul (KR)

(72) Inventors: Jong Gyu Park, Seoul (KR); Ki Hwang Kim, Seoul (KR); Sung Hee Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 184 days.

(21) Appl. No.: 17/077,594

(22) Filed: Oct. 22, 2020

(65) Prior Publication Data

US 2021/0172668 A1 Jun. 10, 2021

(30) Foreign Application Priority Data

Dec. 9, 2019 (KR) ..... 10-2019-0163005
Dec. 9, 2019 (KR) ..... 10-2019-0163006
(Continued)

(51) Int. Cl.
*F25D 11/02* (2006.01)
*F25C 5/20* (2018.01)
(Continued)

(52) U.S. Cl.
CPC ..... *F25D 11/02* (2013.01); *F25C 5/22* (2018.01); *F25D 17/042* (2013.01);
(Continued)

(58) Field of Classification Search
CPC ..... F25D 11/02; F25D 17/042; F25D 17/065; F25D 23/02; F25D 23/061; F25D 23/068;
(Continued)

(56) References Cited

U.S. PATENT DOCUMENTS 6,318,099 B1 11/2001 Hwang
2008/0148761 A1 6/2008 Venkatakrishnan et al.
(Continued)

FOREIGN PATENT DOCUMENTS

CN 101231073 7/2008
CN 106440625 2/2017
(Continued)

OTHER PUBLICATIONS

Translated_Kim (Year: 2017).*
(Continued)

*Primary Examiner* — Elizabeth J Martin
*Assistant Examiner* — Samba Gaye
(74) *Attorney, Agent, or Firm* — Fish & Richardson P.C.

(57) ABSTRACT

A refrigerator includes a cabinet having a freezing compartment below a refrigerating compartment, an ice making compartment at a side of the refrigerating compartment, an evaporator, a shroud that is disposed at a front side of the evaporator, a grille panel coupled to a front surface of the shroud, a first cool air guide channel defined between the grille panel and the shroud and configured to guide cool air to a freezing compartment, a second cool air guide channel defined between the grille panel and the shroud and configured guide cool air to the ice making compartment, a freezing fan module disposed between the grille panel and the shroud and configured to supply cool air to the first cool air guide channel, and an ice making fan module disposed between the grille panel and the shroud and configured to supply cool air to the second cool air guide channel.

11 Claims, 63 Drawing Sheets

(30) Foreign Application Priority Data

| | | |
|---|---|---|
| Dec. 9, 2019 | (KR) | 10-2019-0163007 |
| Dec. 9, 2019 | (KR) | 10-2019-0163008 |
| Dec. 9, 2019 | (KR) | 10-2019-0163009 |
| Dec. 9, 2019 | (KR) | 10-2019-0163010 |
| Dec. 9, 2019 | (KR) | 10-2019-0163011 |
| Dec. 9, 2019 | (KR) | 10-2019-0163015 |
| Dec. 9, 2019 | (KR) | 10-2019-0163016 |
| Dec. 9, 2019 | (KR) | 10-2019-0163017 |

(51) Int. Cl.

| | |
|---|---|
| ***F25D 17/04*** | (2006.01) |
| ***F25D 17/06*** | (2006.01) |
| ***F25D 23/02*** | (2006.01) |
| ***F25D 23/06*** | (2006.01) |

(52) U.S. Cl.
CPC ..... *F25D 17/065* (2013.01); *F25D 23/02* (2013.01); *F25D 23/061* (2013.01); *F25D 23/068* (2013.01); *F25D 2317/063* (2013.01); *F25D 2317/067* (2013.01); *F25D 2317/068* (2013.01); *F25D 2317/0651* (2013.01); *F25D 2317/0667* (2013.01)

(58) Field of Classification Search
CPC ..... F25D 2317/063; F25D 2317/0667; F25D 2317/067; F25D 2317/068; F25C 5/22
See application file for complete search history.

(56) References Cited

U.S. PATENT DOCUMENTS

| | | | | |
|---|---|---|---|---|
| 2017/0241694 | A1* | 8/2017 | Ji | F25C 5/22 |
| 2018/0306484 | A1 | 10/2018 | Cha et al. | |
| 2019/0316829 | A1 | 10/2019 | Han et al. | |
| 2020/0124339 | A1* | 4/2020 | Cheng | F25D 17/062 |

FOREIGN PATENT DOCUMENTS

| | | | | | |
|---|---|---|---|---|---|
| CN | 107388699 | | | 11/2017 | |
| CN | 109341186 | | | 2/2019 | |
| CN | 109341186 | A | | 2/2019 | |
| EP | 3249325 | | | 11/2017 | |
| JP | H11223446 | | | 8/1999 | |
| JP | H11223446 | A | | 8/1999 | |
| JP | 2000234838 | A | * | 8/2000 | |
| JP | 2001021251 | | | 1/2001 | |
| JP | 2013167382 | A | * | 8/2013 | F25D 17/065 |
| JP | 2018124060 | A | * | 8/2018 | |
| KR | 1019980086632 | | | 12/1998 | |
| KR | 1019990031033 | | | 5/1999 | |
| KR | 1020050094671 | | | 9/2005 | |
| KR | 1020060129664 | | | 12/2006 | |
| KR | 1020070010547 | | | 1/2007 | |
| KR | 100716254 | | | 5/2007 | |
| KR | 1020070071094 | | | 7/2007 | |
| KR | 20070109690 | | | 11/2007 | |
| KR | 100821711 | | | 4/2008 | |
| KR | 2008030702 | A | * | 4/2008 | |
| KR | 1020090046241 | | | 5/2009 | |
| KR | 20100129671 | | | 12/2010 | |
| KR | 1020110098413 | | | 9/2011 | |
| KR | 20110136917 | | | 12/2011 | |
| KR | 101659622 | | | 9/2016 | |
| KR | 2017133840 | A | * | 12/2017 | F25B 39/02 |
| KR | 1020170133840 | | | 12/2017 | |
| KR | 2018080651 | A | * | 7/2018 | F25B 21/02 |
| KR | 20180080652 | | | 7/2018 | |
| KR | 1020180080652 | | | 7/2018 | |
| KR | 1020180124451 | | | 11/2018 | |
| KR | 20190163005 | | | 6/2021 | |

OTHER PUBLICATIONS

Translated_Kawai (Year: 2013).*
Translated_Jang (Year: 2009).*
Translated_Park (Year: 2018).*
Translated_Kimura (Year: 2002).*
Translated_Iwabuchi (Year: 2018).*
KR Notice of Allowance in Korean Appln. No. 10-2019-0163005, dated Jun. 1, 2021, 4 pages (with English translation).
KR Notice of Allowance in Korean Appln. No. 10-2019-0163011, dated Jun. 1, 2021, 3pages (with English translation).
IN Office Action in Indian Appln. No. 202014047350, dated Jun. 30, 2021, 6 pages.
Office Action in Chinese Appln. No. 202011291919.2, dated Mar. 11, 2022, 16 pages (with English translation).
EP Extended European Search Report in European Appln. No. 20204934.2, dated Apr. 26, 2021, 8 pages.
KR Office Action in Korean Appln. No. 10-2019-0163005, dated Jun. 22, 2021, 12 pages (with English translation).
KR Office Action in Korean Appln. No. 10-2019-0163011, dated Jun. 22, 2021, 12 pages (with English translation).
Office Action in Australian Appln. No. 2020260541, dated Jul. 30, 2021, 6 pages.

* cited by examiner

REFRIGERATOR

CROSS-REFERENCE TO RELATED APPLICATIONS

The present application claims priority to Korean Patent Application No. 10-2019-0163005, filed on Dec. 9, 2019, Korean Patent Application No. 10-2019-0163006, filed on Dec. 9, 2019, Korean Patent Application No. 10-2019-0163007, filed on Dec. 9, 2019, Korean Patent Application No. 10-2019-0163008, filed on Dec. 9, 2019, Korean Patent Application No. 10-2019-0163009, filed on Dec. 9, 2019, Korean Patent Application No. 10-2019-0163010, filed on Dec. 9, 2019, Korean Patent Application No. 10-2019-0163011, filed on Dec. 9, 2019, Korean Patent Application No. 10-2019-0163015, filed on Dec. 9, 2019, Korean Patent Application No. 10-2019-0163016, filed on Dec. 9, 2019, and Korean Patent Application No. 10-2019-0163017, filed on Dec. 9, 2019, the entire contents of which are incorporated herein for all purposes by reference.

TECHNICAL FIELD

The present disclosure relates to a refrigerator having a refrigerating compartment and a freezing compartment, and having an ice making compartment in a refrigerating compartment door.

BACKGROUND

A refrigerator is an apparatus that can generate cool air using circulation of a refrigerant through a refrigeration cycle and keep storage objects in the generated cool air. The storage objects may include food or other types of storage items to be refrigerated or frozen.

The refrigerator may include one or a plurality of storage compartments that are separated to keep storage objects. The storage compartment may be a storage compartment that is opened and closed by a rotary door or may be a storage compartment that can be drawn in or out in a drawer type.

For example, the storage compartment may include a freezing compartment for keeping storage objects frozen and a refrigerating compartment for keeping storage objects refrigerated. In some cases, the refrigerator may include two or more freezing compartments or two or more refrigerating compartments.

In some cases, the refrigerator may include a grille panel assembly that separates a space in which articles are stored and a space in which a fan module is installed.

In some cases, one grille panel assembly may be provided for each storage compartment and circulate the cool air in the corresponding storage compartment.

For example, each grille panel assembly has a fan module, and cool air is supplied into a corresponding storage compartment or the cool air in a corresponding storage compartment is circulated by the blowing power of the fan module.

In some cases, the structure may not be suitable for supplying cool air to two or more storage compartments using one evaporator. For example, in some cases, where cool air is supplied to two or more storage compartments by one blowing fan, cool air may not be sufficiently supplied, and the entire channel structure may be complicated.

In some cases, one grille panel assembly is equipped with two blowing fans so that cool air can be separately supplied to two or more storage compartments.

In some cases, cool air may be supplied to only two storage compartments, or the same amount of cool air may be supplied to three or more storage compartments by one grille panel assembly. That is, the grille panel assembly in these cases does not selectively supply different amounts of cool air to three or more storage compartments.

In some cases, the vertical height of the grille panel assembly is increased and the entire structure is complicated.

Accordingly, a grille panel assembly having a plurality of fans or a plurality of channels may be difficult to apply to a storage compartment having a relatively small vertical height.

In some cases, where a grille panel assembly has a large vertical height and is disposed through two storage compartments, the storage space of each of the storage compartments may be decreased by the width of the grille panel assembly.

In some cases, where one grille panel assembly is positioned behind both of two storage compartments, work for maintenance may be performed behind the refrigerator.

In some cases, a plurality of fans is simply added to the structures regardless of the use of storage compartments or the lengths of channels. In these cases, cool air may not be sufficiently supplied to a relatively far storage compartment, and a large amount of air may not be supplied to a storage compartment.

In some cases, cool air may be insufficiently supplied up to an ice making compartment in a refrigerating compartment door due to a long distance to the ice making compartment.

In some cases, the number of components of a grille panel assembly may be increased to form different channels, which may lead to a deterioration of assembly convenience and an increase of the front-rear width.

In some cases, fans may be provided to supply cool air to storage compartments, respectively. The fans may be different types of fans (axial flow fans and cross flow fans) or have different sizes to perform their functions, which may lead to inconvenience in preparing various types of fans. In some cases, channel designs may change due to the characteristics of the types of the fans.

In some cases, the ice tray may be disposed in the freezing compartment and configured to make ice using only the cool air supplied to the freezing compartment, which may lead to poor ice making.

For instance, the ice tray in the freezing compartment may be influenced by temperature variation in the freezing compartment where cool air is not continuously sprayed to the ice tray to make ice in the freezing compartment. In some cases, only an outer surface of an ice piece may be frozen.

SUMMARY

The present disclosure describes a refrigerator including a single grille panel assembly having a freezing fan module and an ice making module that are disposed between a grille panel and a shroud.

The present disclosure also describes a refrigerator in which a portion of cool air supplied to an ice making compartment can also be supplied to a freezing compartment such that cool air may be sufficiently supplied to the freezing compartment, and backflow of cool air due to a pressure difference from the ice making compartment may be prevented or reduced.

The present disclosure further describes a refrigerator in which cool air can be sufficiently supplied into the freezing compartment in which the grille panel assembly is installed, and cool air can be sufficiently supplied up a relatively far ice making compartment.

The present disclosure further describes a refrigerator including fans that can be shared and standardized through designing to which the same kinds and sizes of fans are applied.

According to one aspect of the subject matter described in this application, a refrigerator includes a cabinet having a refrigerating compartment and a freezing compartment disposed below the refrigerating compartment, an ice making compartment disposed at a side of the refrigerating compartment, an evaporator disposed in the freezing compartment and configured to cool air, a shroud that is disposed at a front side of the evaporator and defines a first intake hole and a second intake hole spaced apart from each other, where the shroud includes a first fastening protrusion that protrudes forward from a front surface of the shroud and is disposed adjacent to the first intake hole, and a second fastening protrusion that protrudes forward from the front surface of the shroud and is disposed adjacent to the second intake hole, and a grille panel that is coupled to a front surface of the shroud and defines a first seat that is recessed in a direction away from the shroud and faces the first intake hole, a second seat that is recessed in the direction away from the shroud and faces the second intake hole, and a cool air discharge port configured to discharge the cool air into the freezing compartment. The refrigerator further includes a first cool air guide channel defined between the grille panel and the shroud and configured to guide cool air from the first intake hole to the cool air discharge port, a second cool air guide channel defined between the grille panel and the shroud and configured guide cool air from the second intake hole to the ice making compartment, a freezing fan module that is disposed between the first seat and the shroud, that is coupled to the first fastening protrusion, and that is configured to supply cool air to the first cool air guide channel, and an ice making fan module that is disposed between the second seat and the shroud, that is coupled to the second fastening protrusion, and that is configured to supply cool air to the second cool air guide channel.

Implementations according this aspect may include one or more of the following features. For example, the refrigerator can include a refrigerating compartment door that is configured to open and close at least a portion of the refrigerating compartment, where the refrigerating compartment door defines the ice making compartment. In some examples, the grille panel defines an opening at an upper portion of the first seat, and includes a flow guide stage that extends from an end of the upper portion of the first seat facing the second seat. The flow guide stage can have an inclined or rounded shape extending in a direction away from the second seat.

In some implementations, the cool air discharge port includes an upper cool air discharge port defined above a center of the grille panel, and a lower cool air discharge port defined below the upper cool air discharge port. In some implementations, the grille panel includes a partition rib that is disposed at a rear side of the grille panel and that separates the first cool air guide channel and the second cool air guide channel from each other.

In some implementations, the cool air discharge port extends across a portion of the first seat. In some implementations, the freezing fan module can be at least partially accommodated in the first seat and fixed to the shroud, and the ice making fan module can be at least partially accommodated in the second seat and fixed to the shroud.

In some implementations, the grille panel further defines an ice making outlet that is separate from the cool air discharge port and configured to supply a portion of cool air in the second cool air guide channel into the freezing compartment, and the refrigerator further includes an ice maker disposed at the ice making outlet in the freezing compartment. In some implementations, the second cool air guide channel has a plurality of regions separated by the first fastening protrusion and the second fastening protrusion, and at least one of the plurality of regions is configured to communicate with the first cool air guide channel.

According to another aspect, a refrigerator includes a cabinet having a refrigerating compartment and a freezing compartment disposed below the refrigerating compartment, an ice making compartment disposed at a side of the refrigerating compartment, an evaporator disposed in the freezing compartment and configured to cool air, a shroud that is disposed at a front side of the evaporator and defines a first intake hole and a second intake hole spaced apart from each other, a grille panel that is coupled to a front surface of the shroud and defines a cool air discharge port configured to discharge cool air into the freezing compartment, a first cool air guide channel defined between the grille panel and the shroud and configured guide cool air from the first intake hole to the cool air discharge port, a second cool air guide channel defined between the grille panel and the shroud and configured to guide cool air from the second intake hole to the ice making compartment, and a partition rib that is disposed between the first cool air guide channel and the second cool air guide channel. The partition rib defines a communicating channel configured to guide cool air from the second cool air guide channel to the first cool air guide channel. The refrigerator further includes a freezing fan module disposed between the grille panel and the shroud and configured to supply cool air to the first cool air guide channel, and an ice making fan module disposed between the grille panel and the shroud and configured to supply cool air to the second cool air guide channel. The communicating channel is positioned closer to the cool air discharge port than to the first intake hole.

Implementations according this aspect may include one or more of the following features. For example, the partition rib can include a first partition rib and a second partition rib that are disposed between the first cool air guide channel and the second cool air guide channel and that extend away from each other, and the communicating channel can be defined between end portions of the first partition rib and the second partition rib that are spaced apart from and face each other. In some examples, the end portions of the first partition rib and the second partition rib extend parallel to each other, and the communicating channel is an air passage having a predetermined length.

In some implementations, the cool air discharge port includes an upper cool air discharge port defined above a center of the grille panel, and a lower cool air discharge port defined below the upper cool air discharge port. In some examples, the communicating channel includes a first communicating channel configured to guide cool air toward the upper cool air discharge port. In some examples, the communicating channel further includes a second communicating channel configured to guide cool air toward the lower cool air discharge port. In some implementations, the second communicating channel is positioned below the ice making fan module.

According to another aspect, a refrigerator includes a cabinet having a refrigerating compartment and a freezing compartment disposed below the refrigerating compartment, an ice making compartment disposed at a side of the refrigerating compartment, an evaporator disposed in the freezing compartment and configured to cool air, a shroud that is disposed at a front side of the evaporator and defines a first intake hole and a second intake hole spaced apart from each other, a grille panel that is coupled to a front surface of the shroud and defines a cool air discharge port configured to discharge cool air into the freezing compartment, a first cool air guide channel defined between the grille panel and the shroud and configured to guide cool air from the first intake hole to the cool air discharge port, a second cool air guide channel defined between the grille panel and the shroud and configured to guide cool air from the second intake hole to the ice making compartment, a partition rib that separates the first cool air guide channel and the second cool air guide channel from each other, a freezing fan module disposed between the grille panel and the shroud and configured to supply cool air to the first cool air guide channel, and an ice making fan module disposed between the grille panel and the shroud and configured to supply cool air to the second cool air guide channel. A diameter of the second intake hole is less than a diameter of the first intake hole.

Implementations according this aspect may include one or more of the following features. For example, the ice making fan module includes an ice making fan, and the freezing fan module includes a freezing fan, where a size and a shape of the ice making fan are identical to a size and a shape of the freezing fan, respectively. In some examples, the ice making fan is configured to rotate at a higher speed than the freezing fan.

In some implementations, the shroud includes a covering member that extends along an inner circumferential surface of the second intake hole such that the diameter of the second intake hole is less than the diameter of the first intake hole.

In some implementations, installation frames of the fan modules can be fastened and fixed to the shroud by a plurality of fastening protrusions. Accordingly, the fan modules may be stably installed and the flow direction of cool air may be mechanically controlled.

In some implementations, the second intake hole formed at the shroud may be formed to expose only a half or less of impellers of the ice making fan module. Accordingly, it may be possible to reduce a flow loss due to backflow of cool air supplied to the second cool air guide channel through the second intake hole.

In some implementations, the second intake hole may be formed such that the impellers of the ice making module are not exposed. Accordingly, cool air supplied to the second cool air guide channel may not flow backward through the second intake hole, whereby the cool air may have high pressure.

In some implementations, since the fan modules are disposed on the front of the shroud and seats are formed at the grille panel such that the fan modules can be partially accommodated, the grille panel assembly can be made slim.

In some implementations, since a portion of cool air supplied to the ice making compartment can be supplied to the freezing compartment, cool air can be sufficiently supplied to the freezing compartment.

In some implementations, since the second intake hole for the ice making fan module is formed smaller than the first intake hole, cool air can be sufficiently supplied to the ice making compartment at a far positions.

In some implementations, since the same two fan modules are used and are configured to obtain a large amount of air or a high blowing pressure, depending on the uses of the fan modules, fan modules can be shared.

In some implementations, since the communicating tube formed at the partition ribs includes the first communicating tube that guides cooling air to the upper cool air discharge port and a second communicating channel that guides cooling air to the lower cool air discharge port, cool air can be uniformly and sufficiently supplied to the entire freezing compartment.

In some implementations, since a portion of cooling air supplied to the ice making compartment is continuously sprayed to the ice maker in the freezing compartment through the ice making outlet, sufficient ice can be produced in the ice maker.

DETAILED DESCRIPTION

Figure 67:
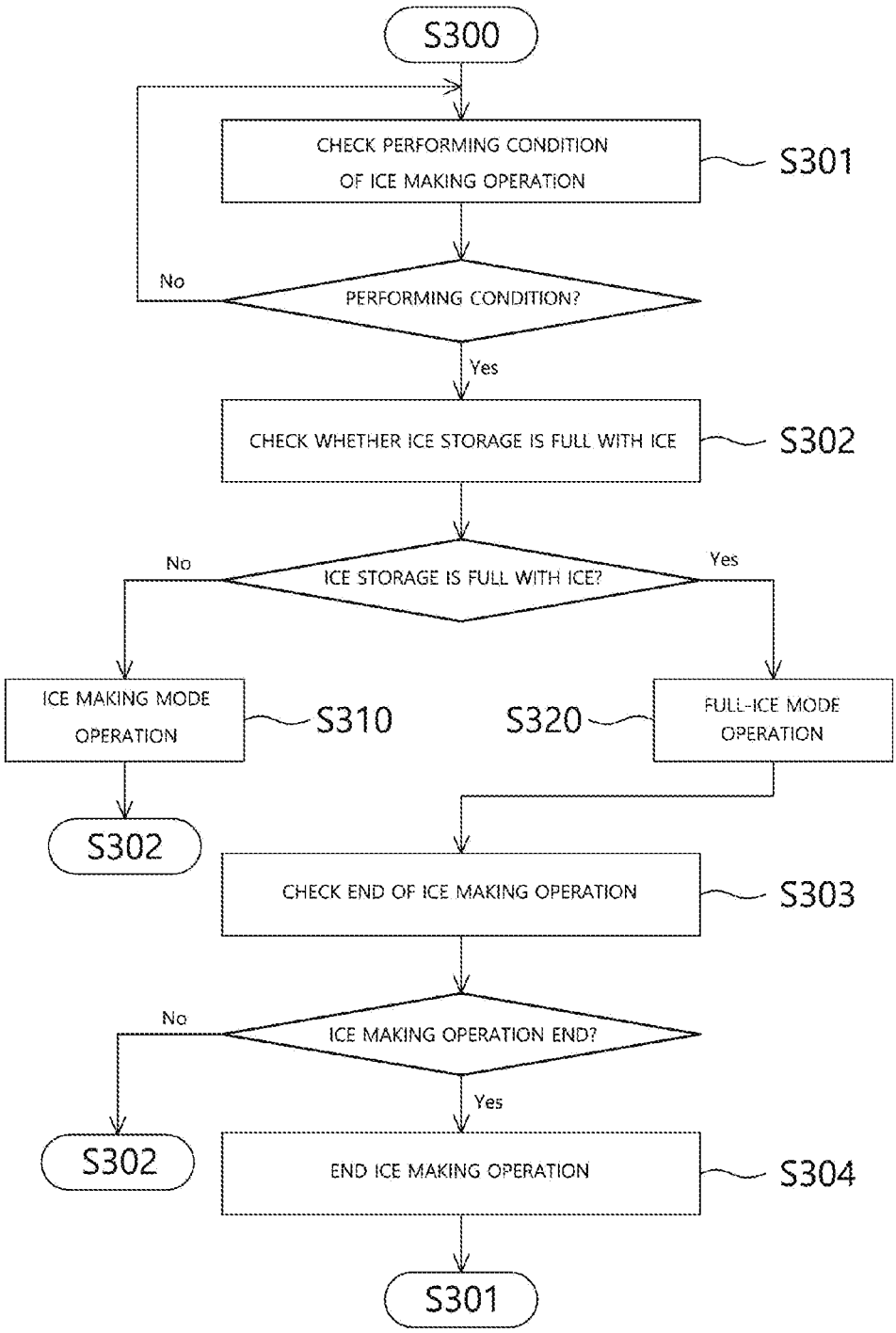
FIG. 67 is a flowchart showing an example of a control method in an ice making operation.
Figure 68:
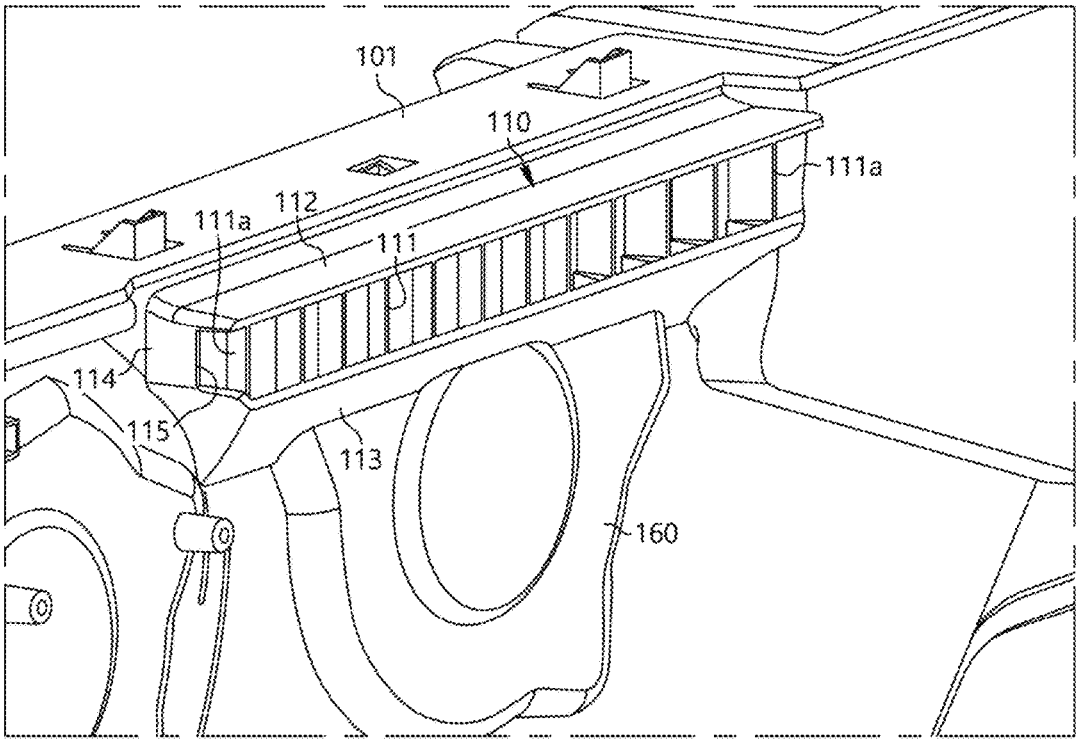
Figure 69:
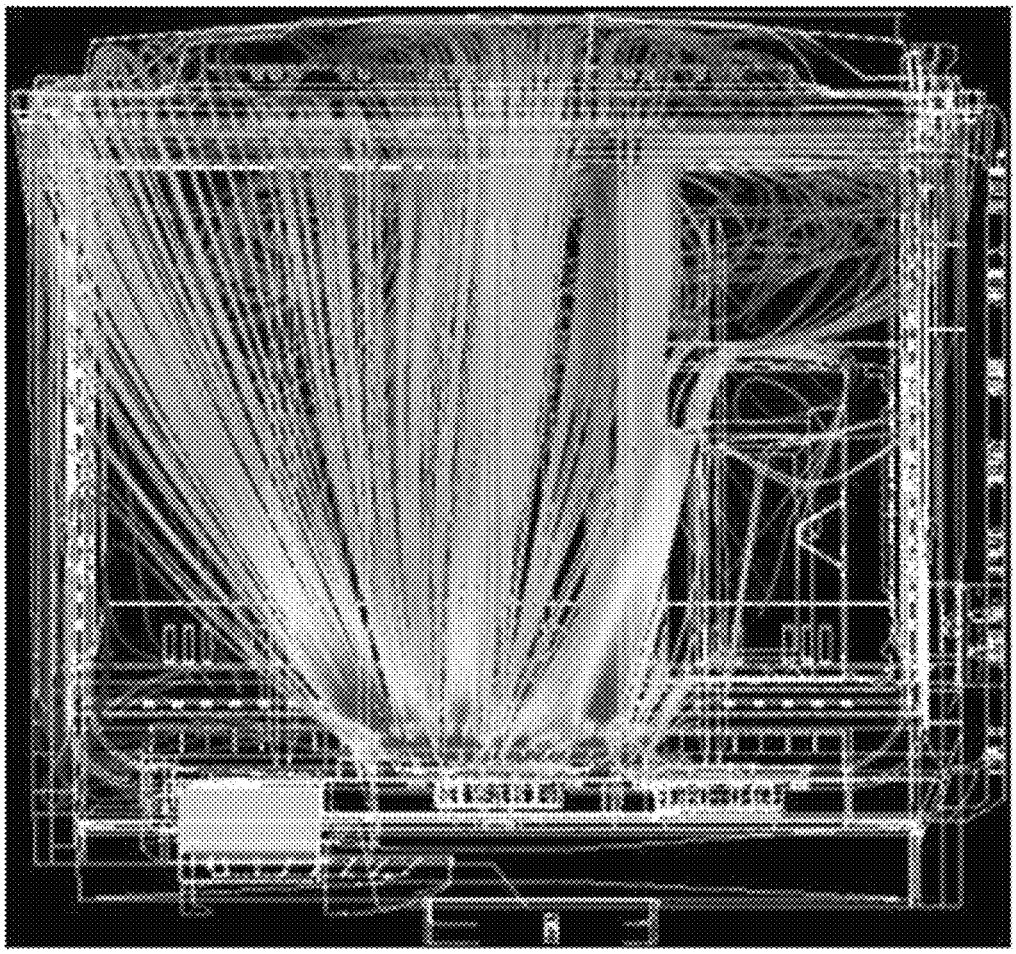
Figure 70:
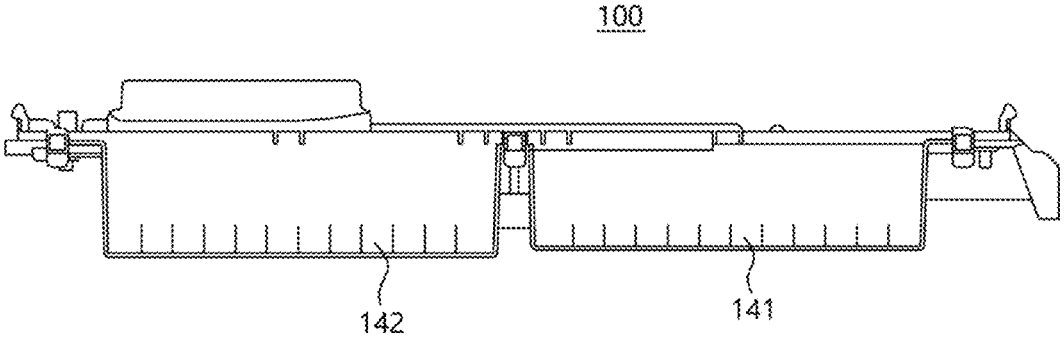
Figure 71:
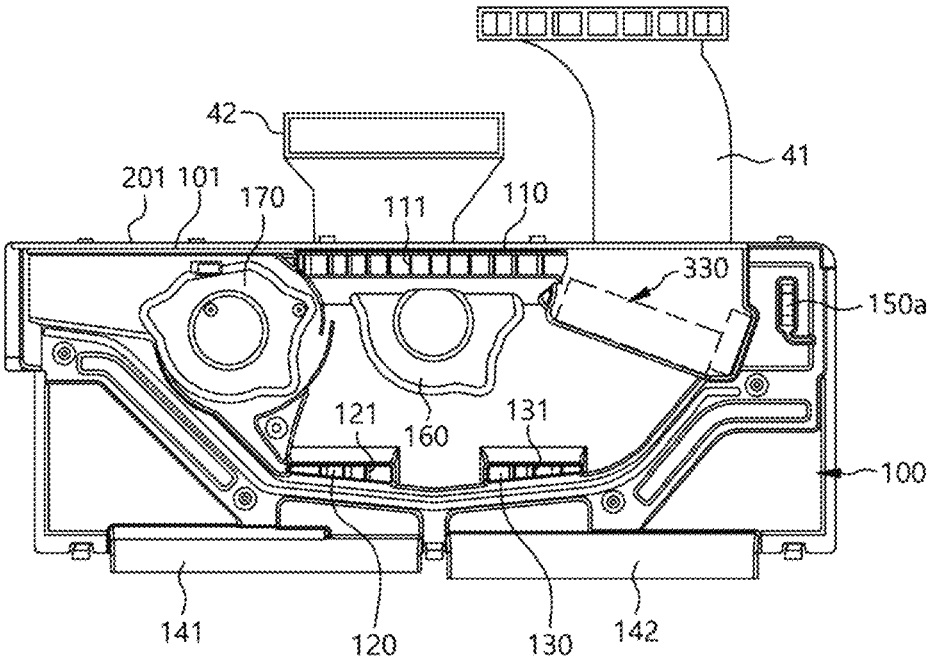
Figure 72:
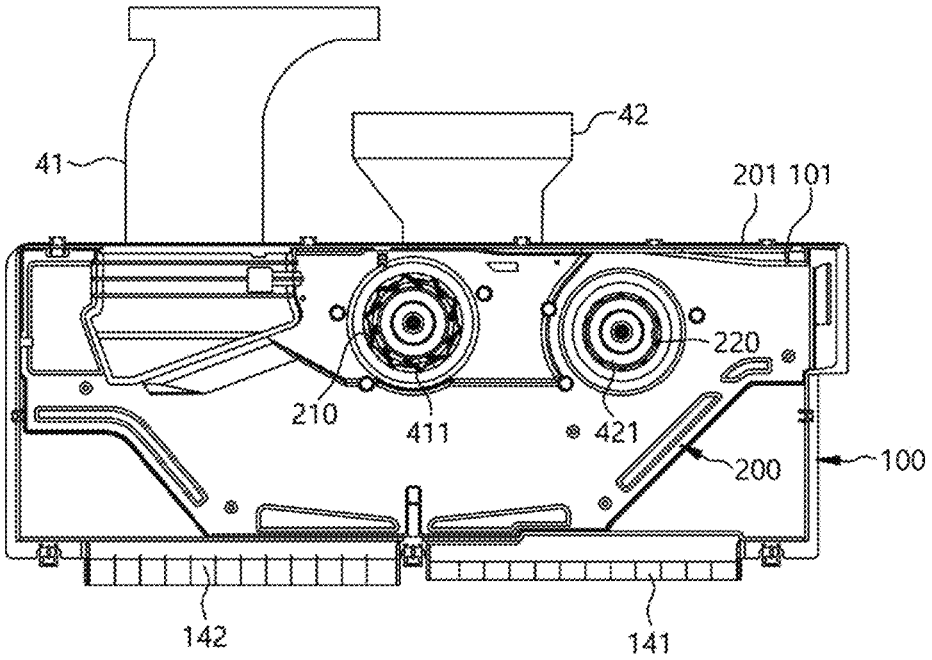
Figure 73:
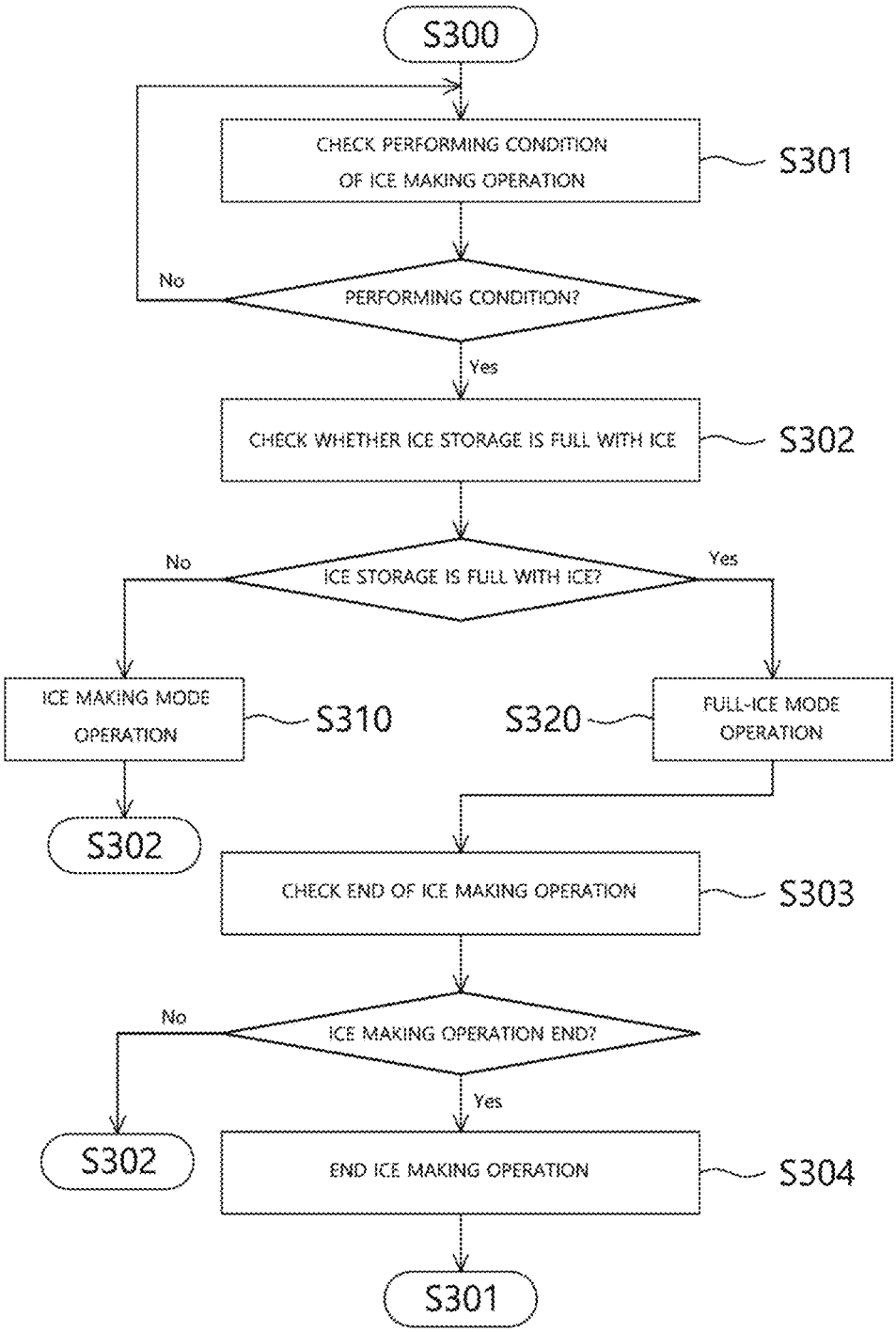

Hereafter, one or more implementations of a refrigerator are described with reference to FIGS. 1 to 67.

Figure 1:
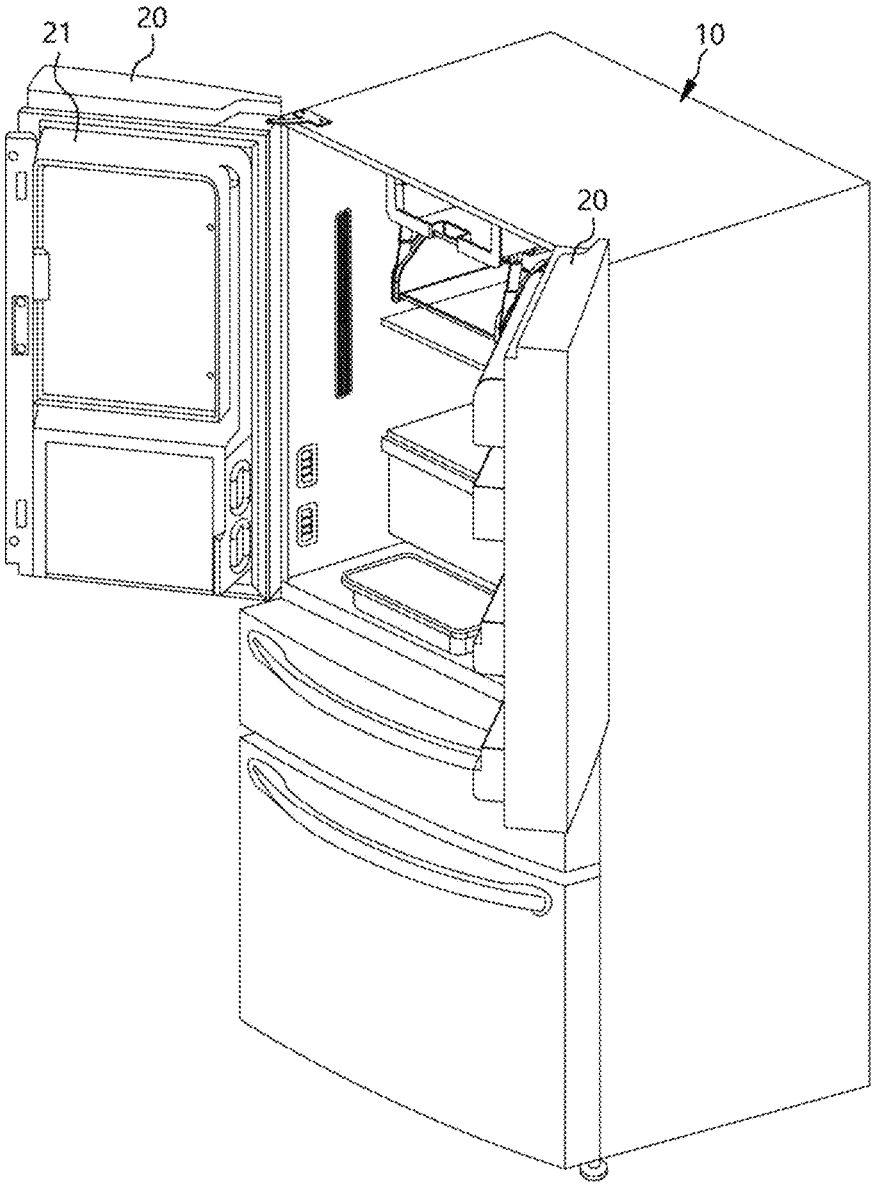
FIG. 1 is a perspective view showing an example of an external structure of an example refrigerator.
Figure 2:
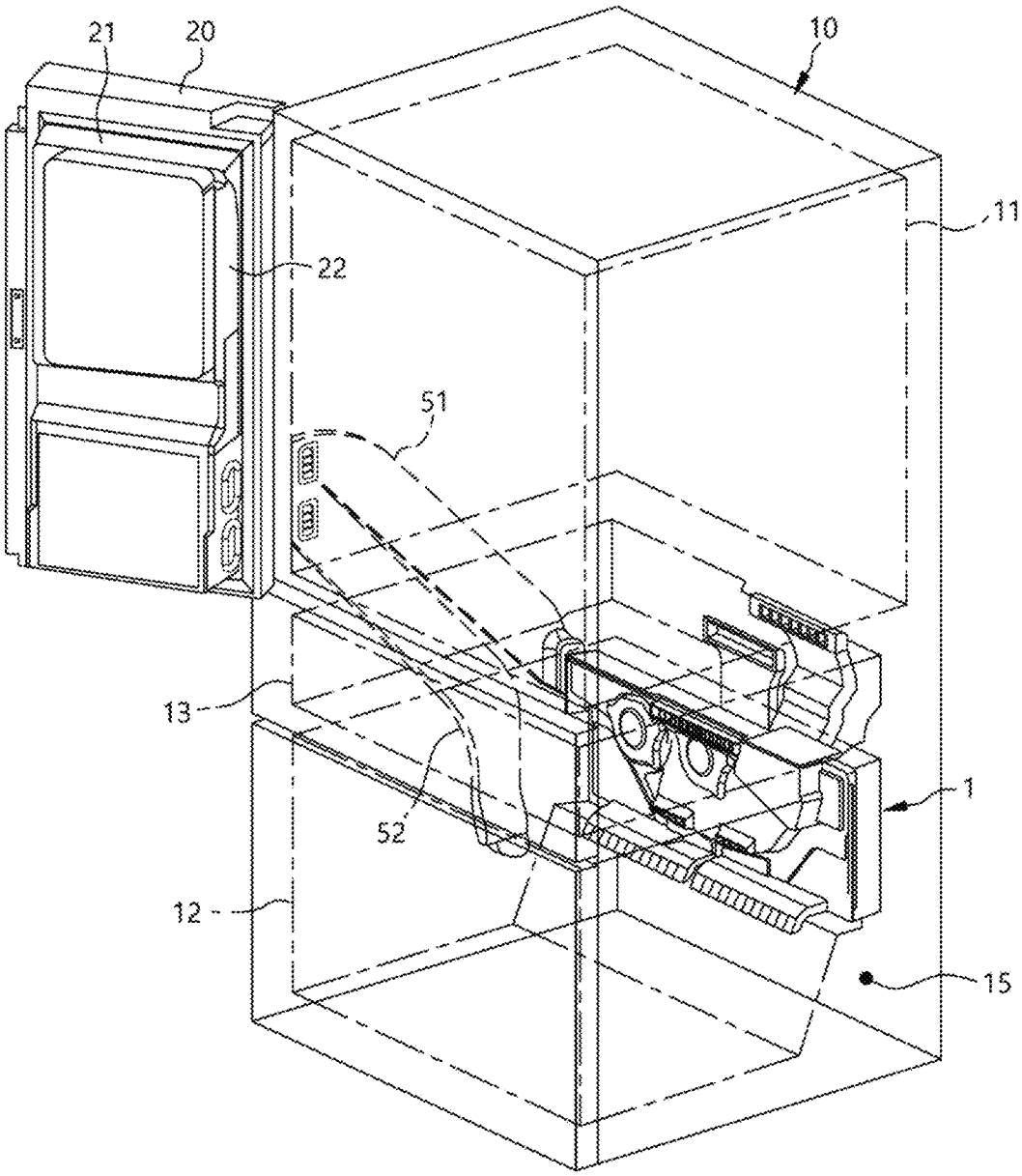
FIG. 2 is a perspective view schematically showing an example of an internal structure of the refrigerator.

FIG. 1 is a perspective view showing an example of an external structure of a refrigerator according to a first implementation, and FIG. 2 is a perspective view schematically showing an example of an internal structure of the refrigerator.

Figure 3:
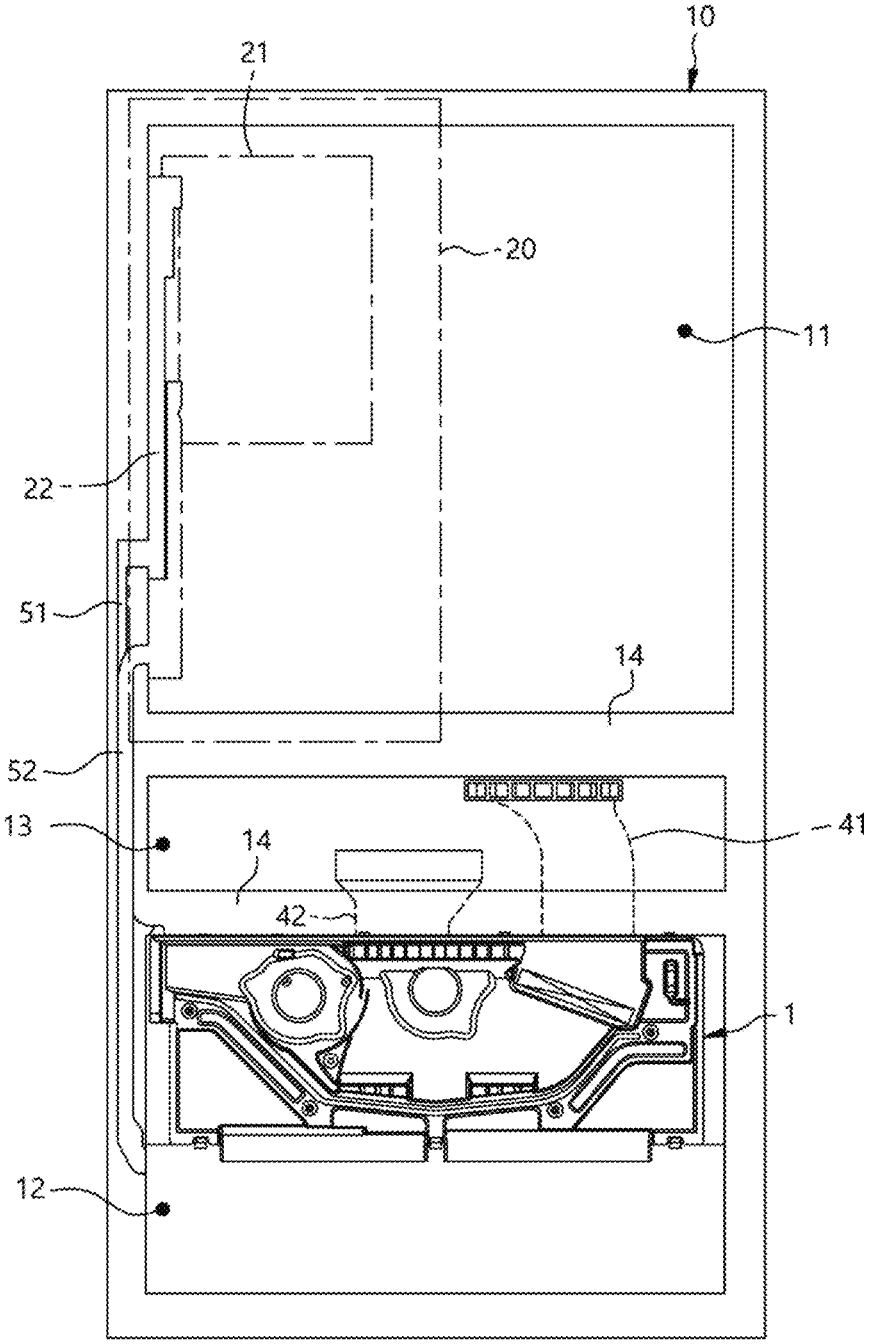
FIG. 3 is a front cross-sectional view schematically showing the internal structure of the refrigerator.
Figure 4:
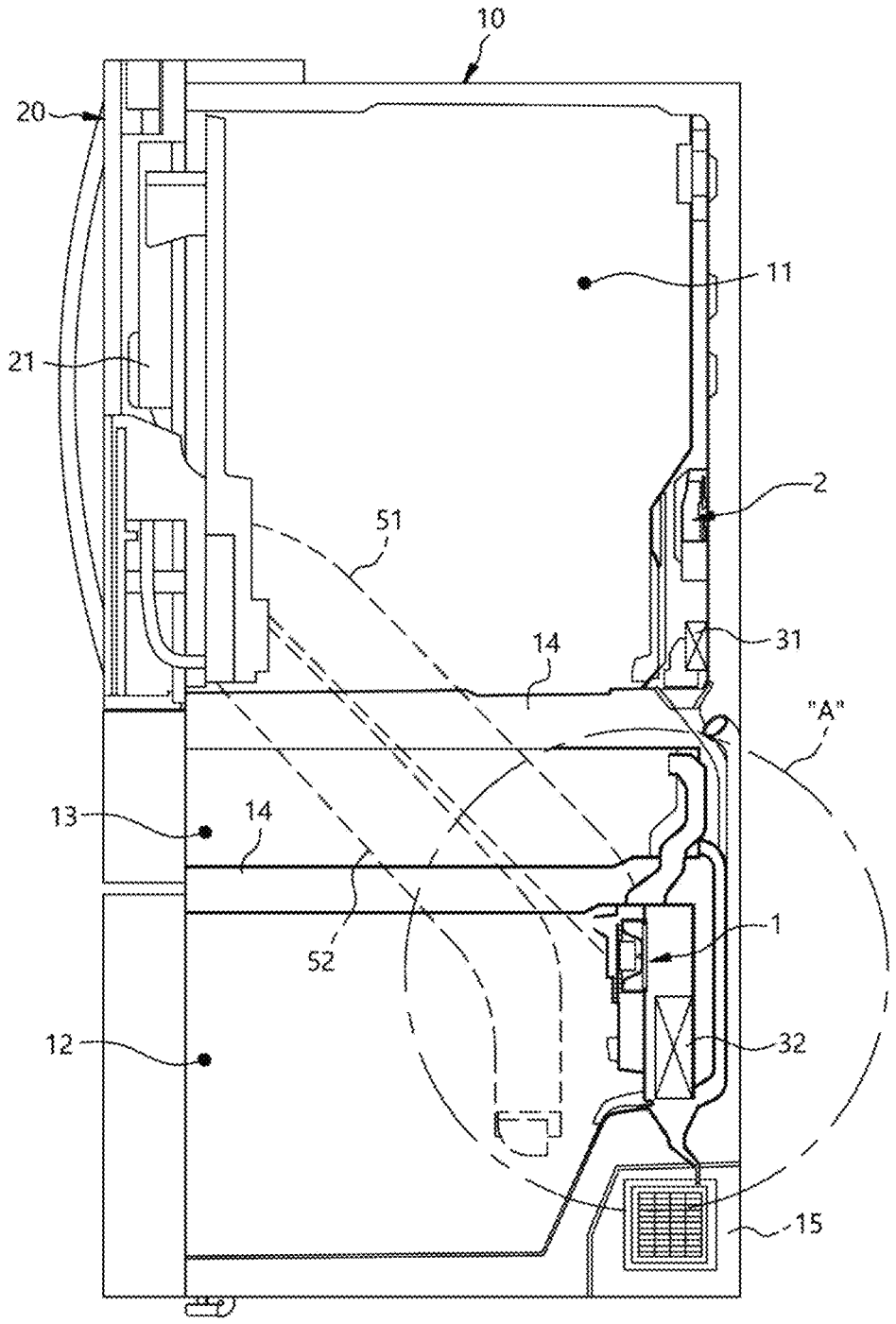
FIG. 4 is a side cross-sectional view schematically showing the internal structure of the refrigerator.
Figure 5:
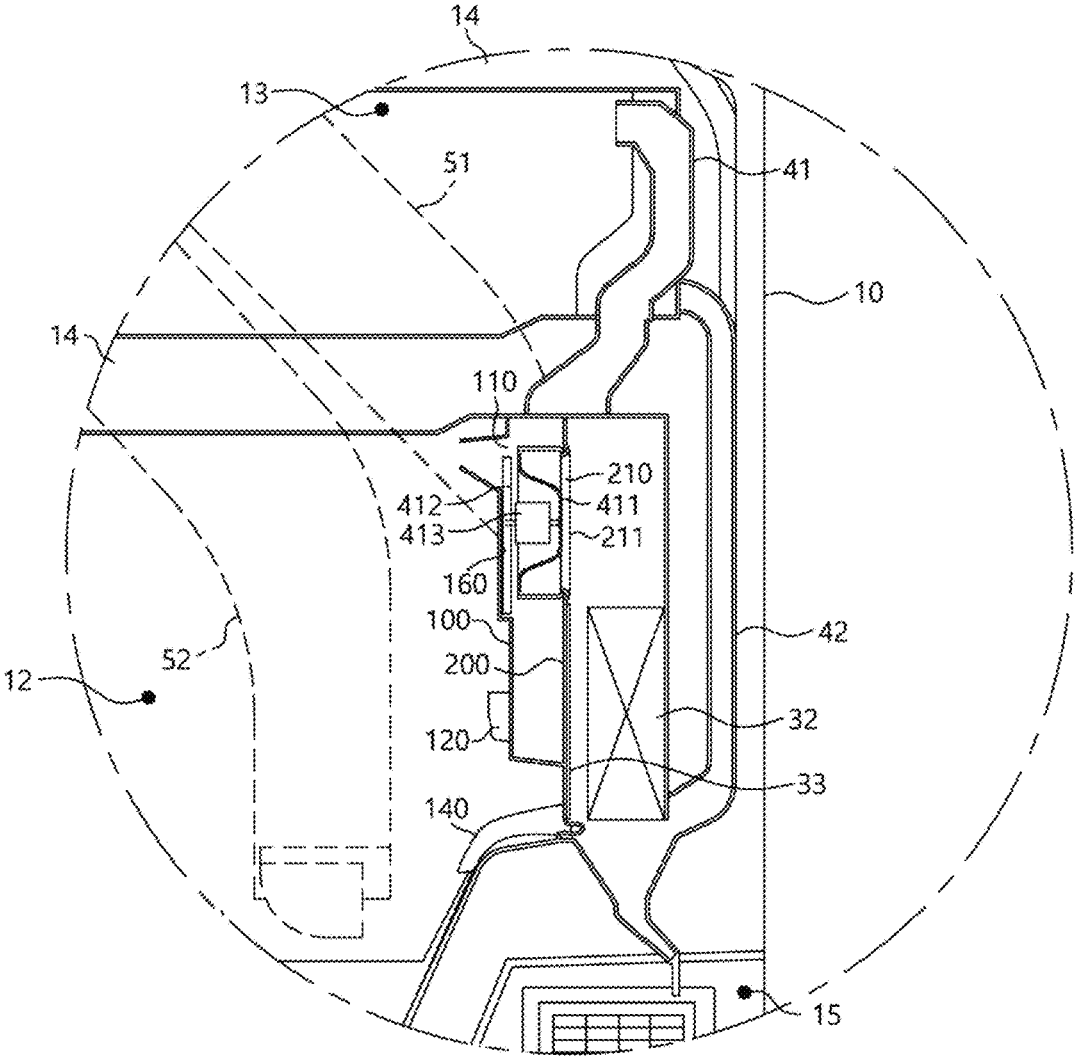
FIG. 5 is an enlarged view of the part "A" of FIG. 4.

FIGS. 3 to 5 are views showing examples of the internal structure of the refrigerator.

As shown in these figures, a refrigerator according to a first implementation includes a cabinet 10 having a refrigerating compartment 11 and a freezing compartment 12, and a refrigerating compartment door 20 having an ice making compartment 21.

The refrigerating compartment 11 can be a storage compartment provided to keep articles refrigerated and the freezing compartment 12 may be a storage compartment provided to keep articles frozen.

The refrigerator can further include a switch compartment 13.

The switch compartment 13 can be a storage compartment of which the use can be changed by a user. The switch compartment 13 can be configured to share an evaporator 31 with the freezing compartment 12, so the switch compartment 13 can be used to keep articles not only refrigerated, but also frozen therein.

On the rear wall of the cabinet 10, a first evaporator 31 may be disposed at the rear portion in the refrigerating compartment 11 and a second evaporator 32 may be disposed at the rear portion in the freezing compartment 12. The first evaporator 31 may be an evaporator provided to supply cool air into the refrigerating compartment 11 and the second evaporator 32 may be an evaporator provided to supply cool air into the freezing compartment 12, the switch compartment 13, and the ice making compartment 21. This configuration is shown in FIGS. 4 and 5.

The refrigerating compartment 11 may be positioned at the upper portion in the cabinet 10, the freezing compartment 12 may be positioned at the lower portion in the cabinet 10, and the switch compartment 13 may be positioned at the middle portion between the refrigerating compartment 11 and the freezing compartment 12 in the cabinet 10. The storage compartments (e.g., refrigerating compartment 11, freezing compartment 12, and switch compartment 13) may be separated from each other by a plurality of partitions 14 that divides the cabinet 10 up and down.

The refrigerating compartment door 20, which is a door for opening/closing the refrigerating compartment 11, may be a rotary door.

In particular, the ice making compartment 21 may be disposed inside the refrigerating compartment door 20 (on the side that is positioned in the refrigerating compartment when the refrigerating compartment door is closed). The ice making compartment 21 may be a storage compartment in which an ice maker for making ice or an ice tray may be disposed on the refrigerating compartment door 20.

Figure 6:
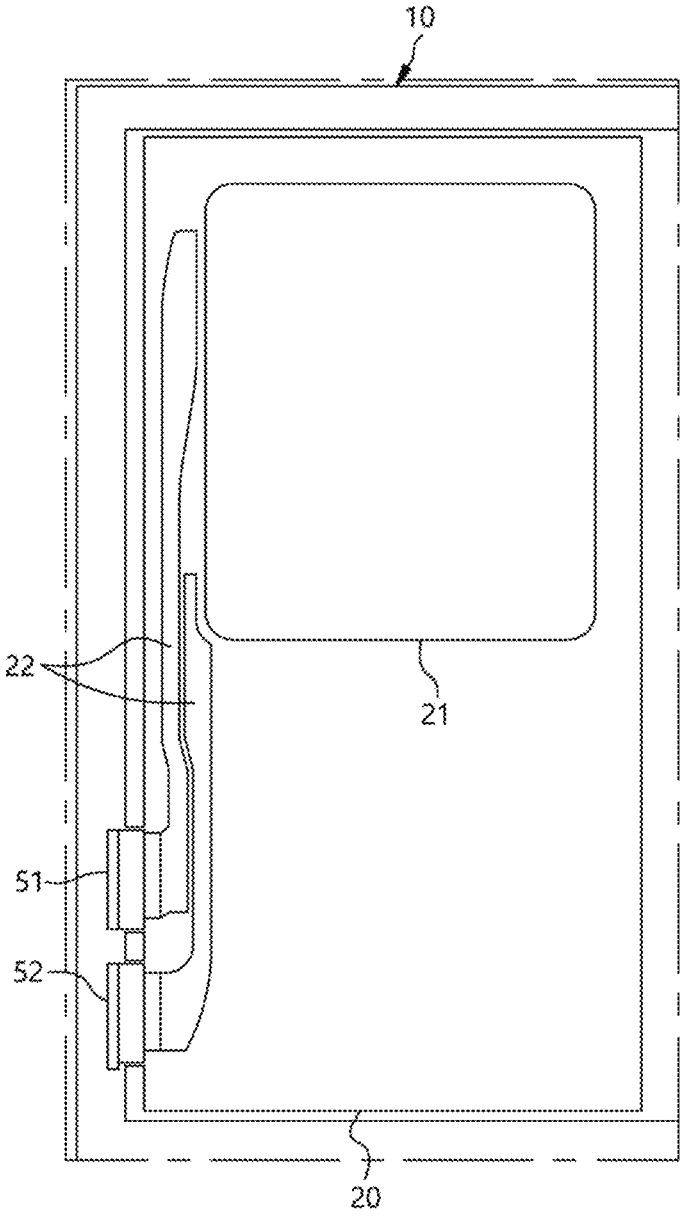
FIG. 6 is an enlarged view showing example parts of a structure that supplies or recovers cool air to or from an ice making compartment of the refrigerator.

The ice making compartment 21 may be configured to be supplied with cool air from an ice making compartment cool air duct 51 through a guide duct 22 and then to discharge cool air to an ice making compartment return duct 52. This configuration is shown in FIG. 6.

A grille panel assembly 1 may be provided ahead of the second evaporator 32 in the cabinet 10 and another grille panel assembly 2 may be provided ahead of the first evaporator 31 in the cabinet 10. In some examples, the grille panel assembly may be referred to as a grille plate assembly, grill plate assembly, grille pan assembly, grill pan assembly, grille fan assembly, or grill fan assembly.

The grille panel assemblies 1 and 2 may be formed equally or differently.

The switch compartment 13 may not be provided with a separate grille panel assembly and may be configured to be supplied with cool air from the grille panel assembly 1 positioned ahead of the second evaporator 32.

That is, a machine room may be formed at the lower portion in the rear space in the freezing compartment 12, so the vertical height of the rear space may be smaller than that of the front space in the freezing compartment 12.

Accordingly, the grille panel assembly 1 may be provided in the rear space in the freezing compartment 12. In some examples, a compressor and a condenser forming a refrigeration cycle may be disposed in the machine room 15, whereby heat exchange may be possible through the first evaporator 31 and the second evaporator 32.

Figure 7:
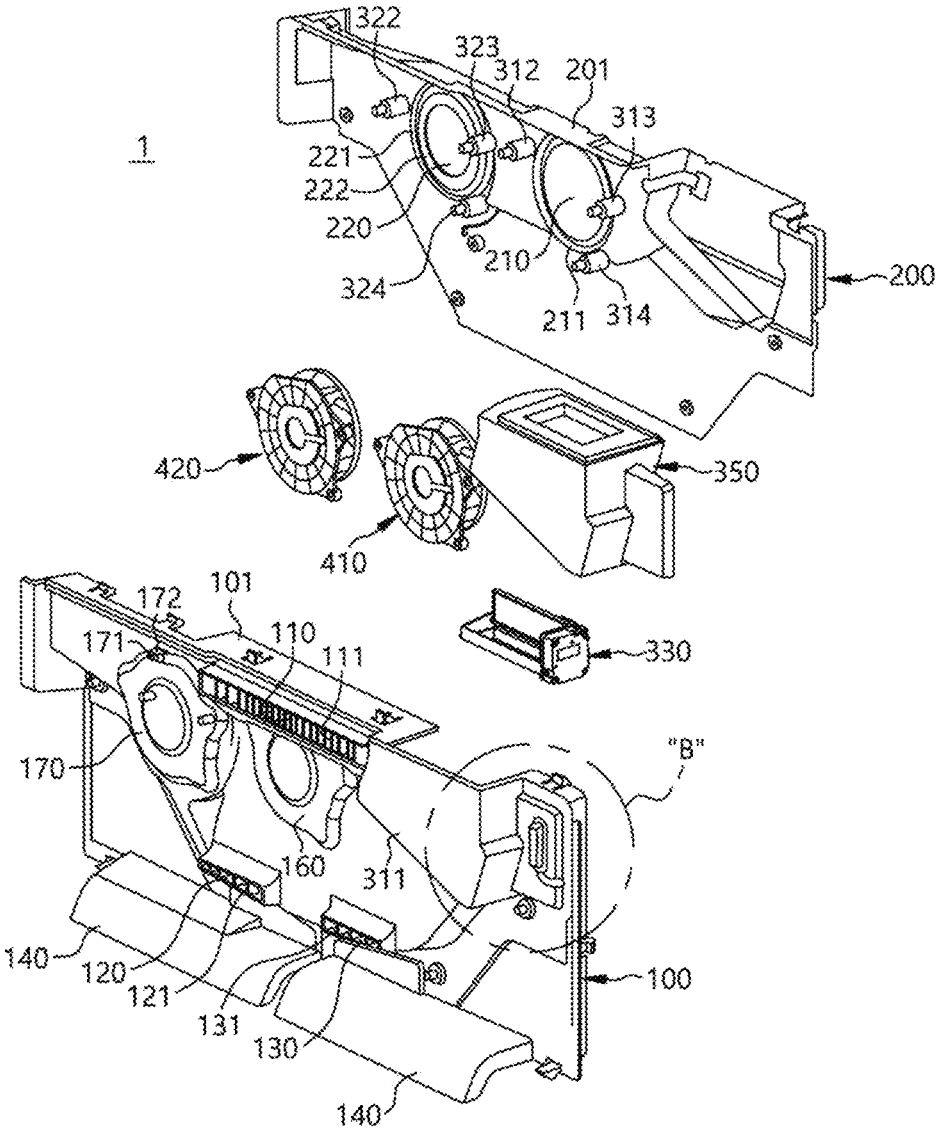
FIG. 7 is an exploded perspective view showing an example of a grille panel assembly of the refrigerator.

As shown in FIG. 7, the grille panel assembly 1 provided in the freezing compartment 12 may include, among other things, a grille panel 100, a shroud 200, a first cool air guide channel 310, a second cool air guide channel 320, a freezing fan module 410, an ice making fan module 420, and partition ribs 510 and 520.

The components of a first implementation of the grille panel assembly 1 are described hereafter in more detail.

The grille panel assembly 1 can include the grille panel 100.

As shown in FIGS. 4 and 5, the grille panel 100 may be a part forming the front wall of the grille panel assembly 1.

Cool air discharge ports 110, 120, and 130 may be formed at the grille panel 100 (see FIGS. 7 to 10).

The cool air discharge ports 110, 120, and 130 may be openings for supplying cool air into the freezing compartment 12 and may be formed in the first cool air guide channel 310 to be described below.

The cool air discharge ports 110, 120, and 130 may include an upper cool air discharge port 110 formed over the center of the grille panel 100 when the grille panel 100 is seen from the front (or the rear).

The upper cool air discharge port 110 can be a part allowing cool air forcibly blown by rotation of the freezing fan module 410 to the discharged to the space in which the upper wall is disposed in the freezing compartment 12.

The upper cool air discharge port 110 can be positioned further over the center of the freezing fan module 410 of the parts in the first cool air guide channel 310. Accordingly, cool air that is discharged to the cool air discharge port 110 may be discharged to the space in which the upper wall is disposed in the freezing compartment 12.

The upper cool air discharge port 110 can be smaller in vertical height than the freezing fan module 410, and can be larger in left-right width than the freezing fan module 410.

Accordingly, cool air flowing in the circumferential direction of the freezing fan module 410 by rotation of the freezing fan module 410 may be sufficiently discharged to the freezing compartment 12 through the upper cool air discharge port 110.

The upper cool air discharge port 110 may include a hole and a tube protruding forward.

Figure 11:
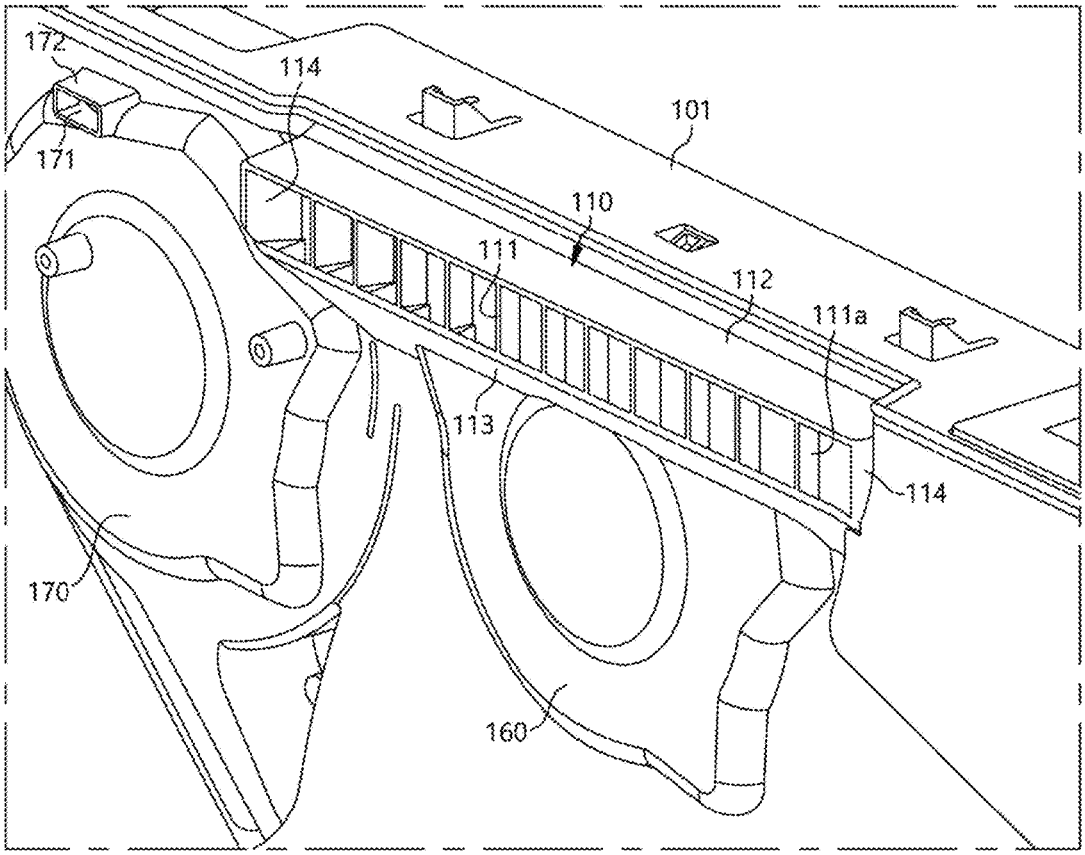
FIGS. 11 and 12 are perspective views showing example parts including an example of an upper cool air discharge port of the refrigerator.
Figure 12:
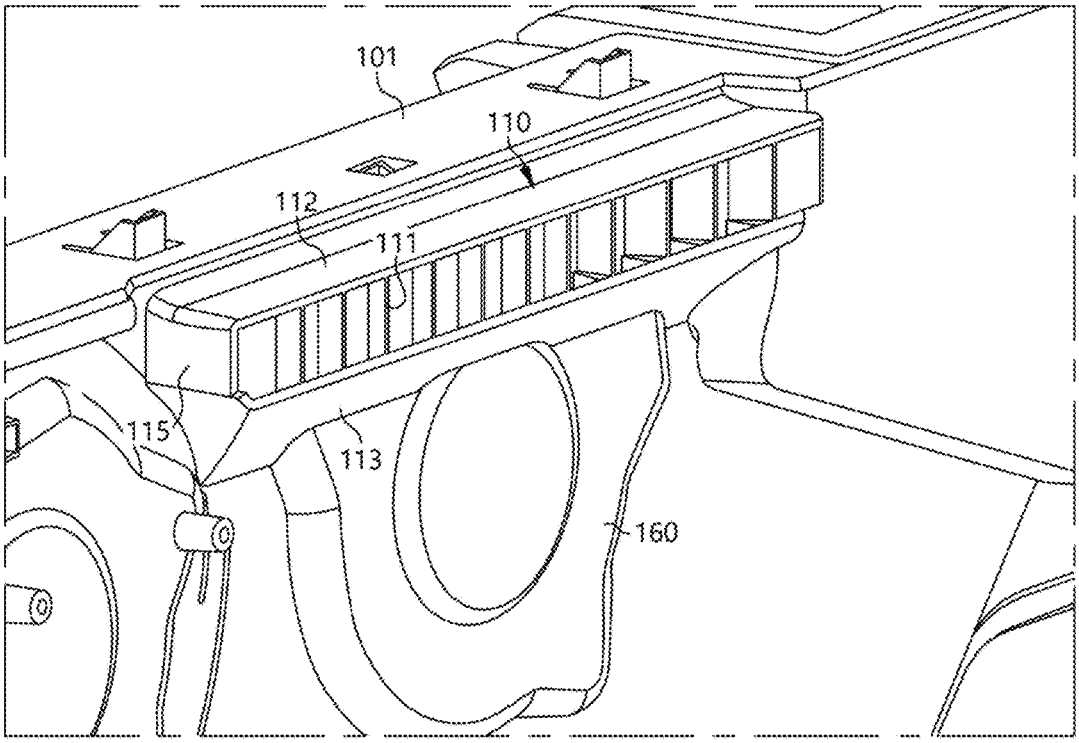

In some implementations, the upper cool air discharge port 110 may be a polygonal tube having a top wall 112 at the upper portion, a bottom wall 113 at the lower portion, and two side walls 114 at both sides. This configuration is shown in FIGS. 11 and 12.

That is, straightness may be given to the cool air passing through the tube-shaped upper cool air discharge port 110. Accordingly, the cool air passing through the upper cool air discharge port 110 may be discharged straight directly forward without spreading up and down and may be supplied to the front in the freezing compartment 12.

Figure 13:
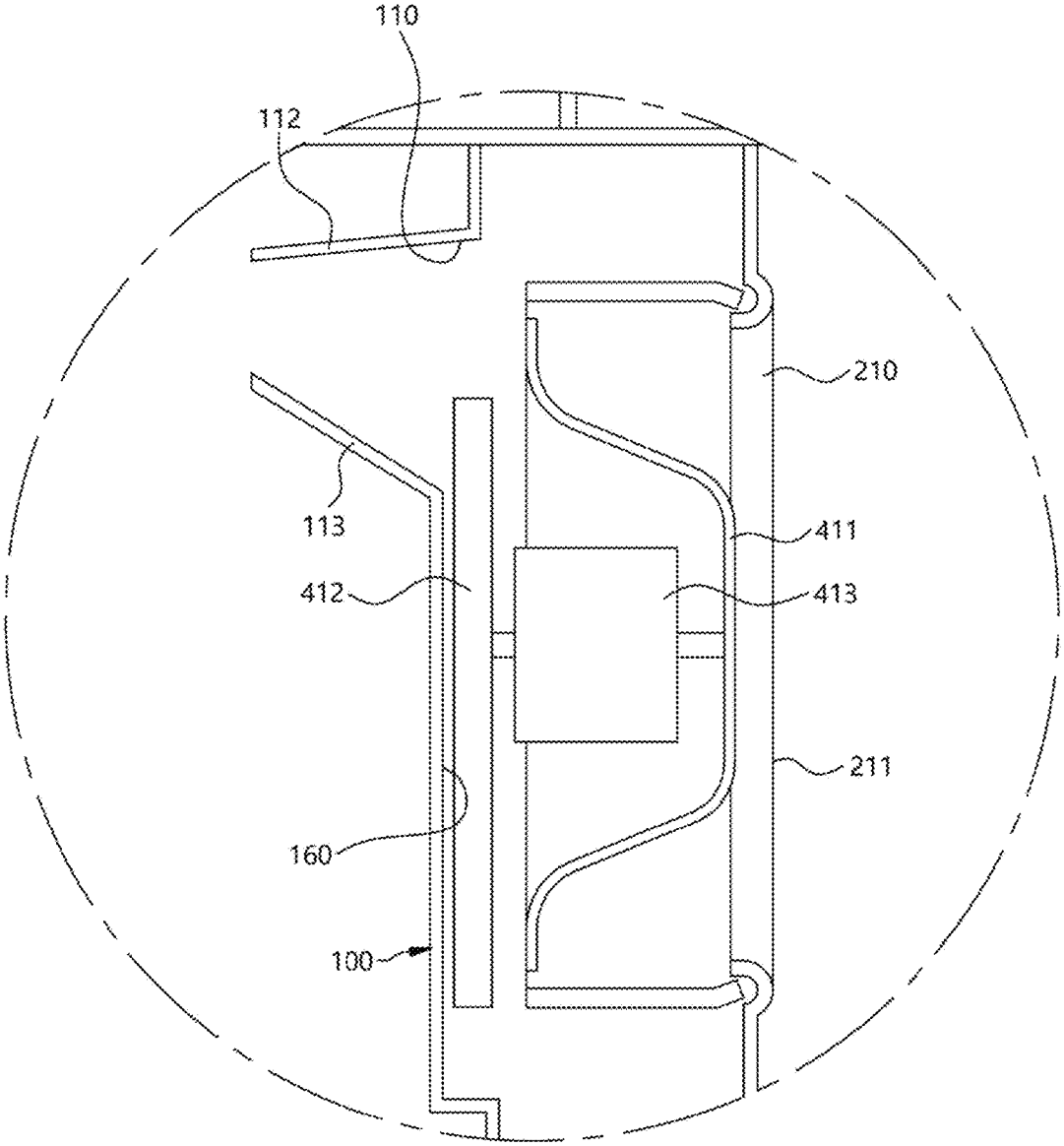
FIG. 13 is an enlarged view showing example parts and the upper cool air discharge port of the refrigerator.

The bottom wall 113 of the upper cool air discharge port 110, as shown in FIG. 13, may be gradually inclined up and down (or rounded) as it goes from the lower end in the protrusion direction (forward). That is, by the inclined structure, the cool air flowing in the circumferential direction of the freezing fan 411 may flow on the rear of the grille panel 100 to be smoothly guided to the bottom wall 113 of the upper cool air discharge port 110 and may keep flow on the bottom wall 113 to be smoothly discharged forward.

The inclination may be a straight inclination and may be a rounded inclination. The rounded inclination may further smoothly guide flow of the cool air.

In some examples, the top wall 112 of the upper cool air discharge port 110 may be inclined downward as it goes forward.

A plurality of grille ribs 111 may be formed in the upper cool air discharge port 110.

The grille ribs 111 may be ribs that guide the discharge direction of the cool air that is discharged to the upper cool air discharge port 110.

The grille ribs 111 may be spaced apart from each other and may be inclined forward or toward both sides.

Figure 10:
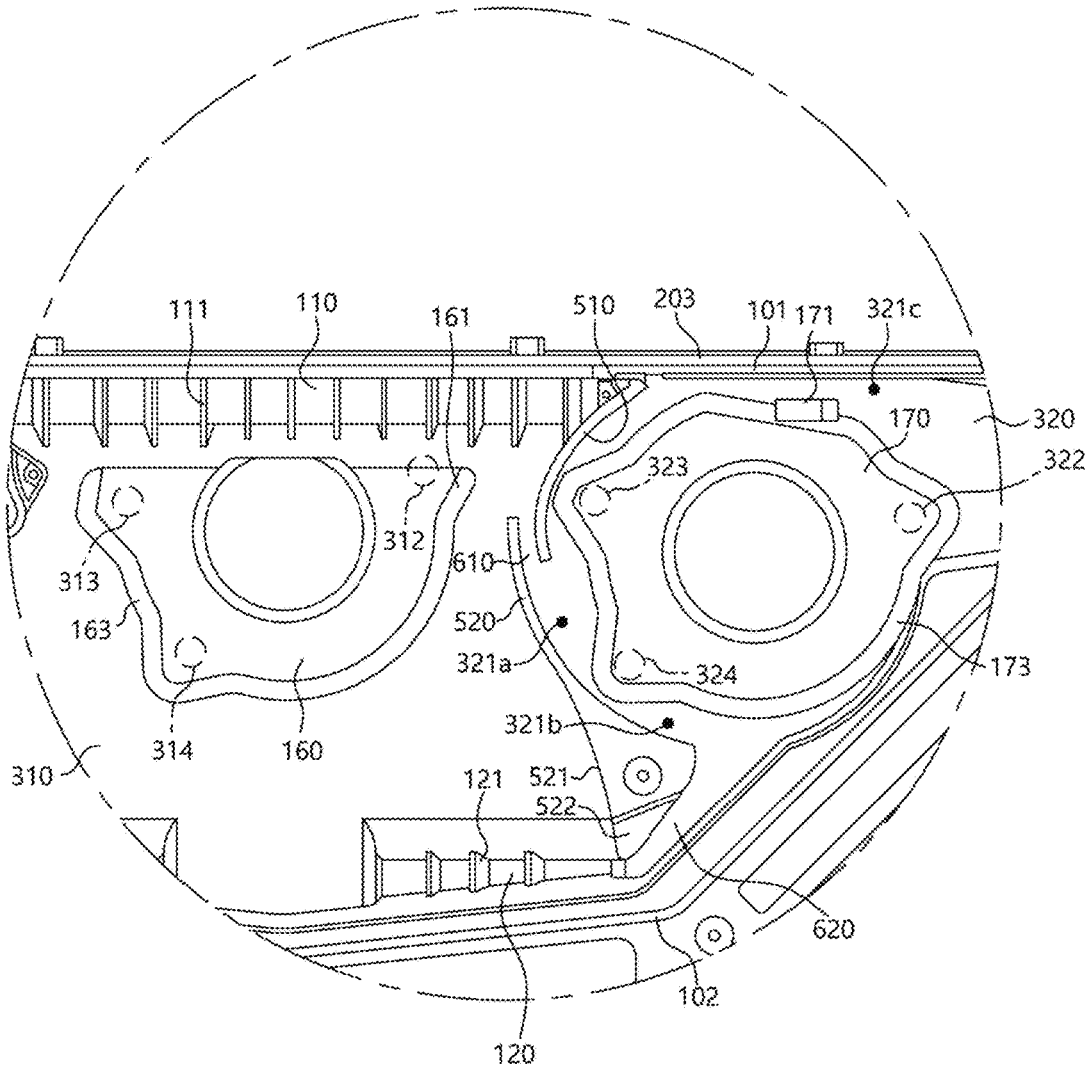
FIG. 10 is an enlarged view of the part "B" of FIG. 9.

The grille ribs 111 may be formed to have different inclination angles, as in FIG. 10.

This may be for enabling cool air that is guided by the grille ribs 111 to be discharged in different directions. That is, this may be for enabling cool air to be uniformly supplied into the entire freezing compartment by supplying cool air in different directions.

In some examples, all grille ribs 111 may not need to be inclined in different directions. That is, some adjacent grille ribs 111 may be formed to have the same inclination angle.

For example, the grille ribs at both sides may be formed to have a large inclination angle in comparison to the grille ribs at the center of the upper cool air discharge port 110.

That is, the cool air guided to the grille ribs 111 at the center may have straightness and may be discharged to a far position, and the cool air guided to the grille ribs 111 at both sides may be supplied up to the rear portions (adjacent to the grille panel assembly) of both side walls of the freezing compartment 12.

Accordingly, although cool air is discharged to the upper cool air discharge port 110 that is smaller in left-right width than the inside of the freezing compartment 12, cool air may be uniformly discharged into the entire freezing compartment 12.

In some examples, the more the grille ribs 111 are positioned outside in the upper cool air discharge port 110, the more the grille ribs 111 may be inclined outward such that cool air may be uniformly supplied to a wider space.

The cool air discharge ports 110, 120, and 130 may include lower cool air discharge ports 120 and 130.

The lower cool air discharge ports 120 and 130 may be openings provided to supply cool air to the middle space of the freezing compartment 12. That is, considering that the upper cool air discharge port 110 is configured to supply cool air only to the top in the freezing compartment 12, cool air may be relatively insufficiently supplied to the middle portion in comparison to the top. Accordingly, the lower cool air discharge ports 120 and 130 may be additionally provided such that cool air may be supplied to the middle portion in the freezing compartment 12.

The lower cool air discharge ports 120 and 130 may be formed at both sides under the upper cool air discharge port 110 of the parts in the first cool air guide channel 310.

In particular, the lower cool air discharge ports 120 and 130 may be formed at the lower portion in the first cool air guide channel 310 such that cool air may be discharged ahead of the grille panel 100 in the freezing compartment 12 while flowing along the bottom in the first cool air guide channel 310.

That is, since the lower cool air discharge ports 120 and 130 may supply cool air into the freezing compartment 12 under the upper cool air discharge port 110, cool air may be sufficiently supplied to the middle portion in the freezing compartment 12.

The lower cool air discharge ports 120 and 130 may include a first lower cool air discharge port 120 formed at any one side (at the right side in figures when the grille panel is seen from the front) of the bottom in the first cool air guide channel 310 and a second lower cool air discharge port 130 formed at the other side (at the left side in figures when the grille panel is seen from the front). That is, cool air may be additionally supplied to the freezing compartment 12 while sequentially passing through the first lower cool air discharge port 120 and the second lower cool air discharge port 130 when flowing through the first cool air guide channel 310.

The first lower cool air discharge port 120 and the second lower cool air discharge port 130 may be formed to be more open as they go to the center of the grille panel 100. That is, considering that articles are stored much at the center than at both sides in the freezing compartment 12, much cool air may be discharged to the center.

The upper cool air discharge port 110 may be larger than the sum of the sizes of the first lower cool air discharge port 120 and the second lower cool air discharge port 130 such that most of the cool air blown by the freezing fan module 410 is supplied into the freezing compartment 12 through the upper cool air discharge port 110.

A plurality of grille ribs 121 and 131 may be formed in the two lower cool air discharge ports 120 and 130.

The grille ribs 121 and 131 may have a structure giving directionality to the cool air that is discharged through the corresponding lower cool air discharge ports 120 and 130. At least some of the grille ribs 121 and 131 may be inclined to be able to guide the cool air passing through them to the sides in the freezing compartment 12.

The lower cool air discharge ports 120 and 130 may be holes and may be tubes protruding forward.

It may be exemplified in the first implementation that the lower cool air discharge ports 120 and 130 are tubes. That is, straightness may be given to the cool air passing through the tube-shaped lower cool air discharge ports 120 and 130. Accordingly, the cool air passing through the lower cool air discharge ports 120 and 130 may be discharged straight directly forward without spreading up and down and may be supplied to the front in the freezing compartment 12.

The grille panel 100 may have a suction guide 140.

The suction guide 140 may guide return flow of cool air flowing through the freezing compartment 12.

Figure 8:
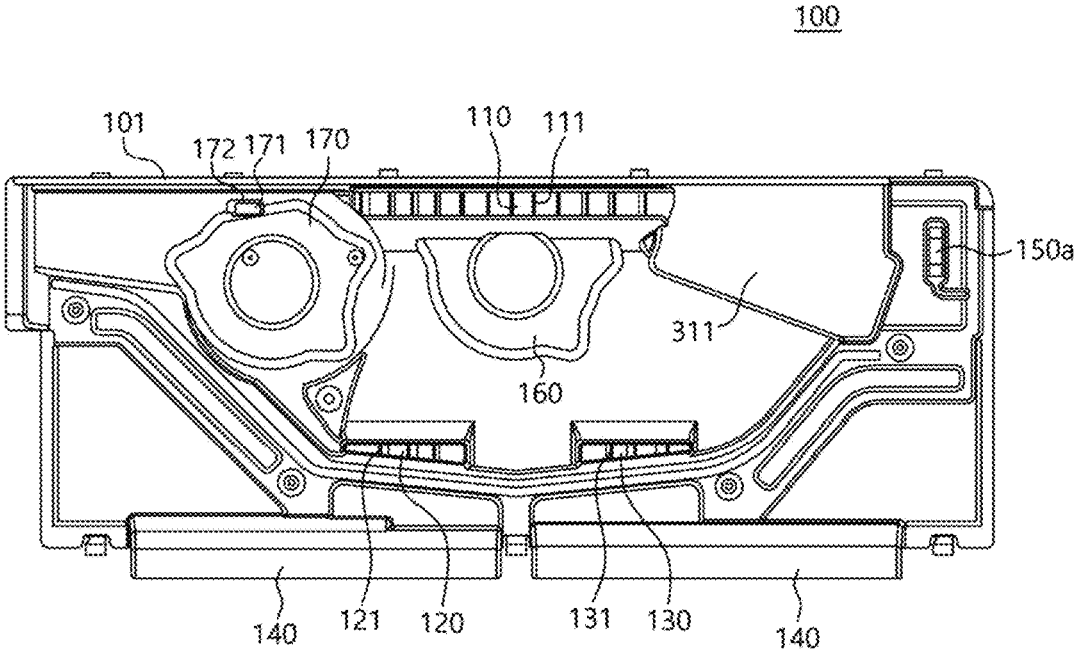
FIG. 8 is a front view showing the grille panel of the refrigerator.
Figure 9:
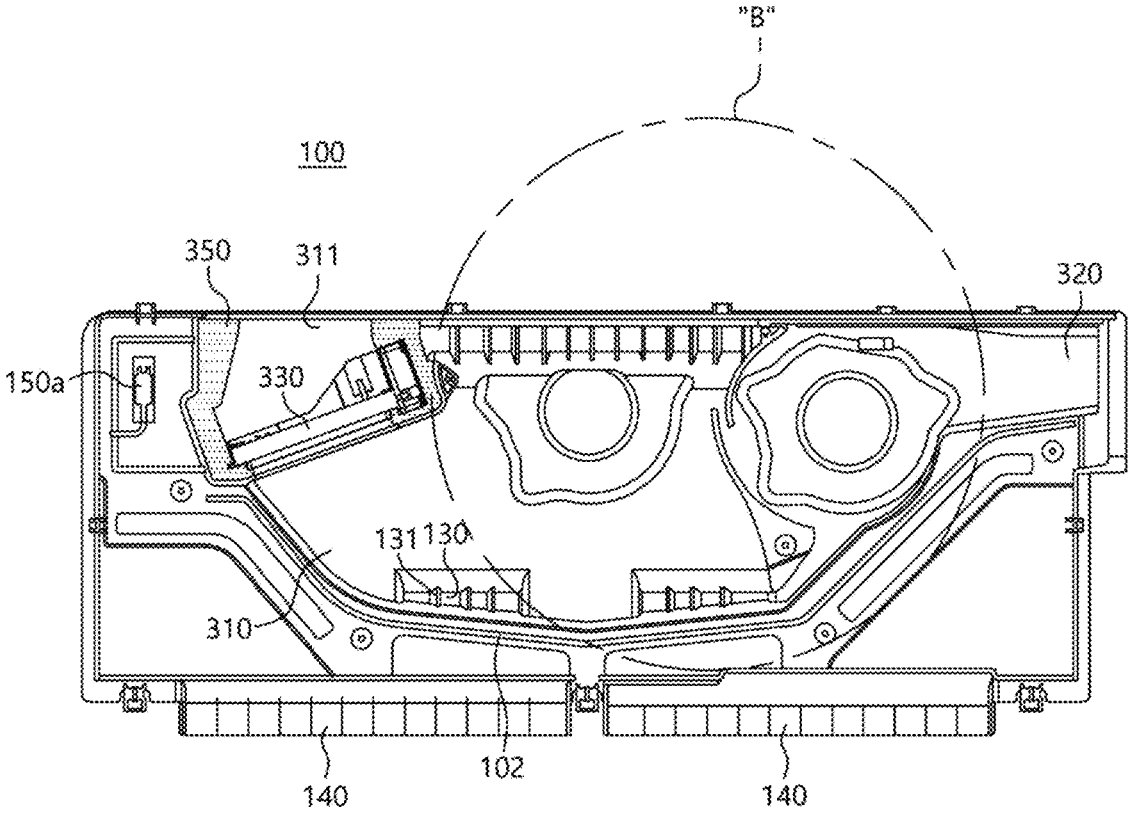
FIG. 9 is a rear view showing the grille panel of the refrigerator.

The suction guide 140, as shown in FIGS. 7 to 9, may be formed at the lower end of the grille panel 100 such that cool air returning after circulating in the freezing compartment flows to the lower end of the second evaporator 32.

The suction guide 140, as shown in FIGS. 5 and 7, may be rounded or bended in the same shape as the bottom of the freezing compartment 12 and may cover a portion of the bottom of the freezing compartment 12.

That is, cool air flowing on the bottom of the freezing compartment 12 may be guided by the suction guide 140, whereby the cool air may smoothly flow to a cool air intake side (bottom) of the second evaporator 32.

The grille panel 100 may have a temperature sensor 150*a*.

The temperature sensor 150*a* may be a sensor that senses the temperature inside the freezing compartment 12.

The temperature sensor 150*a*, as shown in FIGS. 8 and 9, may be disposed at any one of both ends of the grille panel 100.

The grille panel 100 may have a first seat 160.

The first seat 160 may be provided as a portion in which a portion of the freezing fan module 410 is accommodated.

As shown in FIGS. 7 to 10, the first seat 160 may be recessed on the rear of the grille panel 100. In some examples, as shown in FIGS. 11 and 12, the portion where the first seat 160 is formed in the grille panel 100 may protrude forward as much as the recessed depth of the first seat 160.

That is, the freezing fan 411 of the freezing fan module 410 seated in the first seat 160 may be maximally spaced apart from the second evaporator 32 disposed behind the grille panel assembly 1. Accordingly, the influence on the freezing fan 411 by the second evaporator 32 (influence by surface temperature) may be maximally reduced.

The first seat 160 may be positioned at the upper end with respect to the center on the basis of the height of the grille panel 100 and may be formed substantially at the center portion on the basis of the left-right length of the grille panel 100.

The recessed depth of the first seat 160 may be determined in consideration of the distance between the freezing fan 411 of the freezing fan module 410 and the second evaporator 32. That is, considering that condensate water may be produced on the freezing fan 411 when the freezing fan 411 is too close to the second evaporator 32, the recessed depth of the first seat 160 may be determined such that the distance between the freezing fan 411 and the second evaporator 32 is at least 3 mm or more.

The upper cool air discharge port 110 may be formed across the upper end of the first seat 160.

In particular, the open top of the first seat 160 may communicate with the bottom wall 113 of the upper cool air discharge port 110. This structure may enable a portion of the freezing fan module 410 installed in the first seat 160 to be positioned inside the upper cool air discharge port 110, whereby cool air flowing in the circumferential direction of the freezing fan 411 may be directly supplied to the upper cool air discharge port 110 and may be discharged to the open front of the upper cool air discharge port 110 when the freezing fan module 410 is operated.

In some cases, where an outlet for discharging cool air is positioned over a freezing fan module, cool air may not be directly discharged and hits against flow of cool air flowing around due to the distance between the freezing fan module and the outlet. Accordingly, cool air supplied to a storage compartment may not be sufficiently supplied up to the front in the storage compartment.

In some implementations, a portion of the freezing fan 411 of the freezing fan module 410 can be exposed to the upper cool air discharge port 110 such that cool air can be more smoothly discharged. Accordingly, cool air can be sufficiently supplied up to the front in the storage compartment (freezing compartment).

Figure 14:
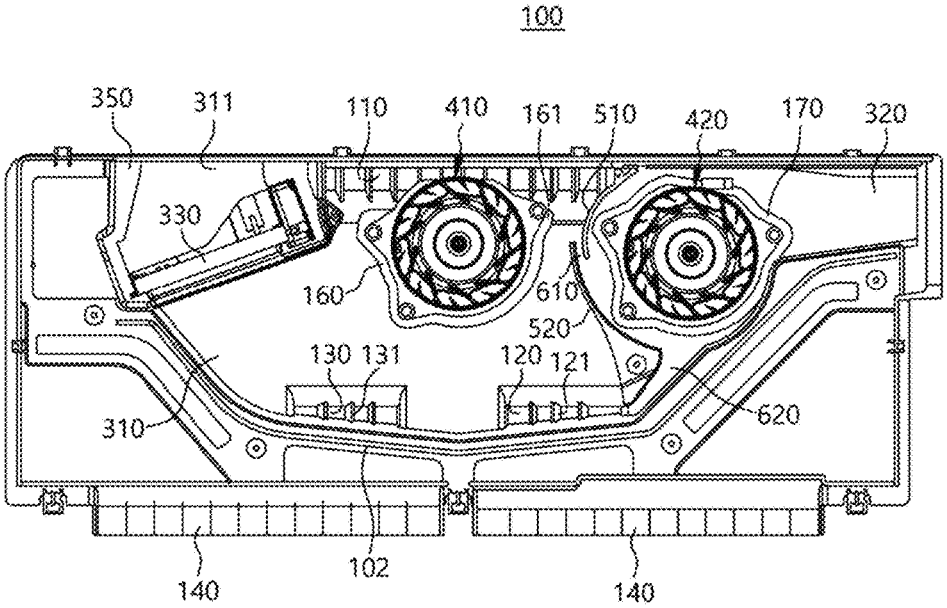
FIG. 14 is a view showing examples of fan modules disposed in a grille panel of the refrigerator.

Further, as shown in FIG. 14, the upper end of the freezing fan module 410 exposed through the open top of the first seat 160 may be positioned at a height at which the upper end does not fully block the upper cool air discharge port 110 (a height that the upper wall of the upper cool air discharge port does not reach).

That is, sufficient discharging force may be applied when cool air flowing in the circumferential direction of the freezing fan module 410 passes through the upper cool air discharge port 110, whereby the cool air may be smoothly supplied up to the front in the cabinet 10.

If the freezing fan module 410 is positioned to fully block the upper cool air discharge port 110, the flow speed of cool air may decrease, so there may be a possibility that cool air is not sufficiently supplied up to the front in the cabinet 10.

Accordingly, due to the structure of the first seat 160 described above and the freezing fan module 410 seated in the first seat 160, substantially half the cool air blown into the first cool air guide channel 310 may be discharged to the upper cool air discharge port 110 by the freezing fan module 410 and the other cool air may be discharged to the two lower cool air discharge ports 120 and 130 or the switch compartment 13 while flowing through the first cool air guide channel 310.

A flow guide stage 161 may be formed at at least any one of both ends of the open top of the first seat 160. The flow guide stage 161 can guide the cool air to rotate and discharge by operation of the freezing fan module 410 in the first seat 160. The cool air can flow while laterally spreading. The flow guide stage 161 may protrude outward from the end of the first seat 160 and be inclined or rounded. For example, the flow guide stage 161 may be inclined or rounded with respect to a horizontal direction and connect to another flow guide stage 163.

The grille panel 100 may have a second seat 170.

The second seat 170 may be a part in which the ice making fan module 420 is seated. That is, the ice making fan module 420 may be embedded in the surface of the grille panel 100, whereby freezing by the second evaporator 32 may be prevented.

The second seat 170 may be formed at a side of the first seat 160.

That is, the freezing fan module 410 and the ice making fan module 420 may be disposed between the grille panel 100 and the shroud 200 due to the first seat 160 and the second seat 170.

Even though the freezing fan module 410 and the ice making fan module 420 may be disposed between the grille panel 100 and the shroud 200 due to the first seat 160 and the second seat 170, the front-rear thickness of the grille panel assembly 1 may be minimized. That is, the slim grille panel assembly 1 may be provided by the first seat 160 and the second seat 170.

The first seat 160 and the second seat 170 may be positioned over the top of the second evaporator 32.

That is, the freezing fan module 410 and the ice making fan module 420 seated in the first seat 160 and the second seat 170 may be positioned higher than the top of the second evaporator 32, whereby malfunction (freezing) of the fan modules 410 and 420 that may be caused by the adjacent arrangement of the second evaporator 32 and the fan modules 410 and 420 may be prevented.

The top of the second evaporator 32 may be the uppermost portion of a refrigerant pipe 32*a* of the second evaporator or may be the upper end of a heat exchange fin 32*b* of the second evaporator 32.

Figure 15:
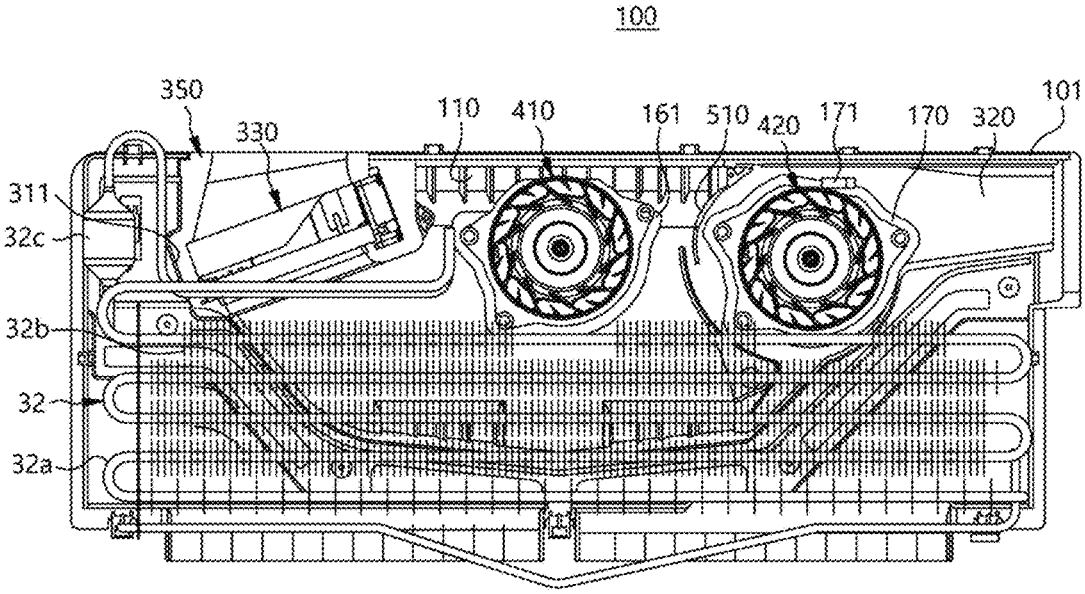
FIG. 15 is a view showing the fan modules and example evaporators respectively disposed behind the grille panels of the refrigerator.

It may be exemplified in the first implementation that the top of the second evaporator 32 is the upper end of the heat exchange fin 32*b*. This configuration is shown in FIG. 15. Accordingly, freezing of the fan modules 410 and 420 due to the second evaporator 32 may be reduced.

In particular, the heat exchange fin 32*b* may not exist at the portion of the second evaporator 32 that is adjacent to the fan modules 410 and 420, whereby freezing of the fan modules 410 and 420 may be reduced.

A heat blocking plate 33 (see FIG. 5) may be disposed on the front of the second evaporator 32, and the coldness at low temperature from the second evaporator 32 may be prevented from being transmitted to the shroud 200 by the heat blocking plate 33.

The grille panel 100 may have an ice making outlet 171.

The ice making outlet 171 may be an opening provided to supply cool air to the ice maker 12*a* disposed in the freezing compartment 12. The ice maker 12*a* may be a common ice tray or may be a space in which the ice maker is disposed and ice is made.

If cool air is not directly sprayed to the ice maker 12*a* and ice is made in the ice maker provided in the freezing compartment 12 only based on the temperature in the freezing compartment 12, poor ice making may be generated and a hollow may be formed without the inside frozen in ice, for instance.

In some implementations, the second cool air guide channel 320 can be a channel provided to supply cool air to the ice making compartment 21, and the ice making fan 421 of the ice making fan module 420 provided in the second cool air guide channel 320 can be controlled to always operate regardless of whether a compressor is operated.

Considering this, a portion of the cool air continuously supplied to the ice making compartment 21 may be directly and continuously sprayed to the ice maker 12*a* through the ice making outlet 171, whereby ice that is made in the ice maker 12*a* may be sufficiently frozen.

Figure 16:
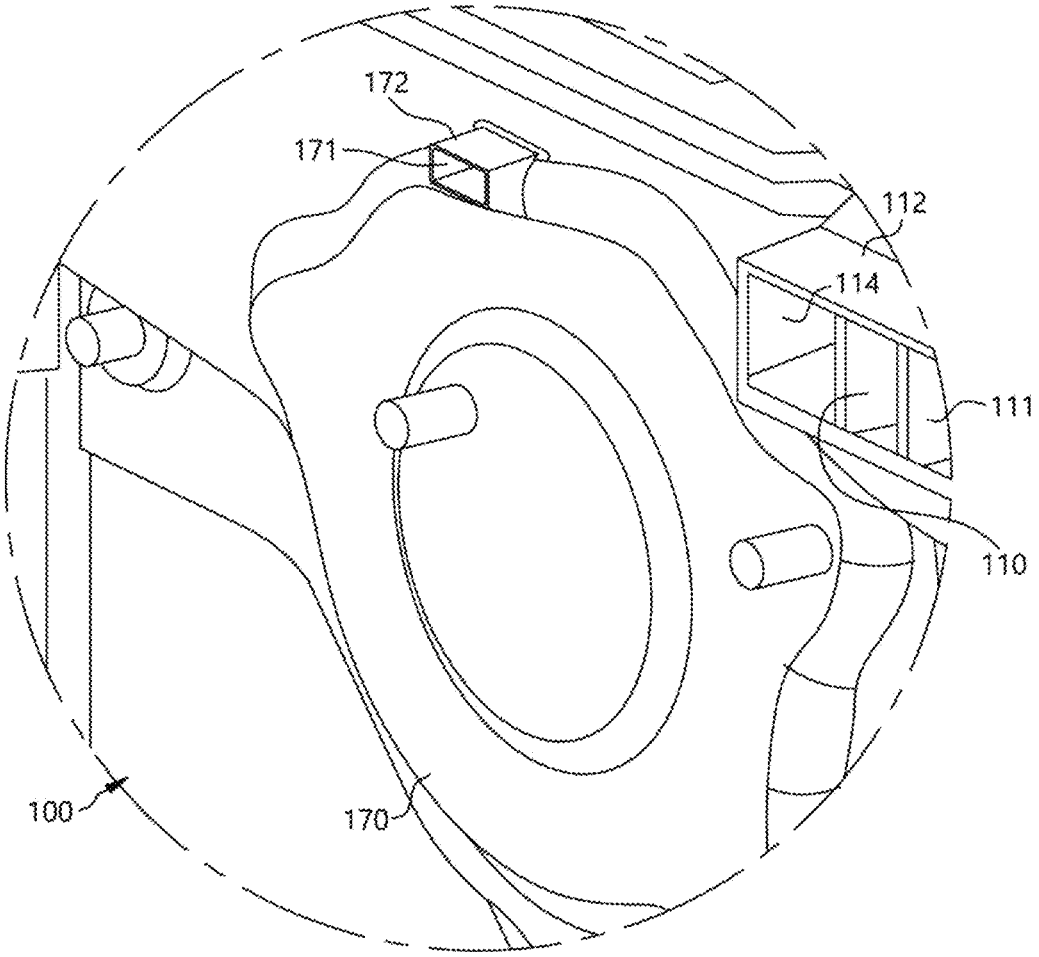
FIG. 16 is a perspective view showing example parts including an ice making discharge port disposed at a second seat of the refrigerator.

As shown in FIG. 16, the ice making outlet 171 may be formed at the second seat 170.

Figure 17:
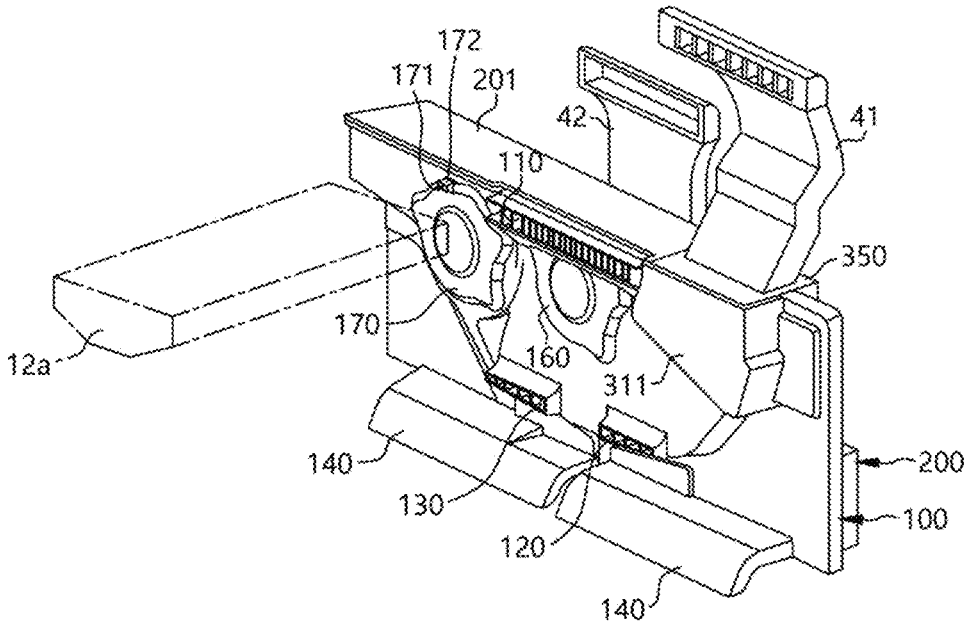
FIG. 17 is a perspective view showing an example of the positional relationship between the ice making discharge port and an ice maker disposed in a freezing compartment of the refrigerator.

As shown in FIG. 17, the ice making outlet 171 may be formed right behind the ice maker 12*a*.

In particular, a discharge guide pipe 172 may extend to the ice making outlet 171. That is, cool air may be intensively supplied to the ice maker 12*a* through the extending discharge guide pipe 172.

The shroud 200 of the grille panel assembly 1 is described with reference to FIGS. 4, 5, and 18 to 25.

Figure 18:
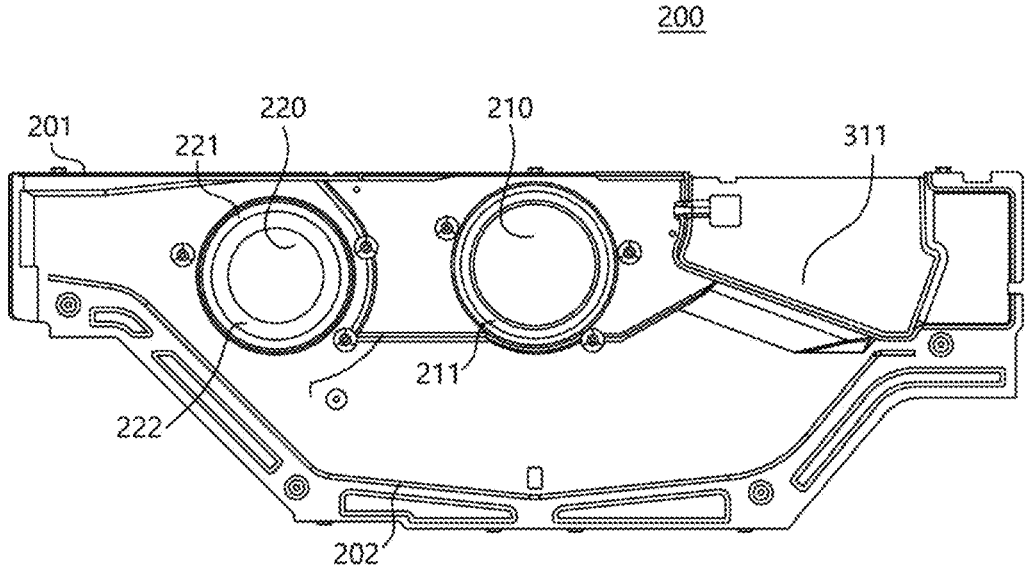
FIGS. 18 and 19 are views showing an example of a shroud in the refrigerator.
Figure 19:
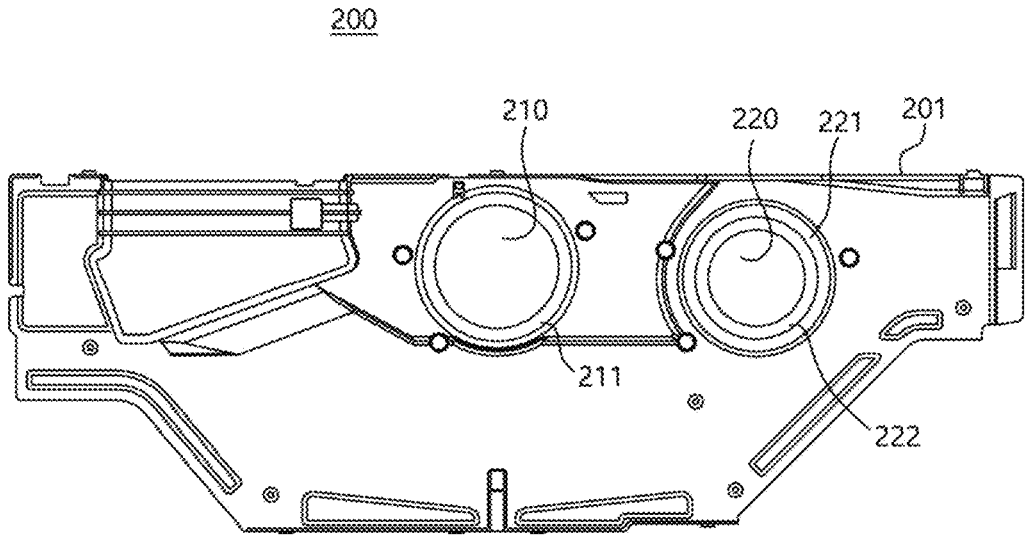
Figure 20:
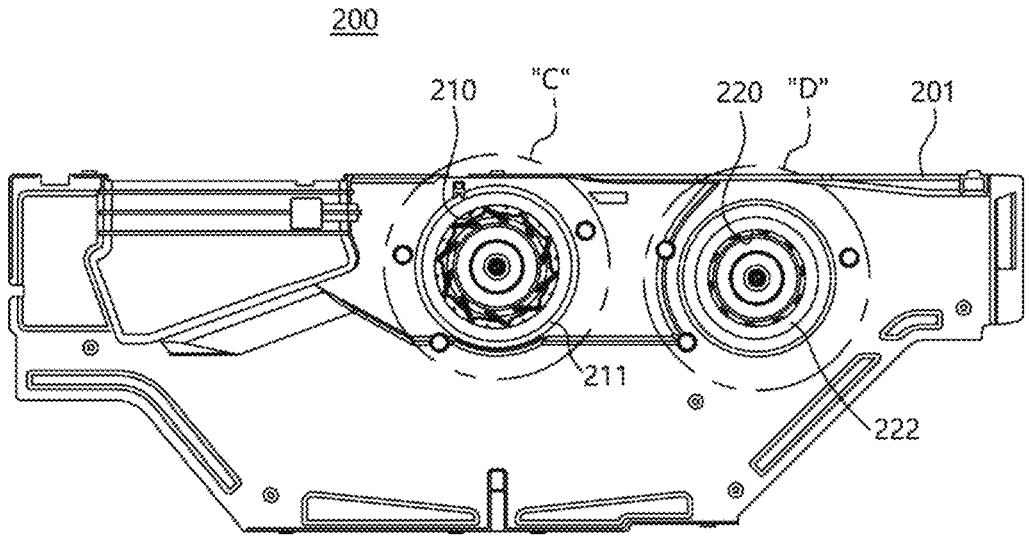
FIG. 20 is a view showing an example of the fan modules disposed in the shroud of the refrigerator.

FIG. 18 is a front view showing a shroud of the refrigerator according to an implementation and FIG. 19 is a rear view showing the shroud of the refrigerator.

The shroud 200 may be coupled to the rear of the grille panel 100 and may provide a space such that a channel for flow of cool air may be formed between the shroud 200 and the grille panel 100.

A first intake hole 210 and a second intake hole 220 may be formed through the shroud 200. The two intake holes 210 and 220 may be openings formed such that the cool air exchanging heat through the second evaporator 32 positioned at the rear in the freezing compartment 12 may flow into the space between the grille panel 100 and the shroud 200.

The first intake hole 210 may be formed substantially at the center of the shroud 200 and the second intake hole 220 may be formed at any one side of the first intake hole 210.

The center of the first intake hole 210 may be positioned closer to the top than the bottom in the first cool air guide channel 310. The upper cool air discharge port 110 may be positioned between the center of the first intake hole 210 and the top in the first cool air guide channel 310.

A first bellmouth 211 may be formed around the first intake hole 210 and a second bellmouth 221 may be formed around the second intake hole 220.

The first intake hole 210 may be designed in consideration of the amount of cool air that is supplied to the freezing compartment 12 through the freezing fan module 420, and the second intake hole 220 may be designed in consideration of the pressure of the cool air that is supplied to the ice making compartment 21 through the ice making fan module 420.

That is, the freezing fan module 410 may be configured to supply a large amount of cool air because it supplies cool air to the freezing compartment positioned ahead of it, and the ice making fan module 420 may be configured to supply cool air up to a long distance because it supplies cool air to the ice making compartment 21 disposed in the refrigerating compartment door 20.

To this end, the first intake hole 210 may be formed larger than the second intake hole 220 such that forcible sending force may be small but a large amount of cool air may be discharged, and the second intake hole 220 may be formed smaller than the first intake hole 210 to obtain high forcible sensing force such that a small amount of cool air may be discharged but cool air may be supplied up to the ice making compartment 21.

In detail, the first intake hole 210 may have an inner diameter such that impellers 411*c* of the freezing fan 411 of the freezing fan module 420 may be exposed substantially half or more. That is, cool air that has passed through the first intake hole 210 may be supplied between the impellers 411*c* and then may be guided to be directly radially discharged by the impellers 411*c*.

Figure 21:
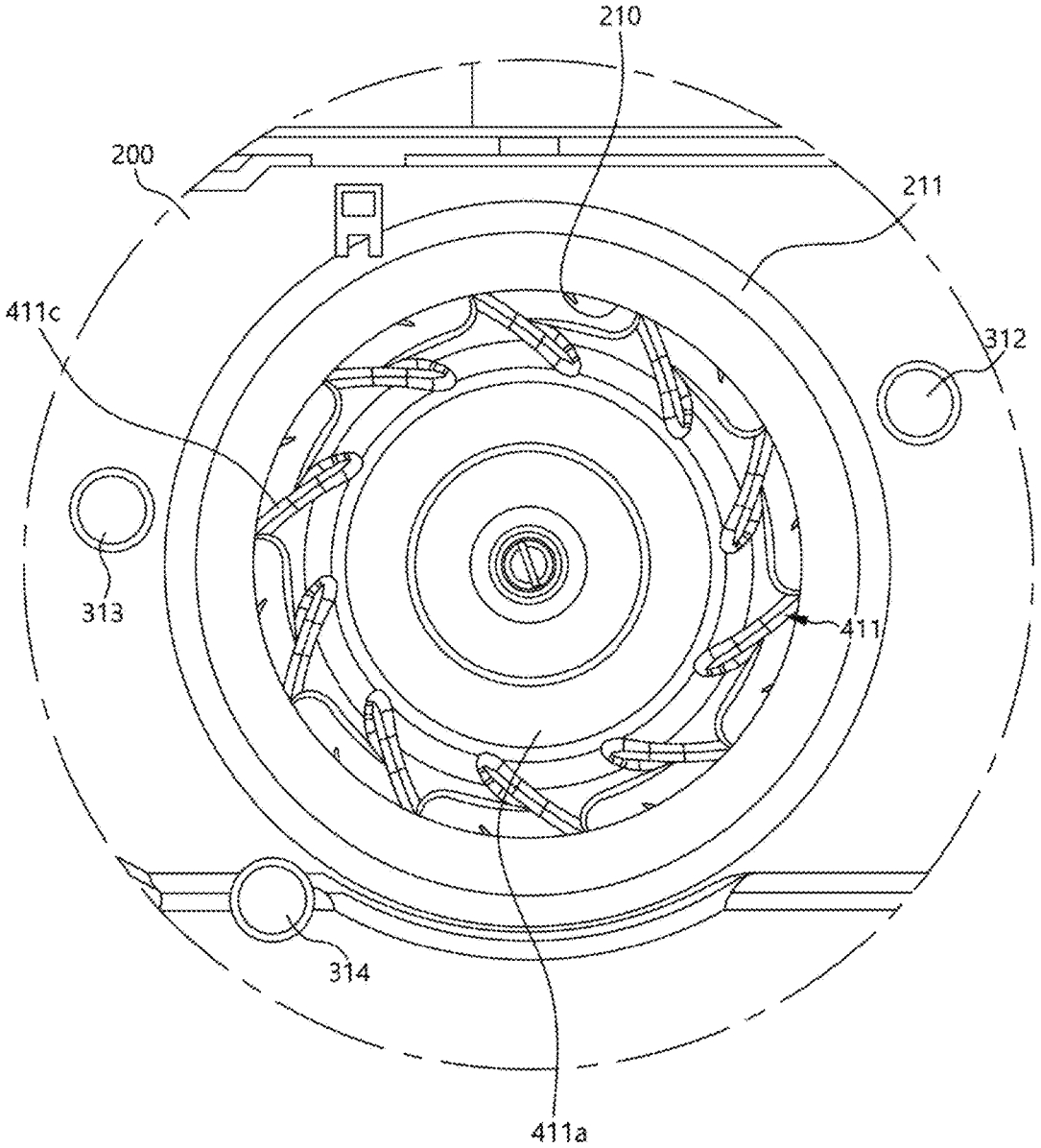
FIG. 21 is an enlarged view of the part "C" of FIG. 20.

The first intake hole 210 may have an inner diameter such that most of the impellers 411*c* of the freezing fan 411 may be exposed. This configuration is shown in FIG. 21.

The second intake hole 220 should be formed such that the impellers 411*c* of the freezing fan 411 are not maximally exposed.

That is, the more the impellers 411*c* of the freezing fan 411 may be exposed through the second intake hole 220, the more the cool air may flow backward through the second intake hole 220 while is it discharged in the rotational direction of the ice making fan 421. Accordingly, the backflow through the second intake hole 220 and the flow going into the second intake hole 220 through the second evaporator 32 may hit against each other, whereby the force sending cool air to the second cool air guide channel 320 relatively decreases.

Figure 22:
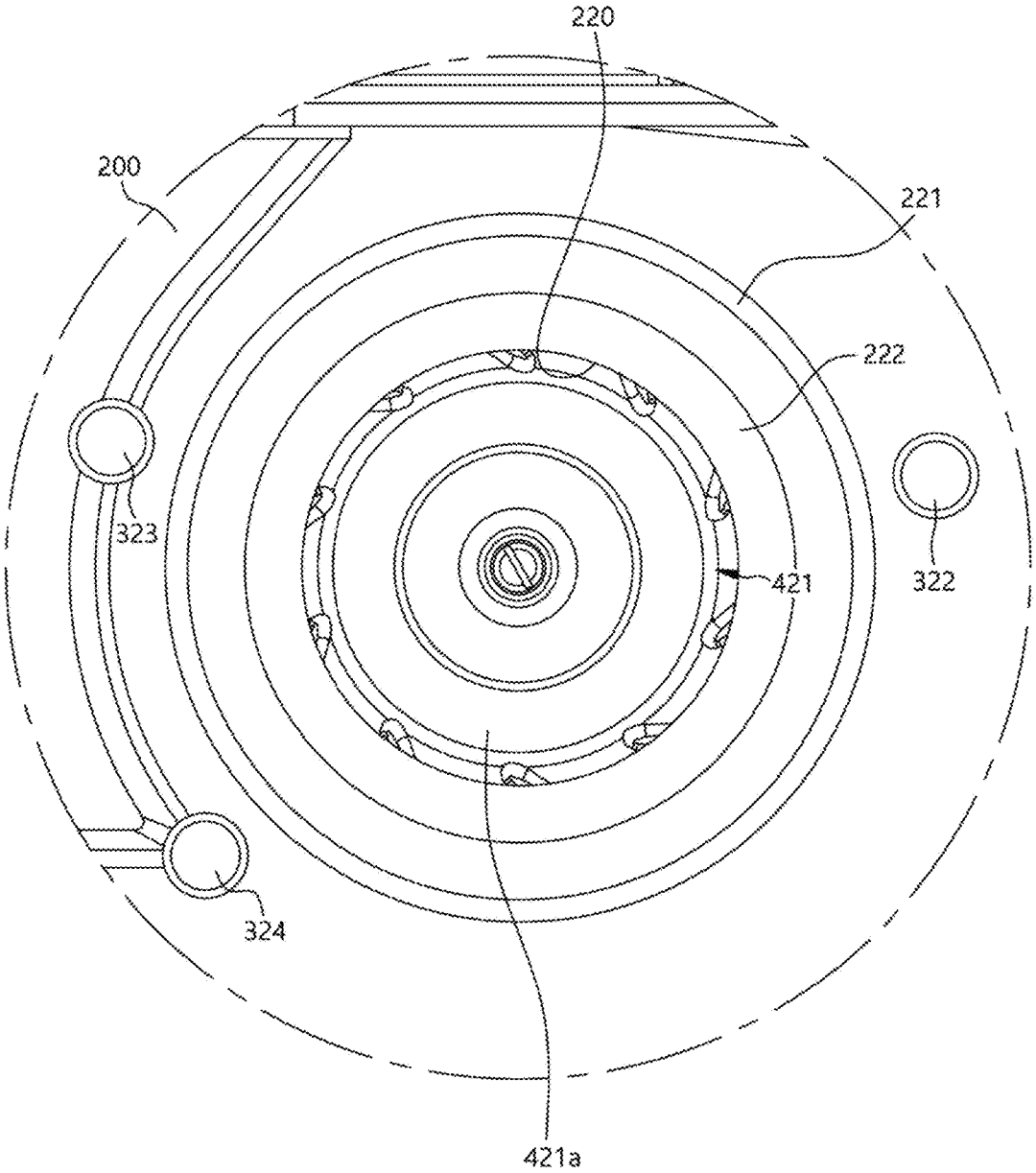
FIG. 22 is an enlarged view of the part "D" of FIG. 20.

The second intake hole 220 may be formed to have size such that the impellers 421*c* may be exposed half or less, whereby forcible sending force may be increased. This configuration is shown in FIG. 22.

The second intake hole 220 may be formed to have a size such that the impellers 421*c* may not be exposed. That is, most parts of the open portions between the impellers 421*c* may be blocked, whereby backflow of cool air may be fundamentally prevented.

The two intake holes 210 and 220 can have different sizes. For example, the diameters of the intake holes 210 and 220 may be different from each other. In some examples, a difference may be given to the diameters by blocking a portion of the inner side of the second intake hole 220.

For instance, a covering member 222 can be disposed at the inner surface of the second intake hole 220. That is, the second intake hole 220 may have a smaller diameter than the first intake hole 210 and may cover the impellers 421*c* of the ice making fan 421 by the covering member 222.

The covering member 222 may have an inner diameter such that the impellers 421*c* of the ice making fan 421 of the ice making fan module 420 may be maximally covered. That is, most parts of the open portions between the impellers 421*c* may be blocked, whereby backflow of cool air may be fundamentally prevented. Accordingly, the cool air flowing in the second cool air guide channel 320 after passing through the second intake hole 220 may be smoothly forcibly sent to the ice making compartment without being discharged backward through the second intake hole 220.

The shroud 200 may be configured not to block the suction guide 140 of the grille panel 100 when the shroud 200 and the grille panel 100 are combined.

That is, the shroud 200 may be configured to block only a portion of the rear of the grille panel 100. Accordingly, the grille panel assembly 1 may be made compact and cool air may smooth flow. Further, the cool air guided to return by the suction guide 140 may smoothly flow to the lower end of the second evaporator 32.

The shroud 200 may have a size that may surround the upper portion of the grille panel 100, the upper cool air discharge port 110, and the two lower cool air discharge ports 120 and 130.

Figure 24:
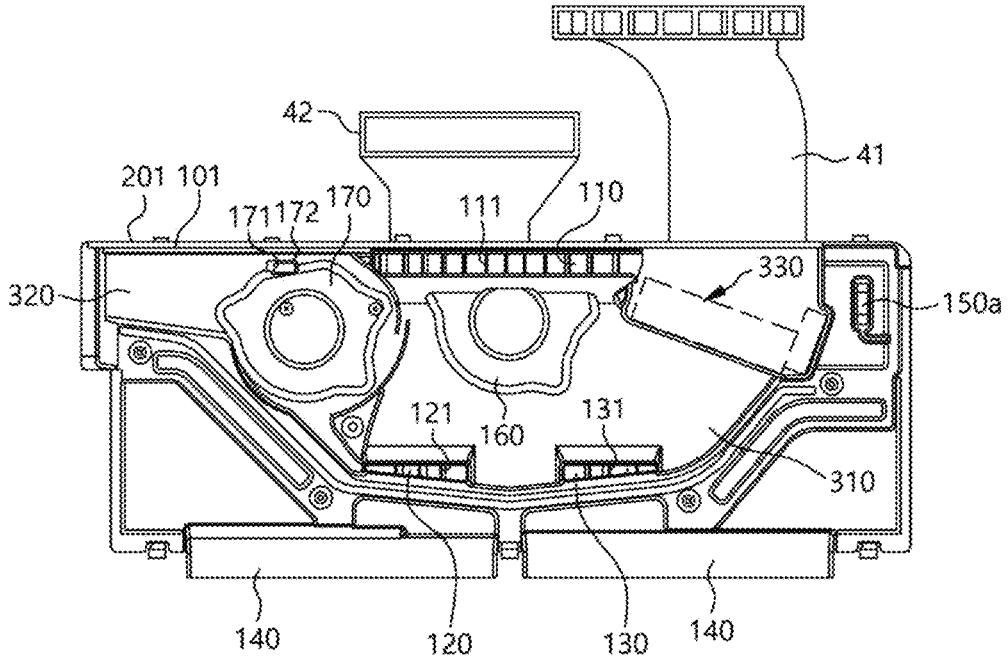
FIG. 24 is a front view showing an example of a connection state of a switch compartment cool air duct and a switch compartment return duct in the refrigerator.
Figure 25:
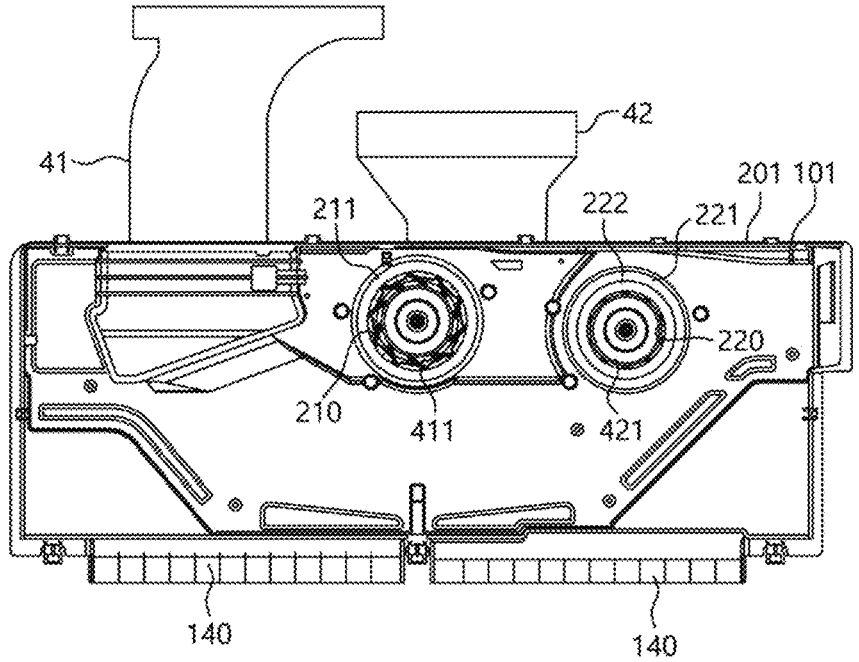
FIG. 25 is a rear view showing the connection state of the switch compartment cool air duct and the switch compartment return duct in the refrigerator.
Figure 26:
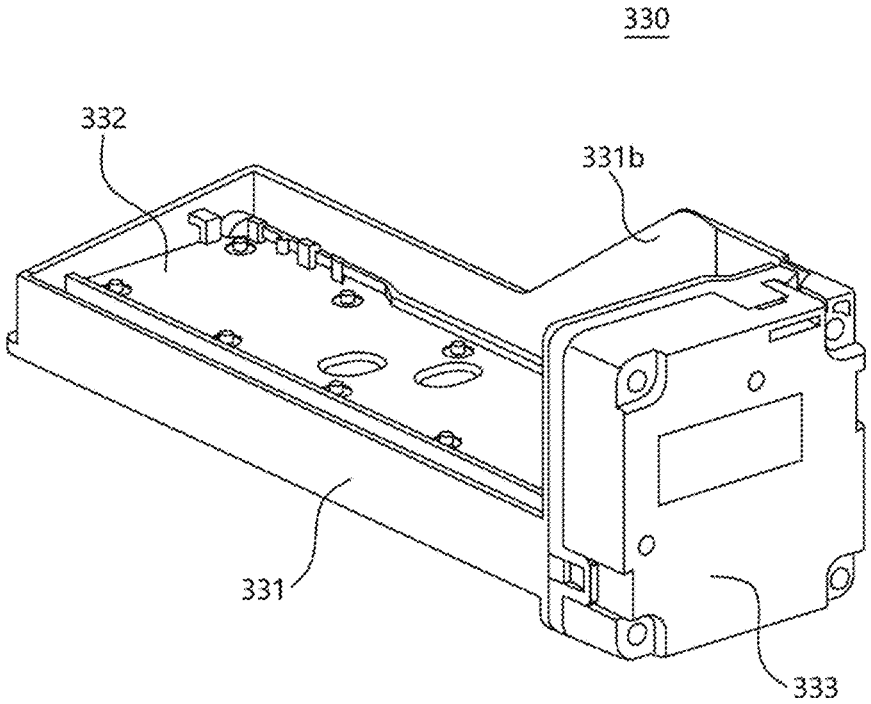
FIG. 26 is a perspective view showing an example of a closed state of a switch damper assembly of the refrigerator.
Figure 27:
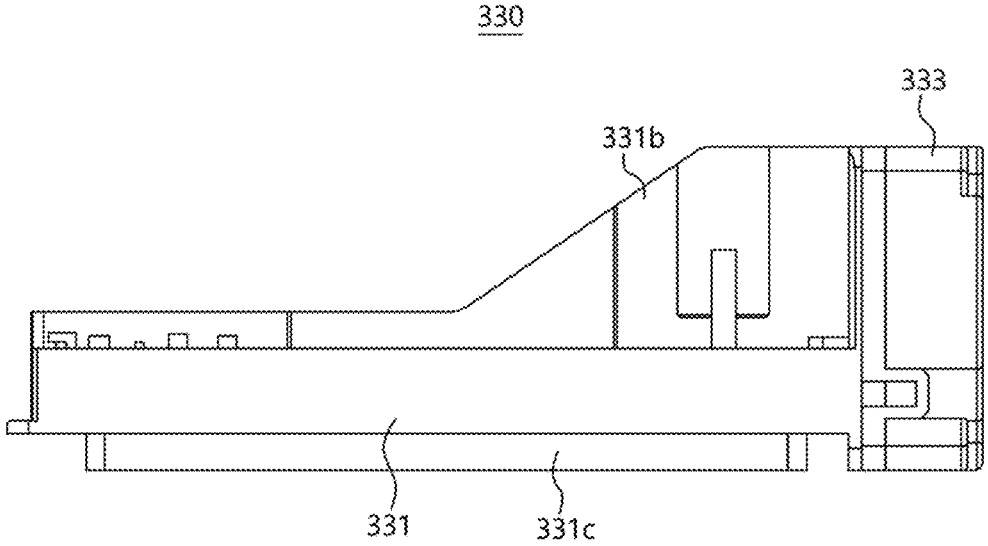
FIG. 27 is a front view showing the closed state of the switch damper assembly of the refrigerator.
Figure 28:
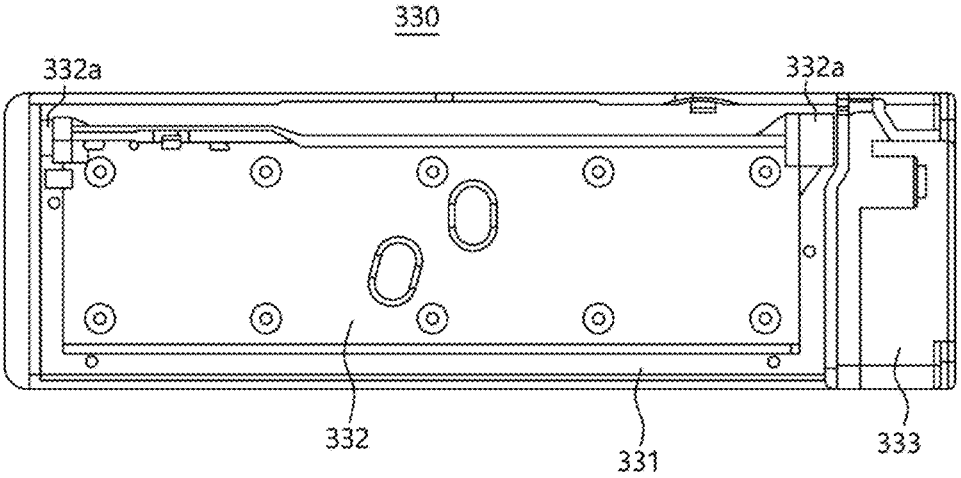
FIG. 28 is a plan view showing the closed state of the switch damper assembly of the refrigerator.
Figure 29:
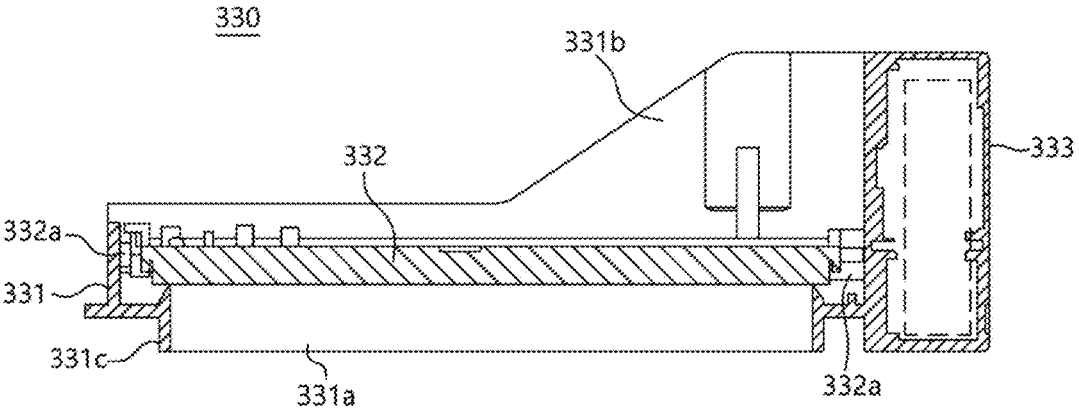
FIG. 29 is a cross-sectional view showing the closed state of the switch damper assembly of the refrigerator.
Figure 30:
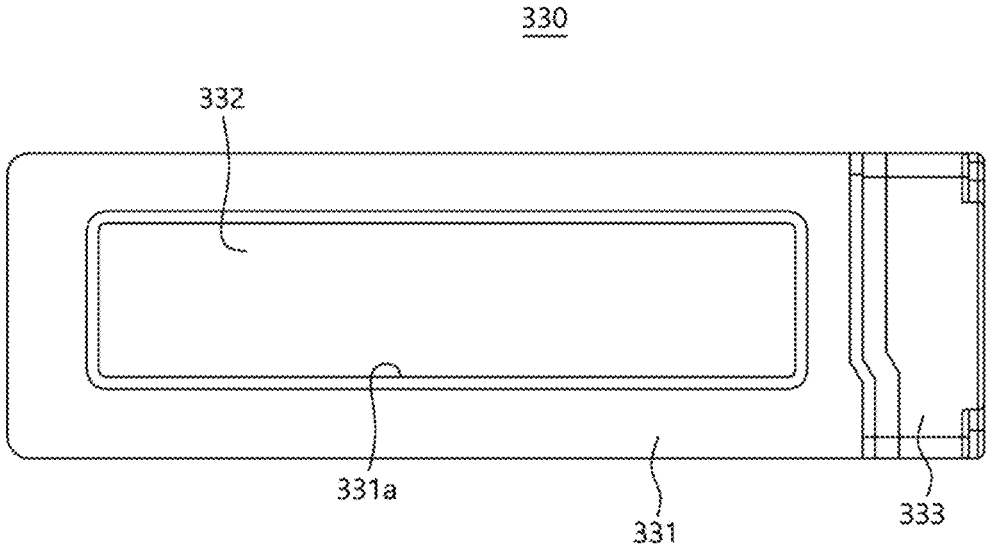
FIG. 30 is a bottom view showing the closed state of the switch damper assembly of the refrigerator.
Figure 31:
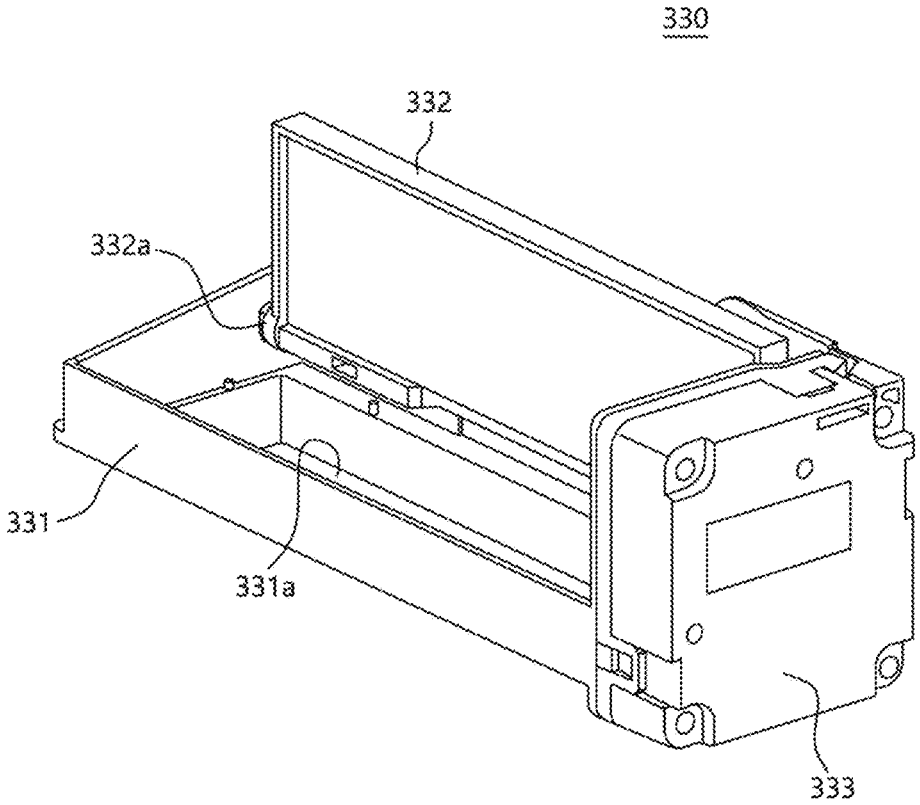
FIG. 31 is a perspective view showing an example of an open state of the switch damper assembly of the refrigerator.
Figure 32:
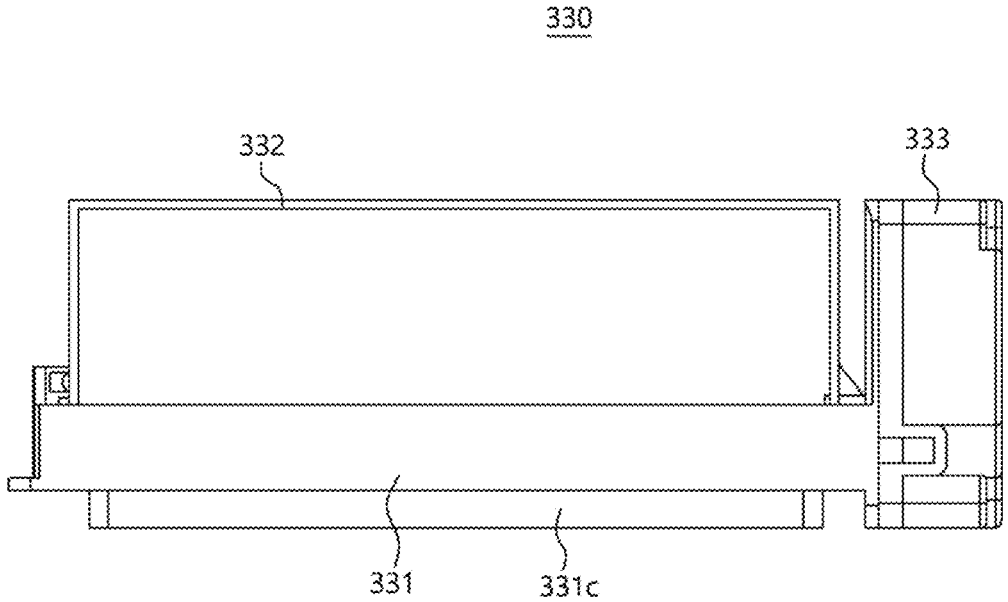
FIG. 32 is a front view showing the open state of the switch damper assembly of the refrigerator.
Figure 33:
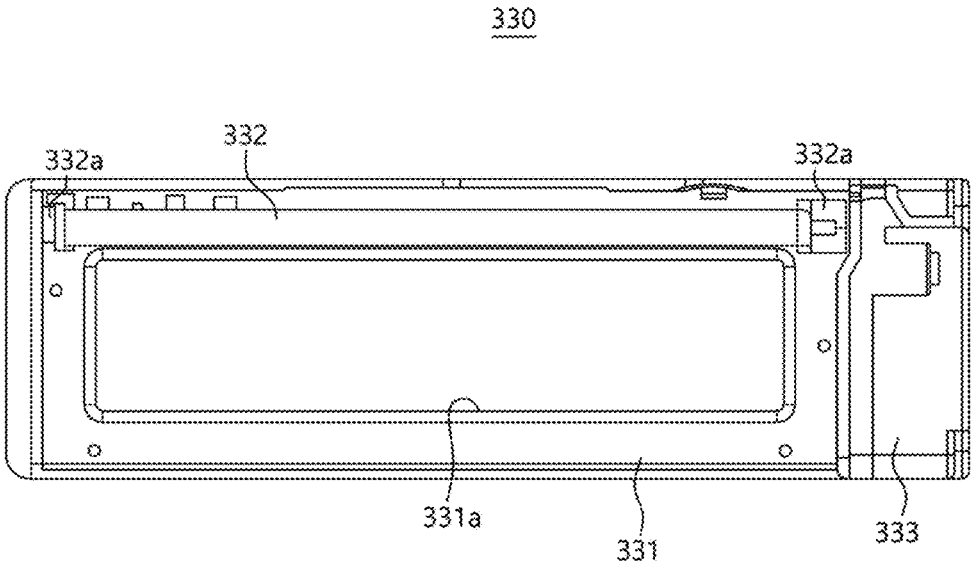
FIG. 33 is a plan view showing the open state of the switch damper assembly of the refrigerator.

The grille panel 100 and the shroud 200 may have tops 101 and 201, respectively, and the tops 101 and 201 may be coupled while overlapping each other. This configuration is shown in FIGS. 24 and 25.

Next, the first cool air guide channel 310 of the grille panel assembly 1 is described with reference to FIGS. 9 and 10.

The first cool air guide channel 310 may be a guide that guides cool air, which flows inside between the grille panel 100 and the shroud 200 through the first intake hole 210, to flow to the freezing compartment 12 and the switch compartment 13.

The first cool air guide channel 310 may be formed on at least any one surface of the facing surfaces between the grille panel 100 and the shroud 200.

In particular, the first cool air guide channel 310 may be recessed on the rear of the grille panel 100 and the shroud 200 may be brought in close contact with the rear of the grille panel 100, whereby the first cool air guide channel 310 may be formed as a channel isolated from the external environment.

In some examples, the first cool air guide channel 310 may be formed on the front of the shroud, may be formed separately from the grille panel 100 or the shroud 200 and then may be coupled between the grille panel 100 and the shroud 200, and may be formed partially on the grille panel 100 and the shroud 200.

The first cool air guide channel 310 may be formed around the first seat 160 from the portion where the first seat 160 is formed with an end rounded toward any one upper portion of the first seat 160 (opposite to the second seat).

That is, the first cool air guide channel 310 may be rounded in the direction in which cool air flows by rotation of the freezing fan 411.

In particular, the end of the first cool air guide channel 310 may be open to the tops of the grille panel 100 and the shroud 200. That is, since the first cool air guide channel 310 may be open upward from the grille panel assembly 1, a pipe (e.g., a switch compartment cool air duct) connected to the first cool air guide channel 310 may face upward.

Figure 23:
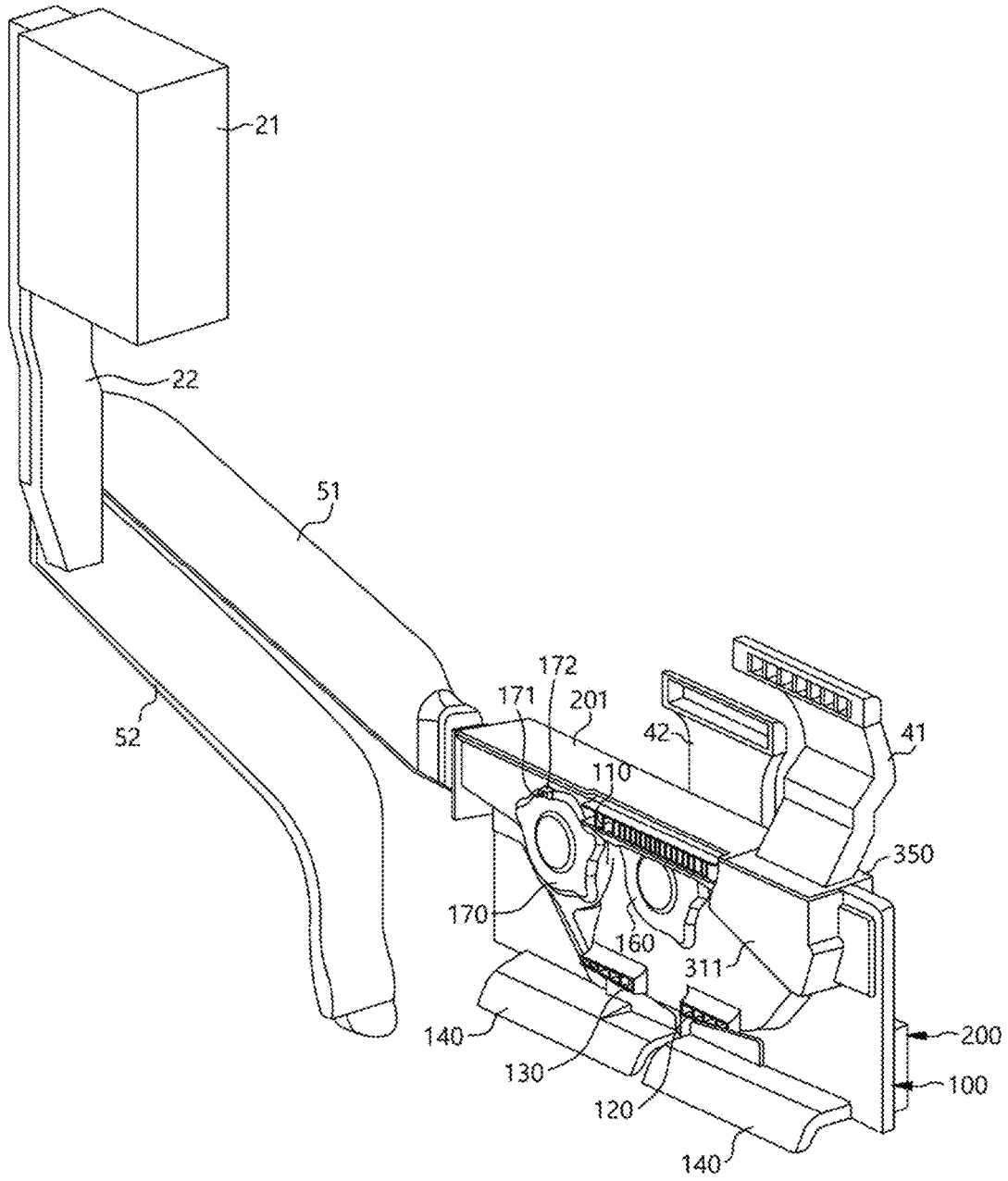
FIG. 23 is a perspective view showing an example structure for transmitting cool air to an ice making compartment of the refrigerator.

A switch compartment cool air duct 41 may be connected to the open portion of the first cool air guide channel 310 (see FIGS. 23 to 25). The switch compartment cool air duct 41 may be a duct for supplying cool air to the switch compartment positioned over the freezing compartment 12 and the upper end of the switch compartment cool air duct 41 may be connected to the rear of the switch compartment 13 (see FIG. 5).

The cool air circulating in the switch compartment 13 may be returned to the air intake side of the second evaporator 32 through a switch compartment return duct 42.

The switch compartment return duct 42 may have an end connected to the lower portion of the rear of the switch compartment 13 and another end connected to the air intake side of the second evaporator 32.

The two lower cool air discharge ports 120 and 130 discharging cool air to the freezing compartment 12 may be formed along the bottom in the first cool air guide channel 310.

That is, cool air may be sequentially discharged to the freezing compartment 12 through the two lower cool air discharge ports 120 and 130 while flowing through the first cool air guide channel 310.

In particular, the two lower cool air discharge ports 120 and 130 may be respectively formed at both sides of the lower space in the first cool air guide channel 310. The portion between the two lower cool air discharge ports 120 and 130 may be substantially a portion that faces the lower space in the freezing compartment 12, so if the lower cool air discharge ports 120 and 130 are formed, the cool air that is discharged through the lower cool air discharge ports 120 and 130 may hit against with the flow of the cool air returning to the lower space after circulating in the freezing compartment 12.

As shown in FIGS. 7 and 10, a plurality of fastening protrusions 312, 313, and 314 may be formed in the first cool air guide channel 310.

The fastening protrusions 312, 313, and 314 may be portions for fastening to the freezing fan module 410 and may protrude toward the first seat 160 from the surface facing the first seat 160 of the inside of the first cool air guide channel 310.

The fastening protrusions 312, 313, and 314 may be formed at positions considering the size and the blowing direction of the freezing fan 411.

As shown in FIGS. 7 and 9, a channel opening/closing module 330 may be formed in the first cool air guide channel 310.

The channel opening/closing module 330 may open/close to selectively preventing cool air flowing through the first cool air guide channel 310 from being discharged to the cool air outlet end of the first cool air guide channel 310.

That is, supply of the cool air that is supplied to the switch compartment 13 through the first cool air guide channel 310 can be selectively allowed and prevented. Accordingly, articles may be kept in the switch compartment 13 under a temperature condition different from that of the freezing compartment 12.

The channel opening/closing module 330 may be installed in the first cool air guide channel 310.

In some cases, where a channel opening/closing module is provided separately from the grille panel assembly 1, for example, at the cool air discharge side of the grille panel assembly 1 or at the cool air intake side of the switch compartment 13, it may take long time to assemble each of the channel opening/closing module and the grille panel assembly 1. In some cases, the storage space of the refrigerator can be decreased by the spaces for installing them.

In some cases, where the channel opening/closing module is provided separately from the grille panel assembly 1, an additional connection structure may be needed for installing the channel opening/closing module.

In some implementations, the channel opening/closing module 330 can be integrated with the grille panel assembly 1 such that the entire installation space can be reduced, and the storage space of the freezing compartment 12 (or the switch compartment) can be increased.

In particular, since the channel opening/closing module 330 may be integrated with the grille panel assembly 1, it may be possible to take out only the grille panel assembly 1 for maintenance, so maintenance may be easy. That is, in cases where the channel opening/closing module 330 and the grille panel assembly 1 are separately provided, they may be separated respectively from the cabinet 10. In some implementations, the channel opening/closing module 330 is integrated with the grille panel assembly 1, which may facilitate assembly or separation thereof.

Figure 34:
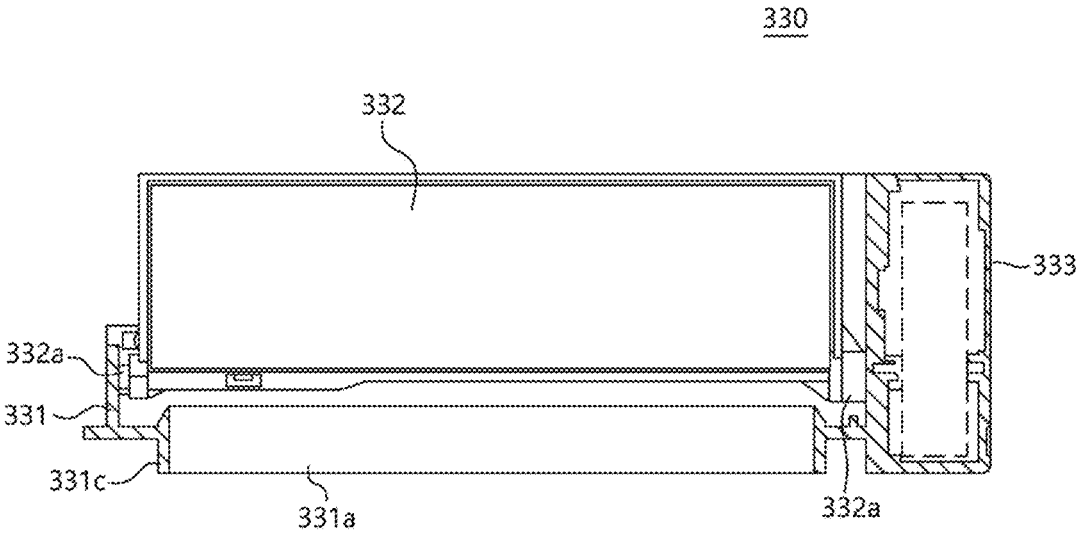
FIG. 34 is a cross-sectional view showing the open state of the switch damper assembly of the refrigerator.
Figure 35:
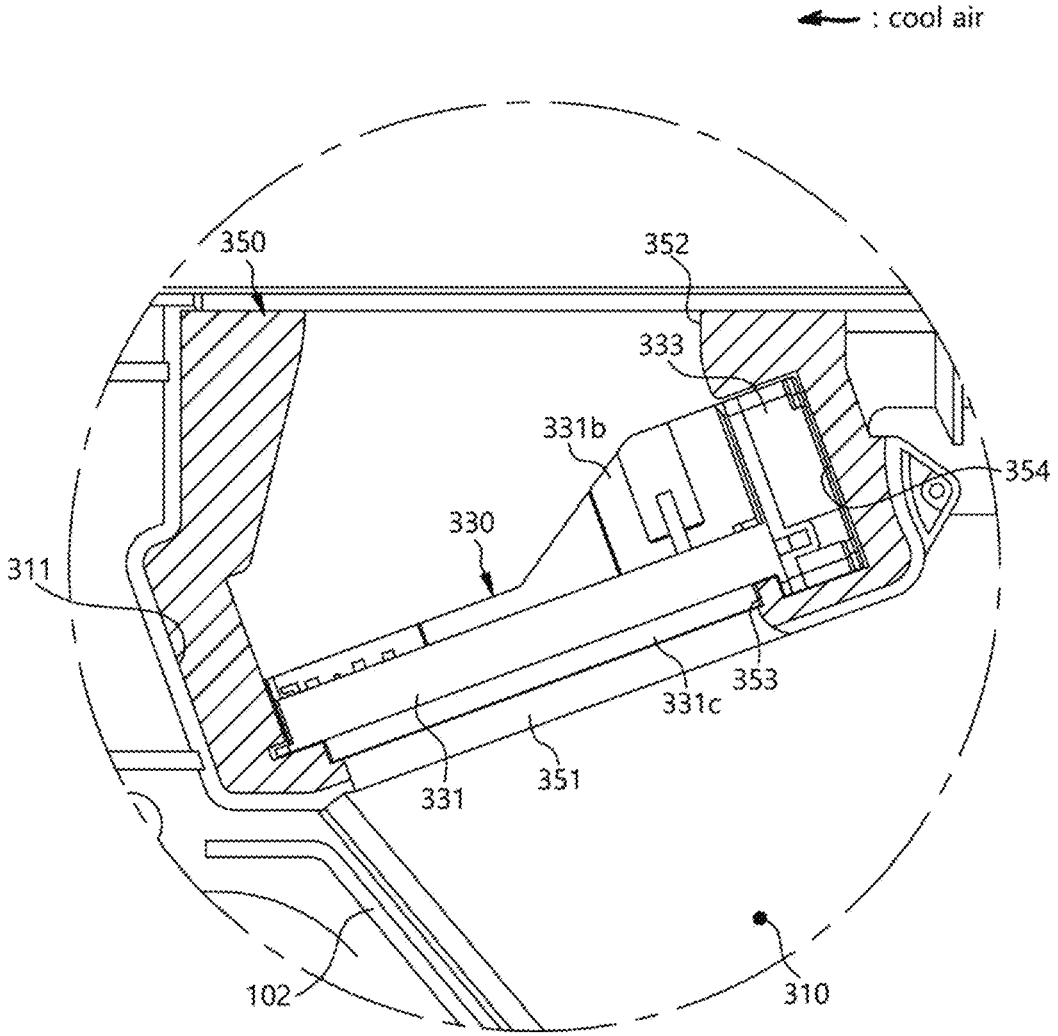
FIGS. 35 and 36 are cross-sectional views showing an example of the operation state when the switch damper assembly is seated in a first cool air guide channel in the refrigerator.
Figure 36:
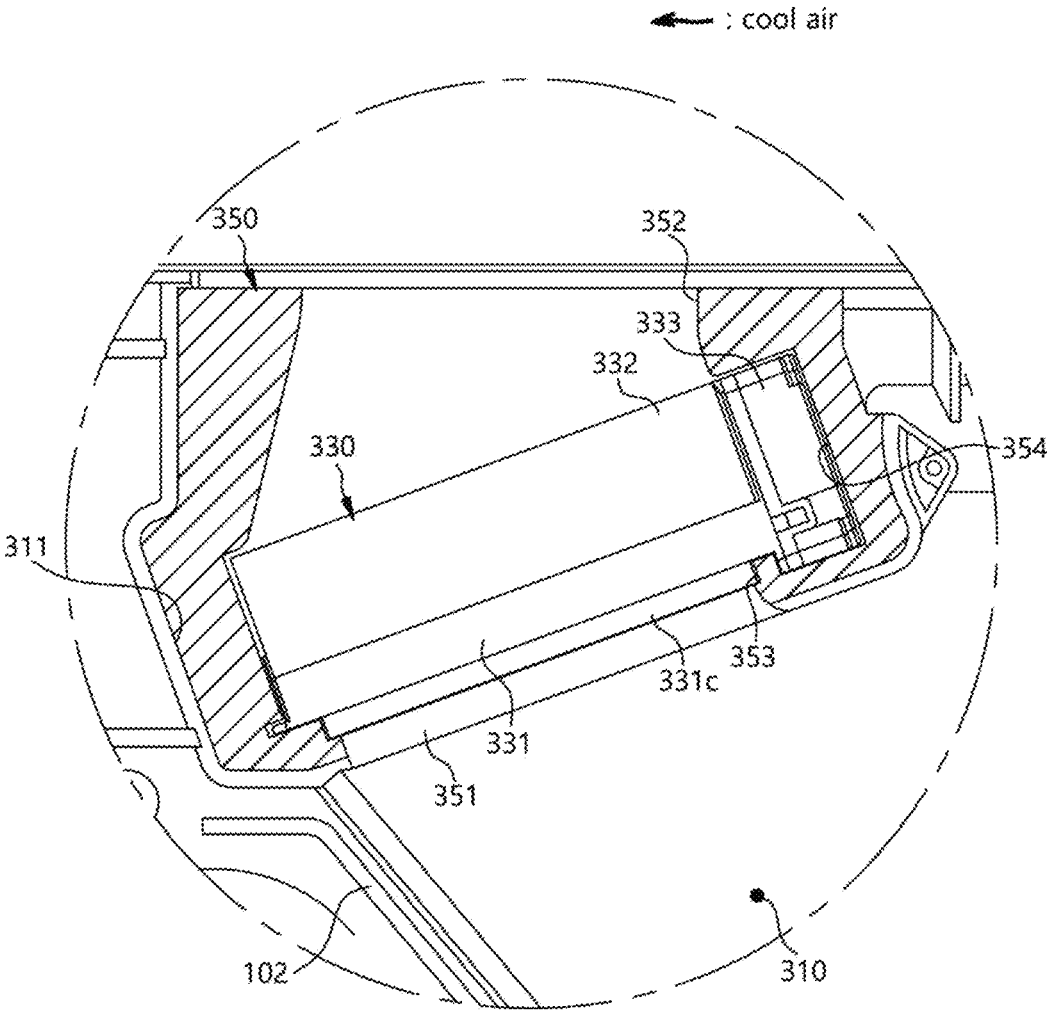
Figure 37:
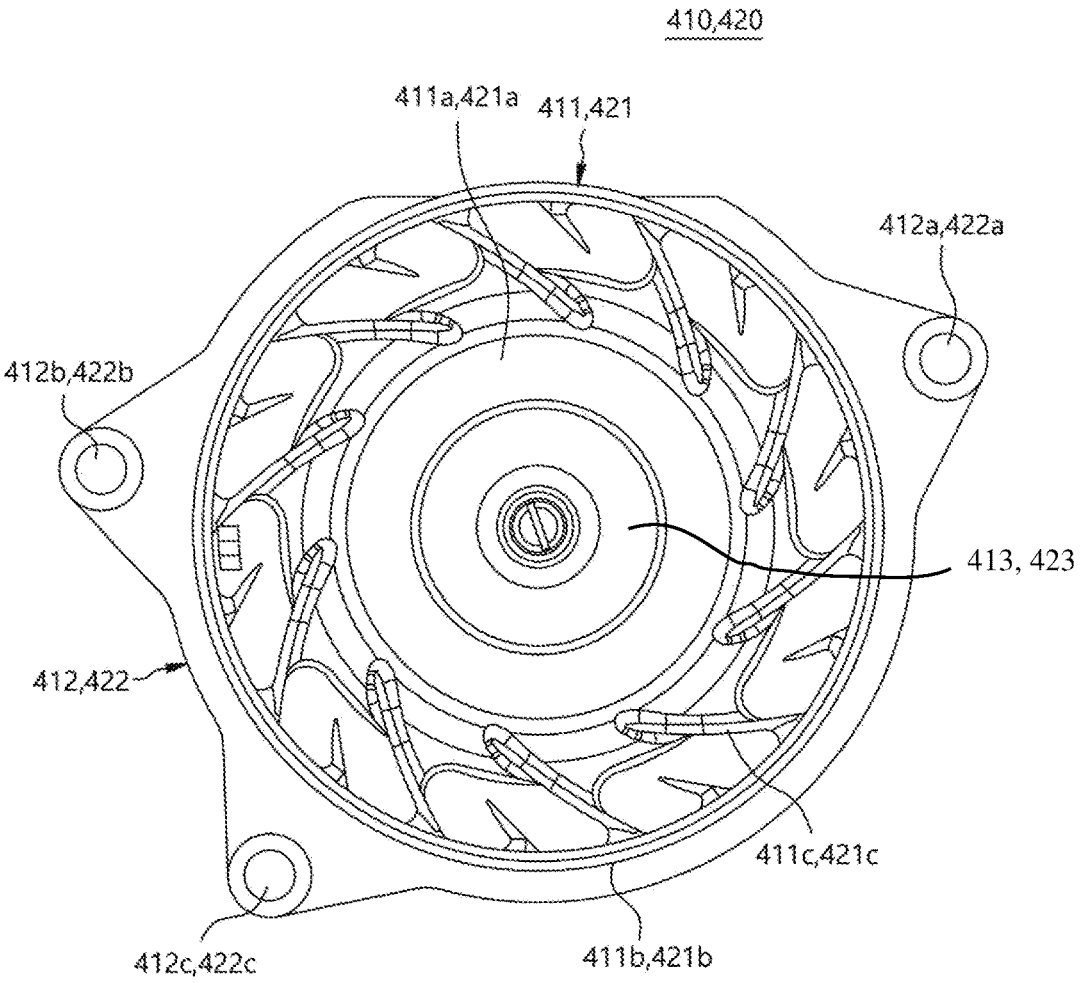
FIG. 37 is a front view showing an example of a fan module of the refrigerator.
Figure 38:
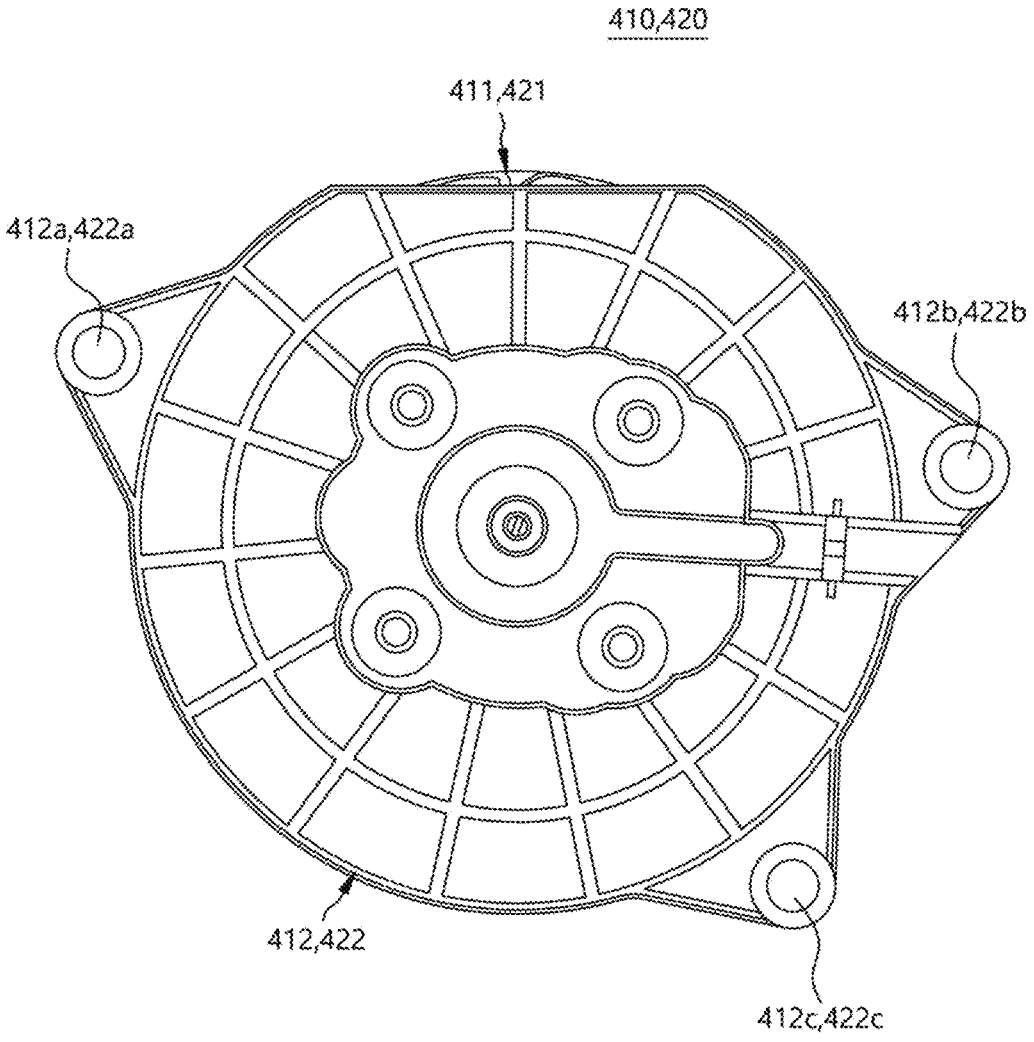
FIG. 38 is a rear view showing the fan module of the refrigerator.

FIGS. 26 to 36 show examples of the channel opening/closing module 330. FIGS. 26 to 34 show the structures and states in various directions of the channel opening/closing module, and FIGS. 35 and 36 show example states in which the channel opening/closing module is installed and operated in the first cool air guide channel.

As shown in the figures, the channel opening/closing module 330 may include a damper case 331, an opening/closing damper 332, and a damper actuator 333.

The damper case 331 may be disposed in the first cool air guide channel 310 to block the first cool air guide channel 310.

The damper case 331 may have a rectangular frame shape having a through-hole 331*a* therein.

The through-hole 331*a* may communicate with the first cool air guide channel 310.

The cool air outlet-side surface of the portion where the through-hole 331*a* of the damper case 331 is formed may be a flat surface. That is, the opening/closing damper 332 may be in close contact with the flat cool air outlet-side surface.

The damper case 331 may have a stopper 331*b*. The stopper 331*b* blocks the opening/closing damper 332 to be described below to excessive opening of the opening/closing damper 332.

The stopper 331*b* may be formed by protruding upward a portion of the rear surrounding surface (in the rotational direction of the opening/closing damper) of the damper case 331 further than other portions.

A mounting protrusion 331*c* may protrude from the bottom of the damper case 331. The mounting protrusion 331*c* may be a portion for coupling to the damper cover 350 to be described below.

The opening/closing damper 332 may be a part that opens/closes the through-hole 331*a* of the damper case 331.

The opening/closing damper 332 may be a block that is in close contact with the cool air outlet-side surface of the damper case 331. It may be a cuboid having a thickness smaller than the left-right width and the front-rear width.

Hinge shafts 332*a* may be formed at the rear corners of both sides of the opening/closing damper 332. That is, the opening/closing damper 332 may selectively open/close the through-hole 331*a* of the damper case 331 by rotating about the hinge shafts 332*a*.

The damper actuator 333 may be a part that operates the opening/closing damper 332.

The damper actuator 333 may be an electric motor.

In particular, the damper actuator 333 may be configured to be able to control a rotational angle, may be a motor that may not control a rotational angle but may be controlled to the turned off when a load of a predetermined magnitude or more is applied, and may be a motor that may be controlled to be turned off by a switch, etc.

A motor shaft of the damper actuator 333 may be coupled to any one of the hinge shafts 332*a* of the opening/closing damper 332. That is, the opening/closing damper 332 may be operated by operation of the actuating actuator 333.

In some examples, the channel opening/closing module 330 may be configured to forcibly block or open the first cool air guide channel 310 by a solenoid or a cylinder, and may be configured in various other structures.

As shown in FIGS. 8, 35, and 36, a mounting stage 311 on which the channel opening/closing module 330 is mounted may be formed in the first cool air guide channel 310.

The mounting stage 311 may be formed such that a portion of the first cool air guide channel 310 has a larger depth and width than adjacent portions.

The mounting stage 311 may be formed perpendicular to or parallel with the first cool air guide channel 310.

Considering the rotational direction of the freezing fan 411 and the channel opening/closing module 330 installed on the mounting stage 311, the mounting stage 311 can be disposed perpendicular to the first cool air guide channel 310 in terms of being able to reduce flow resistance.

However, when the mounting stage 311 is formed perpendicular to the first cool air guide channel 310, most part of the channel opening/closing module 330 installed at the mounting stage 311 is positioned ahead of the second evaporator 32, so there may be a large possibility of freezing, whereby there may be a possibility of malfunction.

In some cases, the mounting stage 311 may be formed in parallel with the first cool air guide channel 310 to prevent reduce freezing and malfunction of the channel opening/closing module 330.

In some cases, when the mounting stage 311 is formed in parallel with the first cool air guide channel 310, flow resistance of cool air may become large and the performance may be deteriorated. Further, the second evaporator 32 and the damper actuator 333 may be positioned close to each other, so there may be a possibility of damage (or malfunction) to the damper actuator 333.

In some implementations, the mounting stage 311 can be inclined. For example, the mounting stage 311 can be inclined with respect to a horizontal direction in which a top surface of the grille panel assembly extends. That is, since the mounting stage 311 may be inclined, the channel opening/closing module 330 may also be installed at an angle on the mounting stage, whereby flow resistance of cool air may be reduced and malfunction due to freezing of the damper actuator 333 may also be reduced or prevented.

In particular, as shown in FIG. 15, the mounting stage 311 may be positioned over the top of the second evaporator 32 (for example, over the uppermost heat exchange fin).

That is, the mounting stage 311 may be positioned at the cool air outlet end of the first cool air guide channel 310.

The mounting stage 311 may be positioned such that the channel opening/closing module 330 is positioned at the cool air outlet end of the first cool air guide channel 310 and cool air flowing through the first cool air guide channel 310 is sufficiently supplied to the freezing compartment 12 through the cool air discharge ports 110, 120, and 130 and then may be supplied to the switch compartment 13.

An end of the channel opening/closing module 330 may be positioned adjacent to the second evaporator 32 and another end of the channel opening/closing module 330 may be spaced apart from the evaporator 32 due to the inclined structure of the mounting stage 311. Considering this, the damper actuator 333 of the channel opening/closing module 330 may be positioned at the other end of the channel opening/closing module 330 such that it may be positioned relatively far from the second evaporator 32.

That is, the channel opening/closing module 330 may be installed such that it may maximally avoid influence of the second evaporator 32 and may reduce flow resistance of the cool air flowing through the first cool air guide channel 310.

As shown in FIGS. 7, 34, and 35, the channel opening/closing module 330 may be surrounded by the damper cover 350 and mounted on the mounting stage 311.

The damper cover 350 may be a part that protects the damper actuator 333 of the channel opening/closing module 330 from cool air. In some cases, the damper actuator 333 can include a motor.

The damper cover 350 may be made of a thermal insulating material. That is, the damper cover 350 made of a thermal insulating material may be installed to surround the channel opening/closing module 330, whereby the channel opening/closing module 330 (in particular, the actuating actuator 333) may not be influenced by the coldness transmitted along the surface of the shroud 200 or the grille panel 100.

The damper cover 350 may be made of Styrofoam, may be made of rubber or silicone, or may be made of a porous foaming material (e.g., a foam). In some examples, the damper cover 350 may be made of other thermal insulating materials not stated herein.

In some implementations, the damper cover 350 may be divided into a front cover and a rear cover with respect to the center. That is, assembly convenience may be provided by mounting the channel opening/closing module 330 on any one side cover and then covering the channel opening/closing module 330 with the other side cover.

The damper cover 350 may have a cool air inlet 351 and a cool air outlet 352 (see FIGS. 34 and 35).

The cool air inlet 351 may be formed through the bottom wall of the damper cover 350 and communicate with the inside of the first cool air guide channel 310.

The cool air outlet 352 may be formed through the top wall of the damper cover 350 and may be connected to the switch compartment cool air duct 41 at the cool air outlet end of the first cool air guide channel 310.

In particular, a base stage 353 may be stepped around the cool air inlet 351 on the bottom inside the damper cover 350.

The mounting protrusion 331*c* protruding from the bottom of the damper case 331 may be accommodated in the base stage 353. That is, the channel opening/closing module 330 may be mounted in position inside the damper cover 350 without moving by the coupling structure of the base stage 353 and the mounting protrusion 331*c*.

A motor seat groove 354 in which the damper actuator 333 of the channel opening/closing module 330 may be formed inside the damper cover 350. That is, the damper actuator 333 may be mounted in the motor seat groove 354 and may be thermally insulated from the external environment.

Next, the second cool air guide channel 320 of the grille panel assembly 1 is described with reference to FIGS. 9 and 10.

The second cool air guide channel 320 may be a guide that may guide cool air, which flows inside between the grille panel 100 and the shroud 200 through the second intake hole 220, to flow to the ice making compartment 21.

The second cool air guide channel 320 may be formed on at least any one surface of the facing surfaces between the grille panel 100 and the shroud 200.

In particular, the second cool air guide channel 320 may be recessed on the rear of the grille panel 100 such that cool air flows therethrough.

The rear of the second cool air guide channel 320 may be open and the open rear of the second cool air guide channel 320 may be closed from the external environment by the shroud 200.

In some examples, the second cool air guide channel 320 may be formed at the shroud 200, and in this case, the second cool air guide channel 320 may be closed from the external environment by the grille panel 100.

In some examples, the second cool air guide channel 320 may be manufactured separated from the grille panel 100 or the shroud 200 and then may be coupled between the grille panel 100 and the shroud 200.

The second cool air guide channel 320 may be formed around the second seat 170 with the end reaching a side of the grille panel 100.

The end of the second cool air guide channel 320 may be open to pass through a side of the grille panel 100.

An end of the ice making compartment cool air duct 51 supplying cool air to the ice making compartment 21 may be connected to the open end of the second cool air guide channel 320. The other end of the ice making compartment cool air duct 51 may be connected to a guide duct 22 supplying cool air to the ice making compartment 21.

In particular, the second cool air guide channel 320 becomes narrows as it goes to the cool air outlet end. Accordingly, the flow pressure of cool air may be increased, whereby cool air may be supplied to a farther position.

The second seat 170 in which the ice making fan module 420 is seated may be formed in the second cool air guide channel 320.

The second seat 170 is positioned at the end opposite to the end where the cool air outlet end of the second cool air guide channel 320 is positioned, in the second cool air guide channel 320. Accordingly, the second cool air guide channel 320 may have a maximally large length.

A plurality of fastening protrusions 322, 323, and 324 may be formed in the second cool air guide channel 320.

The fastening protrusions 322, 323, and 324 may be portions for coupling to the ice making fan module 420 to be described below and may protrude toward the second seat 170 from the surface facing the second seat 170 of the inside of the second cool air guide channel 320.

The fastening protrusions 322, 323, and 324 may be formed at positions considering the size and the blowing direction of the ice making fan 421.

In detail, the fastening protrusions 322, 323, and 324 may include a first fastening protrusion 322 positioned adjacent to the bottom at the cool air outlet end of the second cool air guide channel 320, a second fastening protrusion 323 positioned adjacent to a first partition rib 510 to be described below, and a third fastening protrusion 324 positioned adjacent to a second partition rib 520 to be described below.

In particular, the circumference of the second intake hole of the second cool air guide channel 320 may be divided into a plurality of regions 321*a*, 321*b*, and 321*c*.

The regions 321*a*, 321*b*, and 321*c* may include a first region 321*a* commonly positioned between the first partition rib 510 and the second partition rib 520, which will be described below, and the ice making fan module 420.

The regions 321*a*, 321*b*, and 321*c* may include a second region 321*b* positioned between the bottom of the ice making fan module 420 and the second partition rib 520.

The regions 321*a*, 321*b*, and 321*c* may include a third region 321*c* positioned between the top of the ice making fan module 420 and the first partition rib 510 and communicating with the cool air outlet end of the second cool air guide channel 320.

The regions 321*a*, 321*b*, and 321*c* may be divided on the basis of the positions of the fastening protrusions 322, 323, and 324.

That is, the first region 321*a* may be the region between the second fastening protrusion 323 and the third fastening protrusion 324 around the ice making fan module 420, the second region 321*b* may be the region between the third fastening protrusion 324 and the first fastening protrusion 322 around the ice making fan module 420, and the third region 321*c* may be the region between the second fastening protrusion 323 and the first fastening protrusion 322 around the ice making fan module 420. This configuration is shown in FIG. 10.

The third region 321*c* may be defined to supply substantially the same amount of cool air as the sum of the first region 321*a* and the second region 321*b*, and the second region 321*b* may be defined to supply a relatively larger amount of cool air than the first region 321*a*.

That is, substantially half the entire cool air blown by operation of the ice making fan 421 may be supplied to the ice making compartment 21 and the other half may be supplied to the upper space and the lower space in the first cool air guide channel 310.

By making the amount of the cool air that is supplied to the sections different, cool air may be supplied to the ice making compartment 21 and cool air may be sufficiently supplied to the freezing compartment 12 and the switch compartment 13.

Most of the cool air that is supplied to the first cool air guide channel 310 through the first region 321*a* may be supplied to the freezing compartment 12 through the upper cool air discharge port 110, and the cool air supplied to the first cool air guide channel 310 through the second region 321*b* and communicating channels 610 and 620 may be partially supplied to the freezing compartment 12 through the lower cool air discharge ports 120 and 130 and may be supplied to the switch compartment 13 together with the cool air flowing through the first cool air guide channel 310.

As shown in FIGS. 9 and 18, close-contact portions 102 and 202 may be formed along the first cool air guide channel 310 and the second cool air guide channel 320 on the rear of the grille panel 100 and the front of the shroud 200.

The close-contact portions 102 and 202 may be positioned to face each other. The close-contact portions 102 and 202 may be a groove and a protrusion that may be fitted to each other.

The close-contact portions 102 and 202 may be brought in close contact with each other (or fitted to each other) when the grille panel 100 and the shroud 200 are combined, and the insides of the first cool air guide channel 310 and the second cool air guide channel 320 may be closed from the external environment by the close contact of the two close-contact portions 102 and 202.

Next, the freezing fan module 410 of the grille panel assembly 1 is described with reference to FIGS. 14, 15, 37, and 38.

The freezing fan module 410 may be a part that may blow the cool air that has passed through the second evaporator 32 to the first cool air guide channel 310.

The freezing fan module 410 may include a freezing fan 411 and a first installation frame 412.

The freezing fan 411 may be a slim centrifugal fan such that the thickness (front-rear width) of the grille panel assembly 1 may be maximally reduced.

The freezing fan 411 may include a hub 411*a*, a rib 411*b*, and a plurality of impellers 411*c*.

The hub 411*a* may be coupled to a fan motor 413 through a shaft and may protrude forward (in the direction facing the cool air intake side) as it goes to the center, and the rear thereof may rapidly expand as it goes to the end. The fan motor 413 may be installed inside the hub 411*a*.

The rib 411*b* may be a part formed to surround the hub 411*a*. The rib 411*b* may be a circular rim.

The impellers 411*c* may be parts provided to guide the blowing direction of cool air. The impellers 411*c* may be spaced apart from each other and may have a predetermined inclination (or may be rounded) such that cool air passes therebetween.

The first installation frame 412 may be a part on which the freezing fan 411 may be installed.

The first installation frame 412 may be fixed to the fastening protrusions 312, 313, and 314 formed at the shroud 200.

The fastening protrusions 312, 313, and 314 may protrude toward the first seat 160 from the portion facing the first seat 160 in the first cool air guide channel 310 of the shroud 200, and may be formed at positions considering the size and the blowing direction of the freezing fan 411.

Fastening holes 412*a*, 412*b*, and 412*c* for fastening to the fastening protrusions 312, 313, and 314 may be formed at the first installation frame 412, and the fastening protrusions 312, 313, and 314 and the fastening holes 412*a*, 412*b*, and 412*c* may be aligned to face each other and then fastened by fastening members.

Next, the ice making fan module 420 of the grille panel assembly 1 is described with reference to FIGS. 14, 15, 37, and 38.

The ice making fan module 420 may be a part that may blow the cool air that has passed through the second evaporator 32 to the second cool air guide channel 320.

The ice making fan module 420 may include an ice making fan 421, a second installation frame 422, and a fan motor 423.

The ice making fan 421 may be a slim centrifugal fan such that the thickness (front-rear width) of the grille panel assembly 1 may be maximally reduced.

The ice making fan 421 may include a hub 421*a*, a rib 421*b*, and a plurality of impellers 421*c*.

The hub 421*a* may be coupled to a fan motor 423 through a shaft and may protrude forward (in the direction facing the cool air intake side) as it goes to the center, and the rear thereof may rapidly expand as it goes to the end.

The rib 421*b* may be a part formed to surround the hub 421*a*. The rib 421*b* may be a circular rim.

The impellers 421*c* may be parts provided to guide the blowing direction of cool air. The impellers 421*c* may be spaced apart from each other and may have a predetermined inclination (or may be rounded) such that cool air passes therebetween.

In particular, the ice making fan 421 may be provided as a fan that may be the same in structure and size as those of the freezing fan 411 of the freezing fan module 410. Accordingly, the ice making fan 421 and the freezing fan 411 may be shared.

The fan motor 423 of the ice making fan 421 may be installed on the second installation frame 422.

The second installation frame 422 may be fastened to a plurality of fastening protrusions 322, 323, and 324 formed at the shroud 200.

Fastening holes 422*a*, 422*b*, and 422*c* for fastening to the fastening protrusions 322, 323, and 324 may be formed at the second installation frame 422, and the fastening protrusions 322, 323, and 324 and the fastening holes 422*a*, 422*b*, and 422*c* may be aligned to face each other and then fastened by fastening members.

In particular, the ice making fan module 420 may be configured to be positioned closer to the partition ribs 510 and 520 to be described below than the cool air outlet end of the second cool air guide channel 320 (see FIG. 21).

That is, the ice making fan 421 of the ice making fan module 420 may be spaced a sufficient distance apart from the cool air outlet end of the second cool air guide channel 320.

Accordingly, the cool air passing through the cool air outlet end of the second cool air guide channel 320 may be prevented from becoming turbulent without smoothly passing through the cool air outlet end by hitting against with flow of the cool air rotating in the rotational direction of the ice making fan 421. The distance between the ice making fan module 420 and the cool air outlet end may be set to be at least 25 mm or more.

The ice making fan 421 of the ice making fan module 420 and the freezing fan 411 of the freezing fan module 410 may be controlled to rotate at different rotational speeds.

In detail, the ice making fan 421 of the ice making fan module 420 is controlled to rotate at a higher rotational speed than the freezing fan 411 of the freezing fan module 410.

That is, since the freezing fan 411 may supply cool air to the freezing compartment 12 positioned ahead of the freezing fan 411, the freezing fan 411 may rotate at a rotational speed where it may provide a large amount of cool air. However, since the ice making compartment 21 may be positioned far in comparison to the freezing compartment 12 or the switch compartment 13, the ice making fan 421 may forcibly send air up to the ice making compartment 21 while operating at a higher rotational speed than the freezing fan 411.

The center of the ice making fan module may be positioned lower than the center of the freezing fan module. A sufficient space in which cool air may flow may be provided between the ice making fan and the top of the grille panel.

Next, the partition ribs 510 and 520 of the grille panel assembly 1 are described with reference to FIG. 10.

The partition ribs 510 and 520 may be formed across the interface between the first cool air guide channel 310 and the second cool air guide channel 320. That is, the two cool air guide channels 310 and 320 may provide channels separated by the partition ribs 510 and 520.

The partition ribs 510 and 520 may be divided into a first partition rib 510 and a second partition rib 520. That is, the partition ribs 510 and 520 may be divided into two parts and the ends of the two partition ribs 510 and 520 may be spaced apart in parallel with each other such that a first communicating channel 610 may be provided in the gap.

In some examples, one partition rib may be formed and the first communication channel 610 may be formed at any one portion of the partition rib.

The first partition rib 510 may protrude downward from the top of the grille panel 100.

That is, the first partition rib 510 may be formed to block an upper portion from a center portion between the ice making fan module 420 and the freezing fan module 410.

Cool air provided from the freezing fan module 410 may be prevented from being directly discharged to the cool air outlet end of the second cool air guide channel 320 by the structure of the first partition rib 510.

The lower end of the first partition rib 510 may have a length to be positioned lower than the positions of the centers of the freezing fan module 410 and the ice making fan module 420. Accordingly, it may be possible to minimize cool air flowing into the second cool air guide channel 320 after being produced by operation of the freezing fan module 410 and to enable cool air produced by operation of the ice making fan module 420 to be smoothly supplied to the upper cool air discharge portion 110 in the first cool air guide channel 310.

In particular, the first partition rib 510 may be rounded to surround a portion of the circumference of the second seat 170.

That is, the rounded structure of the first partition rib 510 may enable the cool air blown from the ice making fan module 420 to smoothly flow to the cool air outlet end of the channel opening/closing module 330. Further, the rounded structure of the first partition rib 510 may enable to cool air blown from the freezing fan module 410 to pass through the freezing fan module 410 and the ice making fan module 420 and then smoothly flow to the lower portion in the first cool air guide channel 310.

The second partition rib 520 may protrude upward from the bottom in the first cool air guide channel 310 of the rear of the grille panel 100.

That is, the second partition rib 520 may be formed to block a lower portion from a center portion between the ice making fan module 420 and the freezing fan module 410.

The structure of the second partition rib 520 may prevent the cool air provided from the ice making fan module 420 from flowing to the freezing fan module 41*o* in the first cool air guide channel 310 and may enable to cool air to smoothly flow to the upper cool air discharge port 110.

The upper end of the second partition rib 520 may have a length to be positioned higher than the positions of the centers of the freezing fan module 410 and the ice making fan module 420. Accordingly, it may be possible to minimize the cool air provided from the freezing fan module 420 and flowing to the portion where the ice making fan module 420 is positioned and to enable the cool air produced by operation of the ice making fan module 420 to be smoothly supplied to the upper cool air discharge port 110 in the first cool air guide channel 310.

Further, the second partition rib 520 may be rounded to surround a portion of the circumference of the second seat 170.

That is, the rounded structure of the second partition rib 520 may enable the cool air blown from the ice making fan module 420 to smoothly flow to any one end portion (where the ice making module is positioned) of the upper cool air discharge port 110.

In particular, a guide rib 521 may be formed at the lower end portion of the second partition rib 520.

The guide rib 521 may gradually protrude toward the bottom of the first cool air guide channel 310 and may be rounded toward the lower end of the second partition rib 520 such that cool air flows to any one end of the bottom in the first cool air guide channel 310.

That is, cool air flowing down on the surface of the second partition rib 520 may be guided by the guide rib 521 to smoothly flow to the first lower cool air discharge port 120 positioned at any one side of the bottom in the first cool air guide channel 310.

The lower end of the first partition rib 510 and the upper end of the second partition rib 520 may be spaced apart from each other. The gap may be provided as the first communicating channel 610. That is, the first communication channel 610 may be formed by spacing the two partition ribs 510 and 520, and the cool air in the second cool air guide channel 320 that is blown by the ice making fan module 420 may be partially supplied into the first cool air guide channel 310 through the first communicating channel 610. This configuration will be described again below.

Next, communication channels 610 and 620 of the grille panel assembly 1 are described with reference to FIG. 10.

The communication channels 610 and 620 may be channels guiding a portion of the cool air in the second cool air guide channel 320 to the first cool air guide channel 310 when the ice making fan is operated.

That is, when the ice making fan 421 is operated, the first cool air guide channel 310 may be supplied with a portion of the cool air in the second cool air guide channel 320 through the communicating channels 610 and 620, whereby the pressures in the first cool air guide channel 310 and the second cool air guide channel 320 may equally increase. Accordingly, the cool air in the switch compartment 13 or the freezing compartment may be prevented from flowing backward to the ice making fan 421 due to a pressure difference between the two cool air guide channels 310 and 320.

The communicating channels 610 and 620 may include the first communicating channel 610.

The first communicating channel 610 may be formed to guide the cool air in the first region 321*a* of the second cool air guide channel 320 to the upper space (the space in which the upper cool air discharge port is positioned) in the first cool air guide channel 310.

The first communicating channel 610, as described above, may be formed by the gap between the ends of the two partition ribs 510 and 520.

In particular, the ends of the two partition ribs 510 and 520 may be disposed partially in parallel with each other, whereby the first communicating channel 610 may form a passage having a predetermined length.

The first communicating channel 610 may be formed toward any one end of the upper cool air discharge port 110. Accordingly, it may be possible to reduce the phenomenon that the cool air supplied to the upper cool air discharge port 110 through the first communicating channel 610 is interfered by hitting against the cool air flowing in the first cool air guide channel 310.

To this end, the lower end of the first partition rib 510 may be disposed relatively close to the ice making fan module 420 in comparison to the upper end of the second partition rib 520, and the upper end of the second partition rib 520 may be positioned over the lower end of the first partition rib 510. The spacing and overlapping structure of the two partition ribs 510 and 520 may enable the cool air blown by the ice making fan module 420 to be smoothly supplied to the freezing compartment 12 through the upper cool air discharge port 110.

When the freezing fan module 410 is operated with the ice making fan module 420 stopped (or when the ice making fan module is stopped while the freezing fan module is operated), the cool air in the first cool air guide channel 310 may be supplied into the second cool air guide channel 320 through the first communicating channel 610. Accordingly, cool air may be insufficiently supplied to the freezing compartment 12.

Considering this, the ice making fan module 420 may be configured to enable the cool air flowing in the second cool air guide channel 320 to be smoothly supplied into the first cool air guide channel 310 through the first communicating channel 610 and to reduce the cool air flowing in the first cool air guide channel 310 and supplied into the second cool air guide channel 320 through the first communicating channel 610 (hereafter, referred to as "backward flow").

Various configurations may be considered to reduce the backward flow.

For example, the first fastening protrusion 312 of the fastening protrusions 312, 313, and 314 formed in the first cool air guide channel 310 may reduce the backward flow by being positioned at the position where the flow guide stage 161 is formed in the open top of the first seat 160.

That is, by positioning the first fastening protrusion 312 at the portion facing the first communicating channel 610 in the flow path of the cool air rotating around the freezing fan 411, it may be possible to prevent the cool air from directly flowing to the first communicating channel 610 by hitting against the first fastening protrusion 312.

The flow guide stage 161 formed in the first seat 160 may be used to reduce the backward flow.

That is, it may be possible to reduce the backward flow by guiding the cool air rotating around the freezing fan 411 of the freezing fan module 410 toward any one side of the upper cool air discharge port 110 using the flow guide stage 161.

The second fastening protrusion 323 and the third fastening protrusion 324 of the fastening protrusions 322, 323, and 324 coupled to the second installation frame 422 of the ice making fan module 420 may be installed to be positioned adjacent to the first partition rib 510 and the second partition rib 520, respectively, whereby it may be possible to reduce the backward flow.

That is, the two partitioning fastening protrusions 323 and 324 may be positioned respectively adjacent to the first partition rib 510 and the second partition rib 520, and the gap between the second fastening protrusion 323 and the first partition rib 510 adjacent to the second fastening protrusion 323 and the gap between the third fastening protrusion 324 and the second partition rib 520 adjacent to the third fastening protrusion 324 may be minimized.

Accordingly, the cool air in the first cool air guide channel 310 may be locked in the first region 321*a* in the second cool air guide channel 320 and may not flow to the third region 321*c* through the first communicating channel 610 between the two partition ribs 510 and 520.

In some implementations, various configurations that may reduce the backward flow may be additionally provided other than the flow guide stage 161, or the first fastening protrusion 312 in the first cool air guide channel 310, and the two partition fastening protrusions 323 and 324 in the second cool air guide channel 320.

The communicating channels 610 and 620 may include the second communicating channel 620.

The second communicating channel 620 may be formed to guide the cool air in the second region 321*b* of the second cool air guide channel 320 to the lower space (the space in which the lower cool air discharge port is positioned) in the first cool air guide channel 310.

To this end, the second communicating channel 620 may be formed to connect the second region 321*b* and the first cool air guide channel 310.

In particular, the second communicating channel 620 may be formed to be positioned under the ice making fan module 420. Accordingly, condensate water produced in the second cool air guide channel 320 may be discharged to the lower space in the first communicating channel 610 through the second communicating channel 620.

That is, a separate condensate water outlet communicating with the inside of the cabinet 10 to remove condensate water may not be formed at the second cool air guide channel 320 due to the second communicating channel 620, and a pressure drop due to such a condensate water outlet may be prevented.

In detail, the second communicating channel 620 may be formed through the lower end of the second partition rib 520.

The second communicating channel 620 may be formed to be gradually narrowed toward the cool air outlet end. Accordingly, the cool air passing through the second communicating channel 620 may be gradually increased in flow speed and supplied to the first cool air guide channel 310 due to a high pressure, whereby the cool air flowing in the first cool air guide channel 310 may be prevented from flowing backward to the second cool air guide channel 320 through the second communicating channel 620.

The cool air flowing into the first cool air guide channel 310 through the second communicating channel 620 may hit against the cool air flowing in the first cool air guide channel 310 in the process of flowing inside.

That is, the cool air flowing through the first cool air guide channel 310 and the cool air passing through the second communicating channel 620 may meet each other at the lower end of the guide rib 521 by the freezing fan 411, so the two items of flow may hit against each other, whereby cool air may not smoothly flow along the bottom in the first cool air guide channel 310, which may cause the problem that cool air may not be smoothly discharged to the first lower cool air discharge port 120 or the second lower cool air discharge port 130.

In consideration of this problem, a non-contact stage 522 may be formed on the rear (facing the shroud) of the guide rib 521 of the second partition rib 520.

The non-contact stage 522 may be inclined gradually away from the front of the shroud as it goes to the end of the guide rib 521.

That is, a portion of the cool air passing through the second communicating channel 620 may be guided by the non-contact stage 522 to flow to the front of the shroud 200.

Accordingly, it may be possible to direct hitting of the cool air flowing through the first cool air guide channel 310 and the cool air flowing into the first cool air guide channel 310 through the communicating channel 600 due to the freezing fan 411, so cool air may smoothly flow along the bottom in the first cool air guide channel 310. Accordingly, cool air may be smoothly discharged to the first lower cool air discharge port 120 or the second lower cool air discharge port 130.

Next, the controller is described.

The controller may be a device controlling the operation of the refrigerator.

The controller may be configured to control the operation of a compressor, the operation of the fan modules 410 and 420 and the channel opening/dosing module 330, and perform a freezing operation (S100), a switch compartment operation (S200), or an ice making operation (S300).

In particular, the controller may control the freezing fan 411 and the ice making fan 421 to operate at different rotational speeds. That is, the controller may control the freezing fan 411 to rotate at a higher speed than the ice making fan 421 or control the ice making fan 421 to rotate at a higher speed than the freezing fan 411.

The process of controlling the temperatures of the storage compartments 12, 13, and 21 by the operation of the refrigerator is described hereafter.

First, the process of controlling the temperature of the freezing compartment 12 is described with reference to FIGS. 39 to 45.

Figure 39:
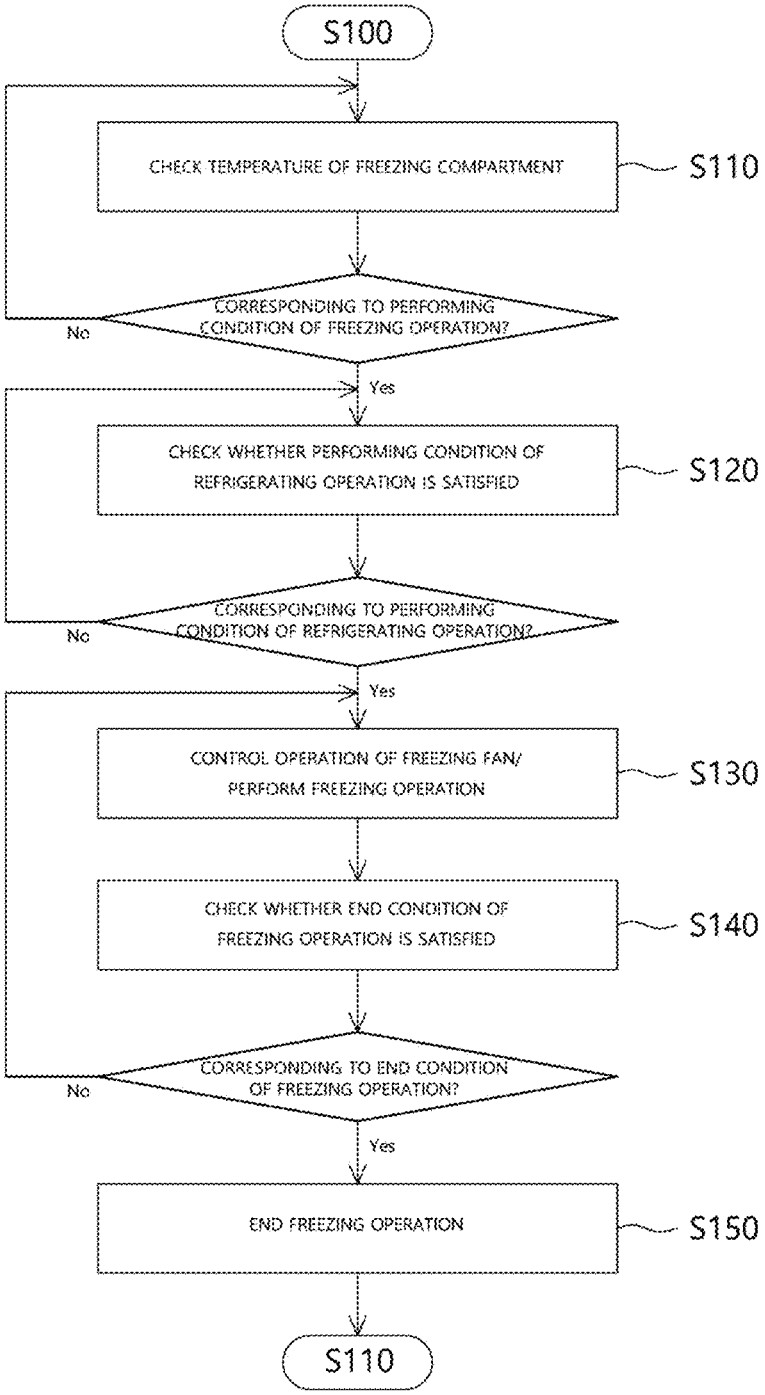
FIG. 39 is a flowchart showing an example of a control method in a freezing operation of the refrigerator.

FIG. 39 is a flowchart showing a control process in a freezing operation of the method of controlling the operation of the refrigerator.

Figure 40:
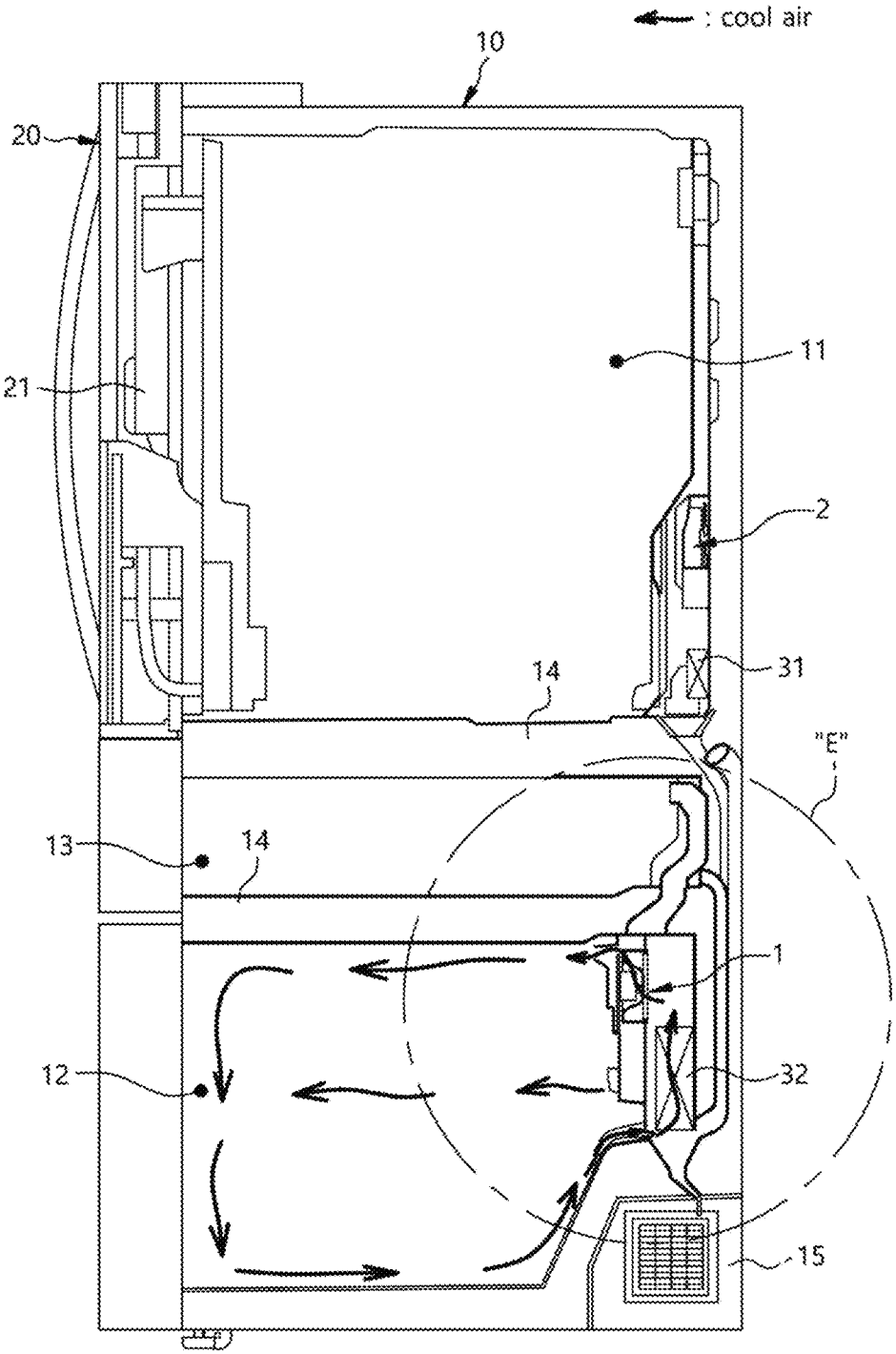
FIG. 40 is a side cross-sectional view showing an example of flow of cool air in the freezing operation of the refrigerator.
Figure 41:
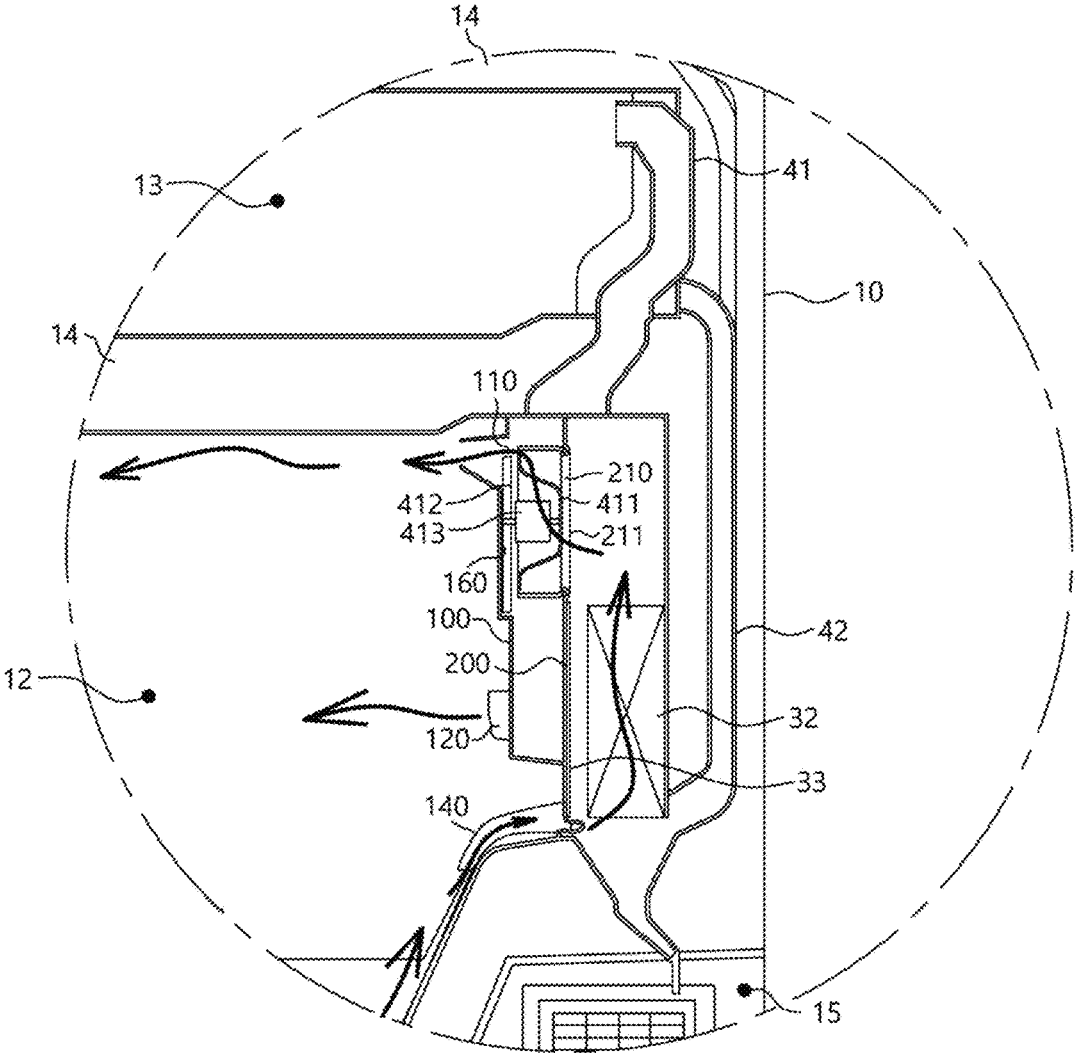
FIG. 41 is an enlarged view of the part "E" of FIG. 40.
Figure 42:
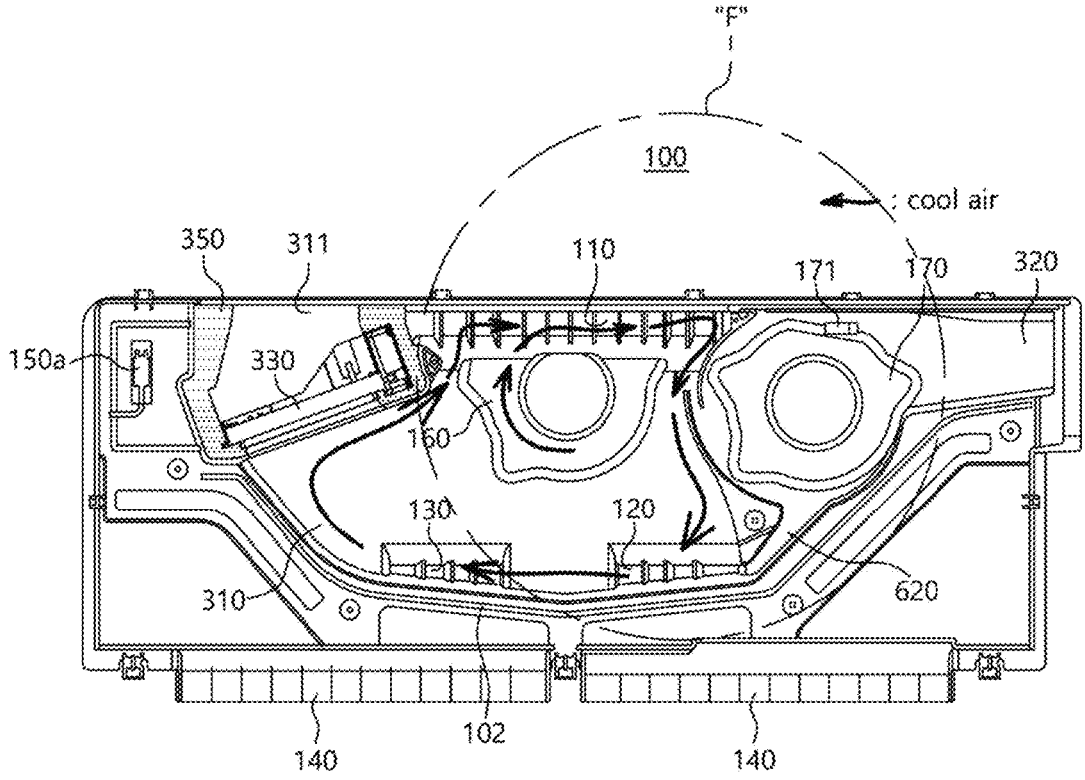
FIG. 42 is a state view showing an example of flow of cool air in a grille panel assembly in the freezing operation of the refrigerator.
Figure 43:
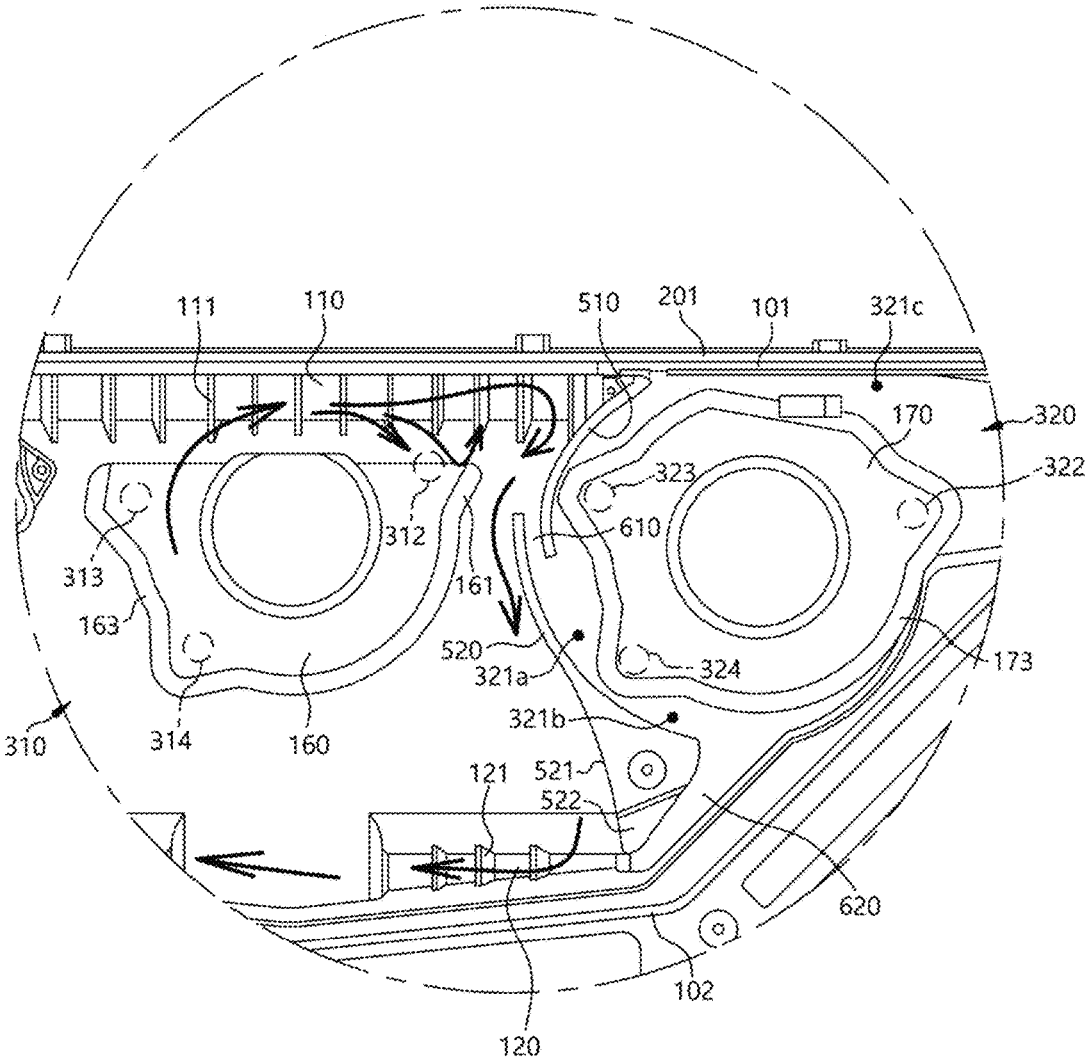
FIG. 43 is an enlarged view of the part "F" of FIG. 42.
Figure 44:
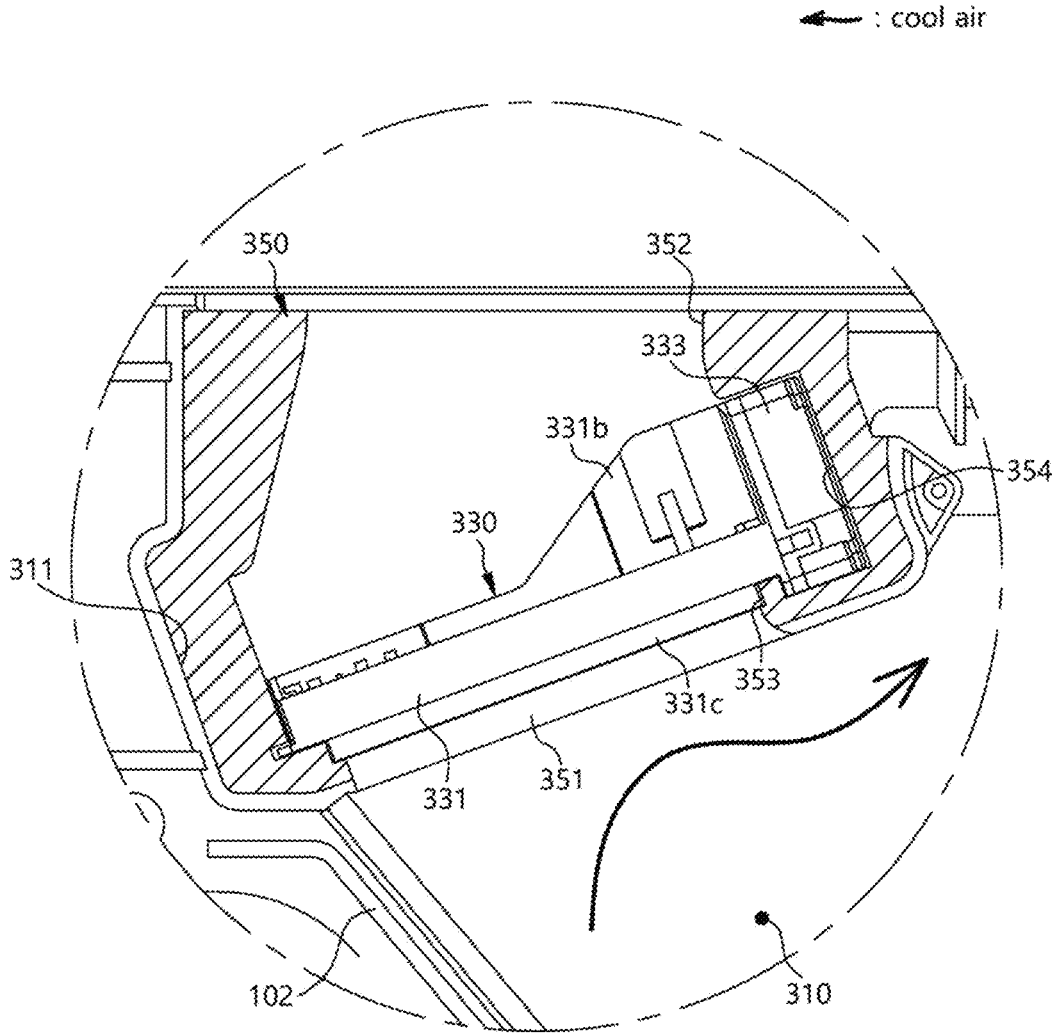
FIG. 44 is an enlarged view of main parts showing an example of a channel opening/closing module in the freezing operation of the refrigerator.
Figure 45:
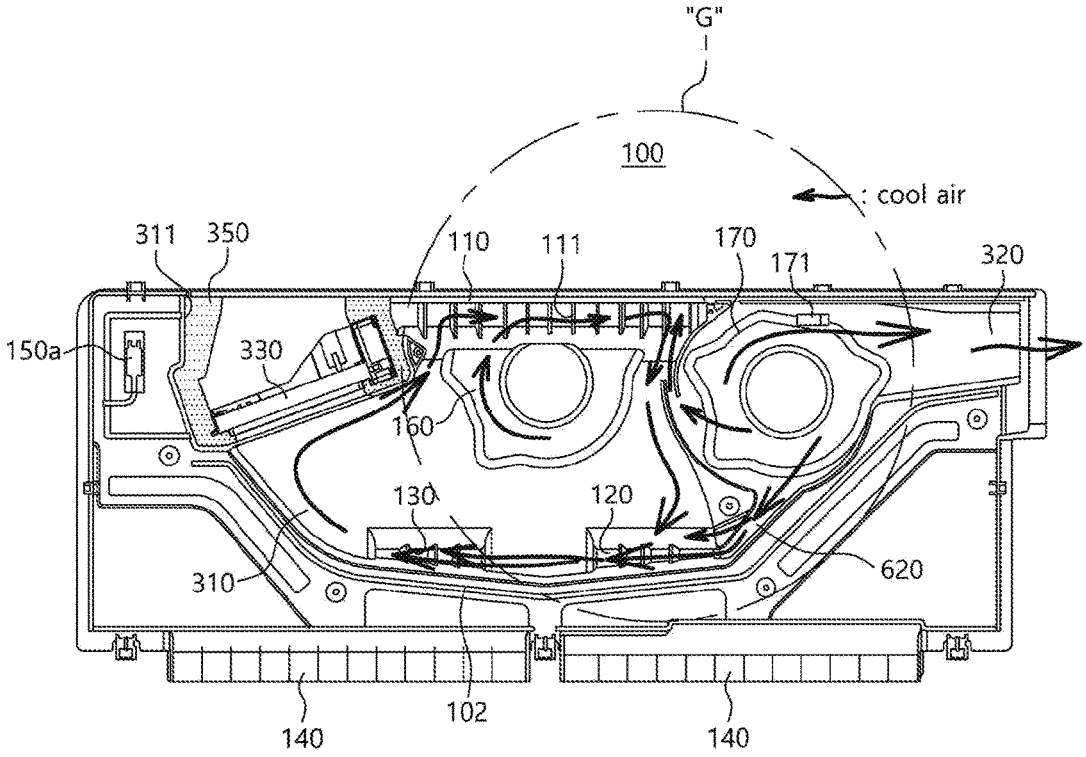
FIG. 45 is a state view showing an example of flow of cool air in the grille panel assembly when a freezing operation and an ice making operation are simultaneously performed in the refrigerator.
Figure 46:
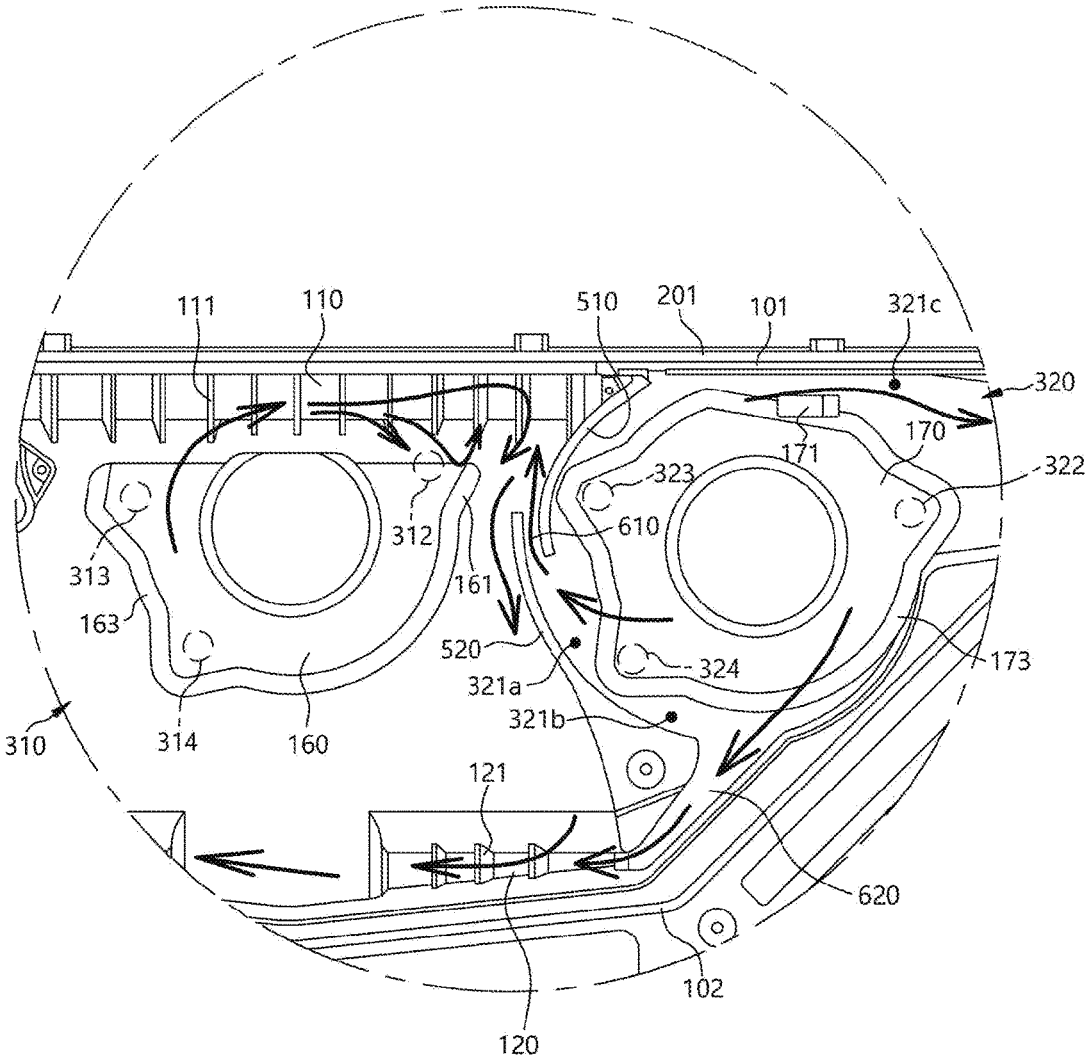
FIG. 46 is an enlarged view of the part "G" of FIG. 45.

FIG. 40 is a side cross-sectional view showing the flow of cool air in a freezing operation for the freezing compartment of the refrigerator, FIG. 41 is an enlarged view of the part "E" of FIG. 40, FIG. 42 is a state view showing cool air flow in the grille panel in the freezing operation for the freezing compartment of the refrigerator, and FIG. 43 is an enlarged view of the part "F" of FIG. 42.

As in the flowchart of FIG. 39, the freezing operation (S100) may be started through a first checking process (S110) in which the controller checks whether the performing condition of the freezing operation is satisfied on the basis of the temperature of the freezing compartment 12 sensed by a temperature sensor 150*a* installed in the grille panel assembly 1.

That is, when the performing condition of the freezing operation is satisfied through the first checking process (S110), the freezing operation may be controlled to be started.

The performing condition of the freezing operation (S100) may be a condition about whether the temperature of the freezing compartment 12 is out of a set freezing temperature range (e.g., a temperature range between −13° C.--6° C.).

When the temperature of the freezing compartment 12 is determined as being higher than the set temperature range by the first checking process (S110) and the performing condition of the freezing operation is satisfied, the controller may perform a second checking process (S120) checking whether it corresponds to a performing condition of a refrigerating operation.

The second checking process (S120) may be whether the refrigerating operation is performed now, which may be performed by checking whether the blowing fan of the grille panel assembly 2 positioned in the refrigerating compartment 11 is being operated or whether a refrigerant is being supplied to the first evaporator 31.

In some examples, the second checking process (S120) may be performed on the basis of the temperature of the refrigerating compartment provided from the temperature sensor of the grille panel assembly 2 disposed in the refrigerating compartment 11. That is, when it is determined that the temperature of the refrigerating compartment 11 is higher than a predetermined refrigerating temperature range, it may be determined that the refrigerating operations is being performed.

When it is determined that the refrigerating operation is being performed, it may be determined that it does not correspond to the performing condition of the freezing operation and the freezing fan 411 may keep stopped until the freezing operation is finished, whereby the second checking process (S120) may be repeated without the freezing operation performed.

If it is determined that the refrigerating operation is not performed through the second checking process (S120), the controller may control the operation of the freezing fan module 410 and the compressor.

Accordingly, power may be supplied to the freezing fan module 410, the freezing fan 411 may be rotated and the compressor may be operated, whereby the second evaporator 32 may exchange heat and a freezing process (S130) may be performed.

When the freezing operation (S130) is performed (a switch compartment operation is not performed), the opening/closing damper 332 of the channel opening/closing module 330 may be positioned to block the through-hole 331*a* of the damper case 331 (the state shown in FIG. 44), whereby the cool air outlet end of the first cool air guide channel 310 may keep closed.

When the freezing fan 411 is controlled to operate by the controller, the air in the freezing compartment 12 may be sent to pass through the second evaporator 32 by the air blowing force by the freezing fan 411 and may exchange heat through the second evaporator 32.

The air (cool air) that has exchanged heat may flow into the first cool air guide channel 310 through the first intake hole 210 of the shroud 200 and then may flow through the first cool air guide channel 310, and may be supplied to the upper space in the freezing compartment 12 through the upper cool air discharge port 110 formed in the grille panel 100.

In particular, considering that the bottom wall 113 of the upper cool air discharge port 110 may be inclined upward as it goes in the protruding direction, the cool air flowing in the circumferential direction of the freezing fan 411 may be guide to the bottom wall 113 of the upper cool air discharge port 110 and then may be smoothly discharged toward the front of the upper cool air discharge port 110 while flowing on the bottom wall 113.

The cool air not discharged to the upper cool air discharge port 110 of the cool air flowing by the blowing force of the freezing fan 411 may flow through the upper cool air discharge port 110 and may be supplied to the middle portion in the freezing compartment 12 while sequentially passing through the first lower cool air discharge port 120 and the second lower cool air discharge port 130 formed in the first cool air guide channel 310 while passing through the first cool air guide channel 310.

A half or more of the cool air that has passed through the first intake hole 210 may be discharged to the upper cool air discharge port 110 and the other cool air may be discharged to the first lower cool air discharge port 120 and the second lower cool air discharge port 130.

In particular, considering that the cool air outlet end of the first cool air guide channel 310 may be closed by the channel opening/closing module 330, most of the cool air flowing through the first cool air guide channel 310 may be supplied to the middle space in the freezing compartment 12 through the lower cool air discharge ports 120 and 130 and a portion of the cool air may rise and may be supplied to the portion where the top is positioned in the freezing compartment 12 through the upper cool air discharge port 110.

In some examples, a portion of the cool air not discharged to the upper cool air discharge port 110 and flowing down through the first cool air guide channel 310 may flow into the second cool air guide channel 320 through the first communicating channel 610 between the two partition ribs 510 and 520 due to the flow of the cool air produced in the same direction as the rotational direction of the freezing fan 411.

However, the flow of the cool air produced in the same direction as the rotational direction of the freezing fan 411 may be prevented from directly flowing to the first communicating channel 610 by being blocked by the flow guide stage 161 formed in the first seat 160 and the first fastening protrusion 312 in the first cool air guide channel 310. The cool air may be guided up to the end of the first cool air guide channel 310 by the inclined (or rounded) structure of the flow guide stage 161.

In some examples, in the cool air flowing to the bottom in the first cool air guide channel 310 from the top in the first cool air guide channel 310, a partial cool air flowing down on the surfaces of the partition ribs 510 and 520 may flow into the first region 321*a* of the second cool air guide channel 320.

However, since the first region 321*a* may be substantially separated from the third region 321*c*, the amount of cool air flowing to the ice making compartment through the third region 321*c* may be very small, so it may not influence temperature control of the freezing compartment 12.

While the cool air is supplied to the freezing compartment 12 through the lower cool air discharge ports 120 and 130, the discharge direction may be guided by the grille ribs 121 and 131 formed in the lower cool air discharge ports 120 and 130. That is, the cool air may be uniformly discharged throughout the inside of the freezing compartment 12 by the grille ribs 121 and 131.

The flow of the cool air flowing through the first cool air guide channel 310 may be guided not only by the top and the bottom in the first cool air guide channel 310, but also by the partition ribs 510 and 520.

That is, a portion of the cool air that has passed through the upper cool air discharge port 110 while flowing on the top in the first cool air guide channel 310 may flown on the surface of the second partition rib 520, and in this process, it may be guided by the guide rib 521 formed at the lower end portion of the second partition rib 520 to flow to the portion where the first lower cool air discharge port 120 is formed.

Accordingly, the cool air guided to flow by the guide rib 521 may be supplied to the freezing compartment 12 through the first lower cool air discharge port 120.

The cool air not discharged to the first lower cool air discharge port 120 may flow to the second lower cool air discharge port 130 while flowing on the bottom in the first cool air guide channel 310 and may be discharged into the freezing compartment 12 through the second lower cool air discharge port 130.

In particular, since the bottom in the first cool air guide channel 310 may be rounded, the cool air that has passed through the first lower cool air discharge port 120 may smoothly flow to the second lower cool air discharge port 130 while flowing on the bottom in the first cool air guide channel 310.

The cool air supplied into the freezing compartment 12 through the cool air discharge ports 110, 120, and 130 may be guided to return to the air intake side of the second evaporator 32 by the suction guide 140 formed in the grille panel 100 after flowing in the freezing compartment 12.

In particular, considering that the suction guide 140 may be inclined (or rounded) in the freezing compartment 12, the cool air flowing on the inclined wall of the machine room 15 after flowing in the freezing compartment 12 may be guided to smoothly flow to the air intake side of the second evaporator 32 by the suction guide 140.

Whether the temperature in the freezing compartment may be continuously checked by the temperature sensor 150*a* installed in the grille panel 100 while the freezing operation of supplying cool air to the freezing compartment 12 is performed, and accordingly, when it is checked that the temperature in the freezing compartment 12 decreases under a set temperature (a set temperature condition is satisfied), the operation of the freezing fan 411 and the refrigeration cycle may be stopped such that supply of cool air is stopped.

In some examples, when the temperature in the freezing compartment 12 increases over the set temperature, the operation of the freezing fan 411 and the refrigeration cycle may be restarted and cool air may be supplied to the freezing compartment 12.

Accordingly, the temperature in the freezing compartment 12 may be controlled to reach the set temperature range by repeated circulation of the air (cool air).

When the freezing process (S130) is performed, a third checking process (S140) of checking whether an end condition of the freezing process (S130) is finished may be performed.

The end condition of the freezing process (S130) may be the case when the temperature in the freezing compartment is further lower than the set temperature. The set temperature may be set as a temperature that is in a set freezing temperature range of the first checking process (S110) and is further lower than the maximum temperature of the freezing temperature range.

For example, when the freezing temperature range is −16° C.~−6° C., the set temperature may be −13° C. In some examples, the set temperature may be a temperature further lower than the freezing temperature range.

Then the internal temperature of the freezing compartment 12 satisfies the end condition of the freezing operation in the third checking process (S140), the controller may finish the freezing operation by performing a stopping process (S150) of stopping the operation of the freezing fan 411.

The ice making fan 421 may also be operated while the temperature of the freezing compartment 12 is controlled.

That is, considering that the ice making operation (S300) is continuously performed except for a specific condition (e.g., when the ice storage of the ice making compartment is full with ice, etc.), the ice making operation (S300) may be performed while the freezing operation (S100) is performed.

If the ice making operation (S300) is also performed while the freezing operation (S100) is performed, flow of cool air sequentially flowing through the second intake hole 220 and the second cool air guide channel 320 may be generated by the operation of the ice making fan 421.

The cool air produced by the operation of the ice making fan 421 may be partially supplied to the first cool air guide channel 310 through the first communicating channel 610 and the second communicating channel 620 and the other cool air may be supplied to the ice making compartment 21 through the ice making compartment cool air duct 51 connected to the second cool air guide channel 320.

That is, the cool air blown to the first region 321*a* of the second cool air guide channel 320 through the second intake hole 220 may be supplied to the first cool air guide channel 310 through the first communicating channel 610, the cool air blown to the second region 321*b* of the second cool air guide channel 320 through the second intake hole 220 may be supplied to the first cool air guide channel 310 through the second communicating channel 620, and the cool air blown to the third region 321*c* of the second cool air guide channel 320 through the second intake hole 220 may be supplied to the ice making compartment 21 through the ice making compartment cool air duct 51 connected to the cool air outlet end of the second cool air guide channel 320.

Accordingly, since not only the cool air blown by the operation of the freezing fan 411, but also the cool air blown by the operation of the ice making fan 421 may be supplied into the freezing compartment 12, cool air may be sufficiently supplied.

The flow of cool air when the freezing operation and the ice making operation are both performed is shown in FIGS. 46 to 50.

In particular, the flow of cool air may be discharged to the upper cool air discharge port when the freezing operation and the ice making operation are both performed, and the flow of cool air may be discharged to the lower cool air discharge ports when the freezing operation and the ice making operation are both performed.

In some examples, a separate cool air discharge port may be additionally formed between the two lower cool air discharge ports 120 and 130. However, cool air discharged through the additionally formed cool air discharge port may hit against the flow of cool air returning to a lower space after circulating in the freezing compartment 12. Accordingly, a separate lower cool air discharge port may not be formed between the two lower cool air discharge port 120 and 130.

When a separate lower cool air discharge port is further formed between the two lower cool air discharge ports 120 and 130, the amount of cool air flowing to both walls in the freezing compartment is relatively small, so the freezing compartment may not be uniformly frozen.

Next, the switch compartment operation (S200) for temperature control of the switch compartment 13 is described with reference to FIGS. 47 to 51.

Figure 47:
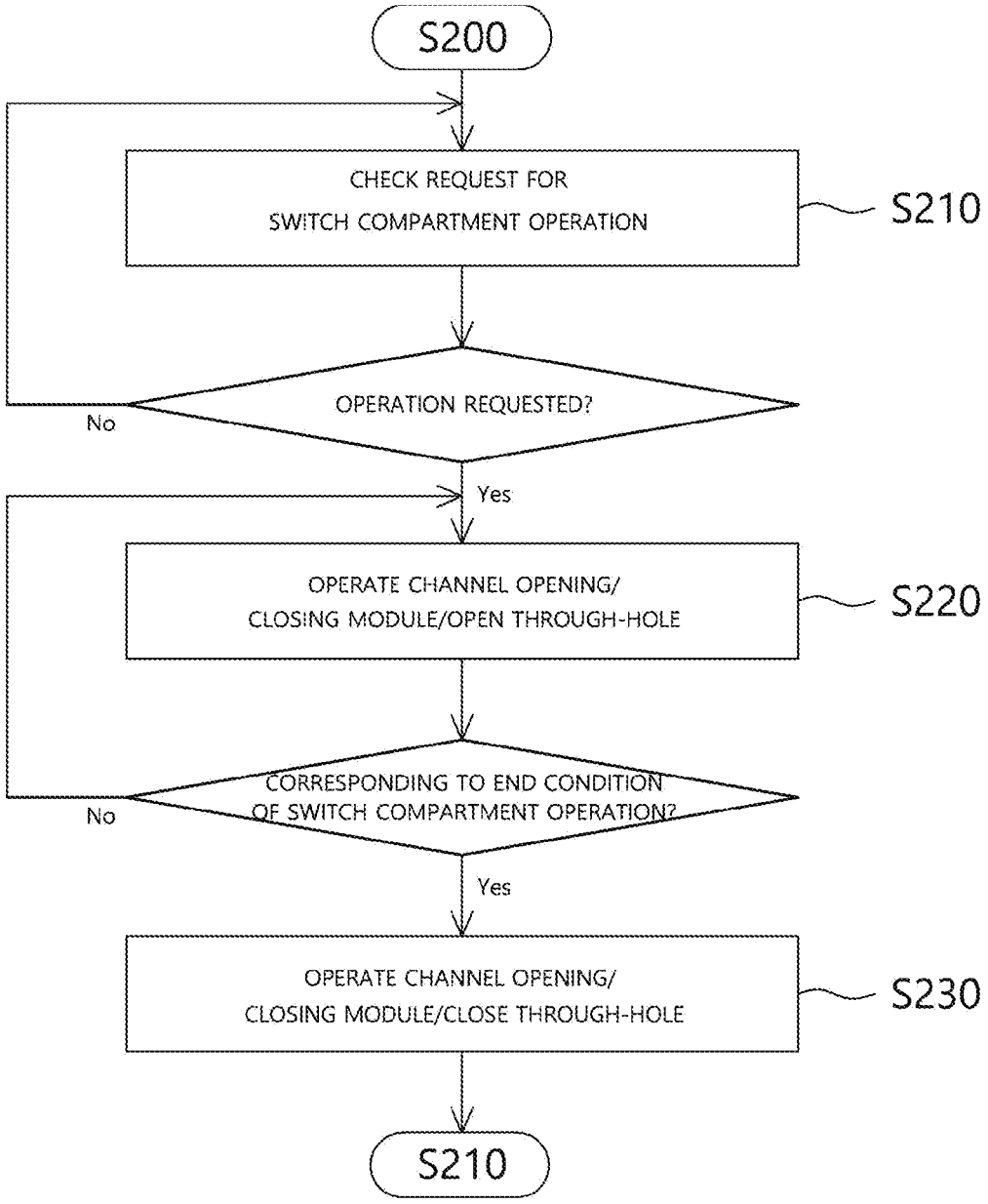
FIG. 47 is a flowchart showing an example of a control method in the freezing operation of the refrigerator.

FIG. 47 is a flowchart showing a control process in a switch compartment operation of the method of controlling the operation of the refrigerator.

Figure 48:
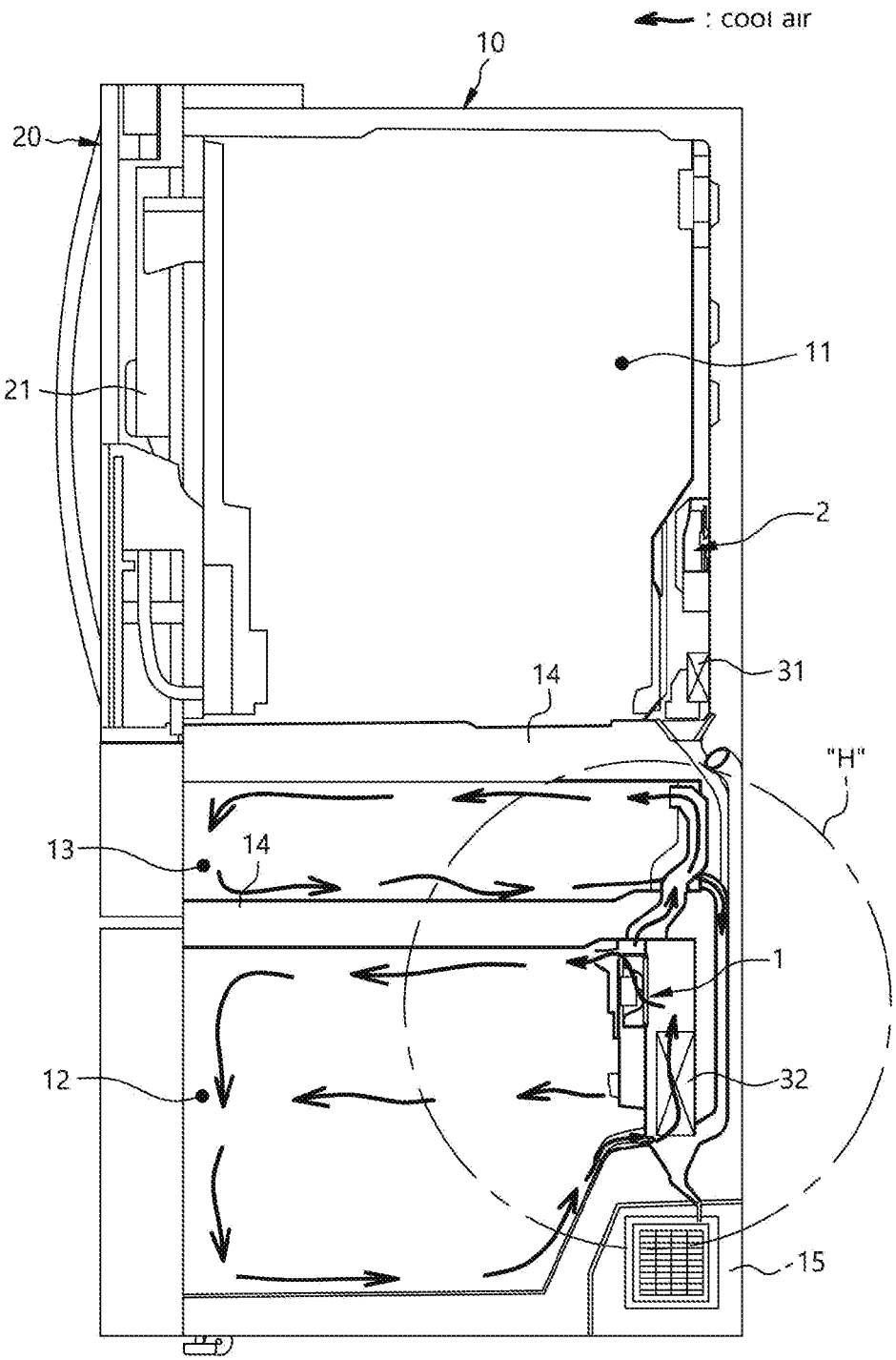
FIG. 48 is a side cross-sectional view showing an example of flow of cool air in the freezing operation for a switch compartment of the refrigerator.
Figure 49:
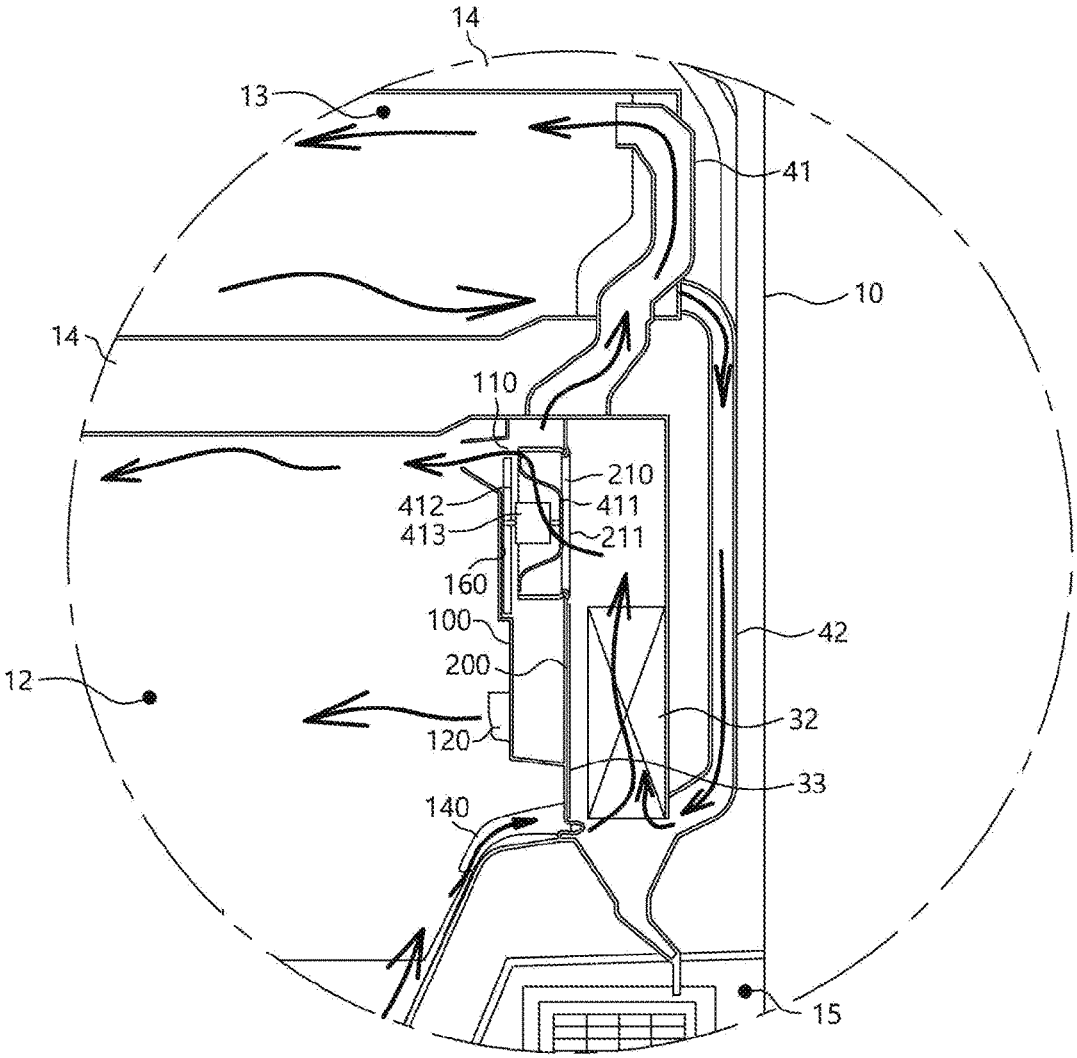
FIG. 49 is an enlarged view of the part "H" of FIG. 48.
Figure 50:
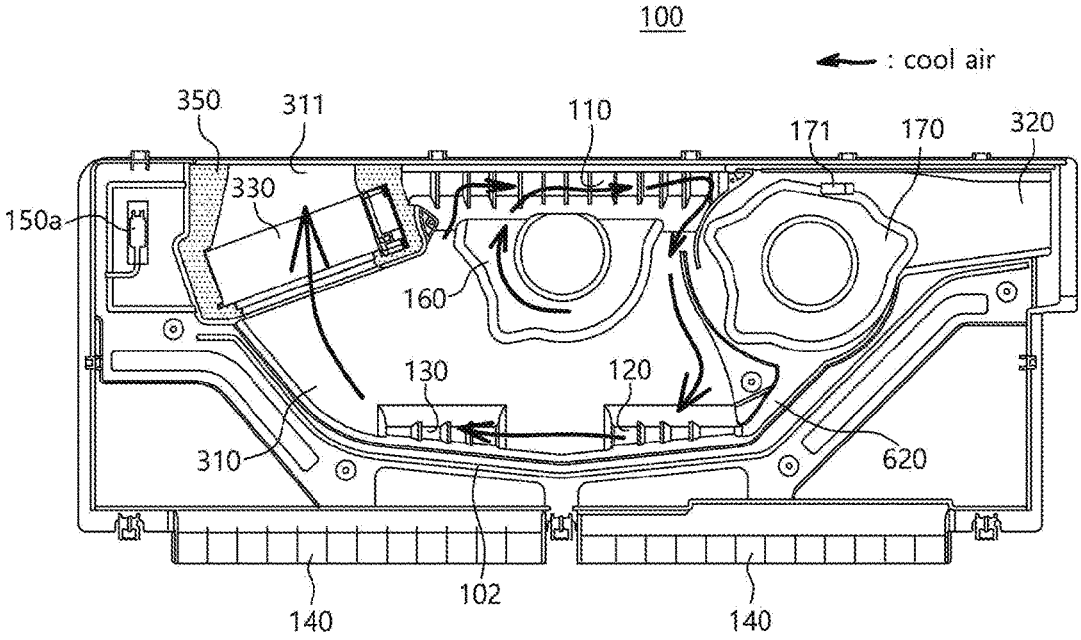
FIG. 50 is a state view showing an example of cool air flow in the grille panel assembly in the freezing operation for the switch compartment of the refrigerator.
Figure 51:
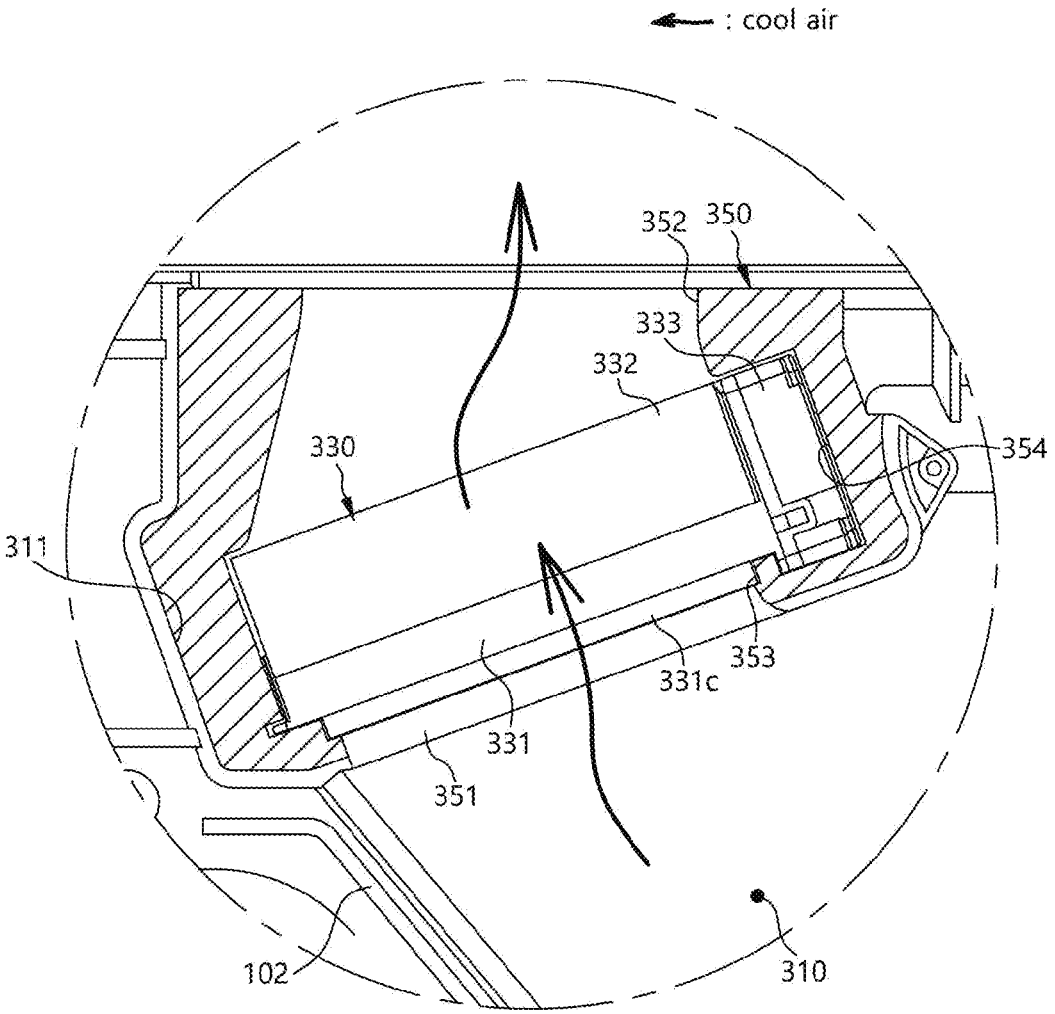
FIG. 51 is a state view showing the channel opening/closing module in the freezing operation for the switch compartment of the refrigerator.

FIG. 48 is a side cross-sectional view showing the flow of cool air in a freezing operation for the switch compartment of the refrigerator, FIG. 49 is an enlarged view of the part "H" of FIG. 48, FIG. 50 is a state view showing cool air flow in the grille panel assembly in the freezing operation for the switch compartment of the refrigerator, and FIG. 51 is a state view of main part showing the state of the channel opening/closing module in the freezing operation of the switch compartment.

As shown in FIG. 47, the switch compartment operation (S200) may be performed by the operations of the freezing fan module 410 and the compressor and the operation of the channel opening/closing module 330.

That is, when whether there is a request for the switch compartment operation (S200) is checked (S120) and then when there is a request for the switch compartment operation (S200), the controller may rotate the freezing fan 411 by supplying power to the freezing fan module 410 and may operate the compressor such that the second evaporator performs heat exchange.

Further, the controller may control the damper actuator 333 of the channel opening/closing module 330 such that the opening/closing damper 332 opens the through-hole 331*a* of the damper case 331 (S220).

Accordingly, air flowing to the second evaporator 32 from the freezing compartment 12 by the blowing force of the freezing fan 411 may exchange heat through the second evaporator 32. The air (cool air) that has exchanged heat may keep flow through the first intake hole 210 of the shroud 200 and then may flow into the first cool air guide channel 310 between the grille panel 100 and the shroud 200.

Thereafter, the cool air may flow through the first cool air guide channel 310 and may be supplied to the top in the freezing compartment 12 through the upper cool air discharge port 110 formed in the grille panel 100.

In the cool air flowing by the blowing force of the freezing fan 411, the other cool air not discharged to the upper cool air discharge port 110 may flow through the first cool air guide channel 310.

A portion of the cool air flowing through the first cool air guide channel 310 may be supplied to the middle portion in the freezing compartment 12 sequentially through the first lower cool air discharge port 120 and the second lower cool air discharge port 130 formed in the first cool air guide channel 310. The other cool air may be supplied to the switch compartment 13 through the switch compartment cool air duct 41 connected to the cool air outlet end of the first cool air guide channel 310 after passing through the through-hole 331*a* of the damper case 331 positioned at the mounting stage 311 of the first cool air guide channel 310.

The cool air discharged to the upper cool air discharge port 110 through the first intake hole 210 may be discharged a little in comparison to the state in which the first cool air guide channel 310 is closed, and the cool air discharged to the first lower cool air discharge port 120 and the second lower cool air discharge port 130 may be discharge less than the cool air supplied to the switch compartment 13. Accordingly, cool air may be sufficiently supplied to the switch compartment 13.

When cool air is supplied to the switch compartment 13, the ice making fan 421 may also be controlled to rotate.

That is, a portion of the cool air flowing in the second cool air guide channel 320 through the second intake hole 220 by the operation of the ice making fan 421 may be supplied to the first cool air guide channel 310 through the first communicating channel 610 and the second communicating channel 620. Accordingly, more cool air may be supplied to the switch compartment 13 due to the cool air additionally supplied to the first cool air guide channel 310, whereby quick temperature control may be possible.

The cool air supplied into the switch compartment 13 in this process may flow in the switch compartment 13 and then may be guided to return to the air intake side of the second evaporator 32 by the switch compartment return duct 42 connected to the switch compartment 13.

Since the switch compartment cool air duct 41 may be connected to the upper portion of the rear wall of the switch compartment 13 and the switch compartment return duct 42 may be connected to the lower portion of the rear wall of the switch compartment 13, the air flowing into the switch compartment 13 may be discharged through the switch compartment return duct 42 after sufficiently flowing in the switch compartment 13.

The temperature inside the switch compartment 13 may be performed using a switch compartment temperature sensor. The switch compartment temperature sensor may be positioned to be exposed to the inside of the switch compartment 13 and may be configured to sense the temperature inside the switch compartment 13.

Accordingly, the temperature in the switch compartment 13 may be controlled by repeated circulation of the air (cool air).

When a switch compartment operation end condition is satisfied by repetition of the process, the damper actuator 333 of the channel opening/closing module 330 may be controlled such that the opening/closing damper 332 closes the through-hole 331*a* of the damper case 331.

Accordingly, the switch compartment operation (S200) is finished.

Next, an operation (ice making operation) for temperature control of the ice making compartment 21 is described with reference to FIGS. 52 to 56.

Figure 52:
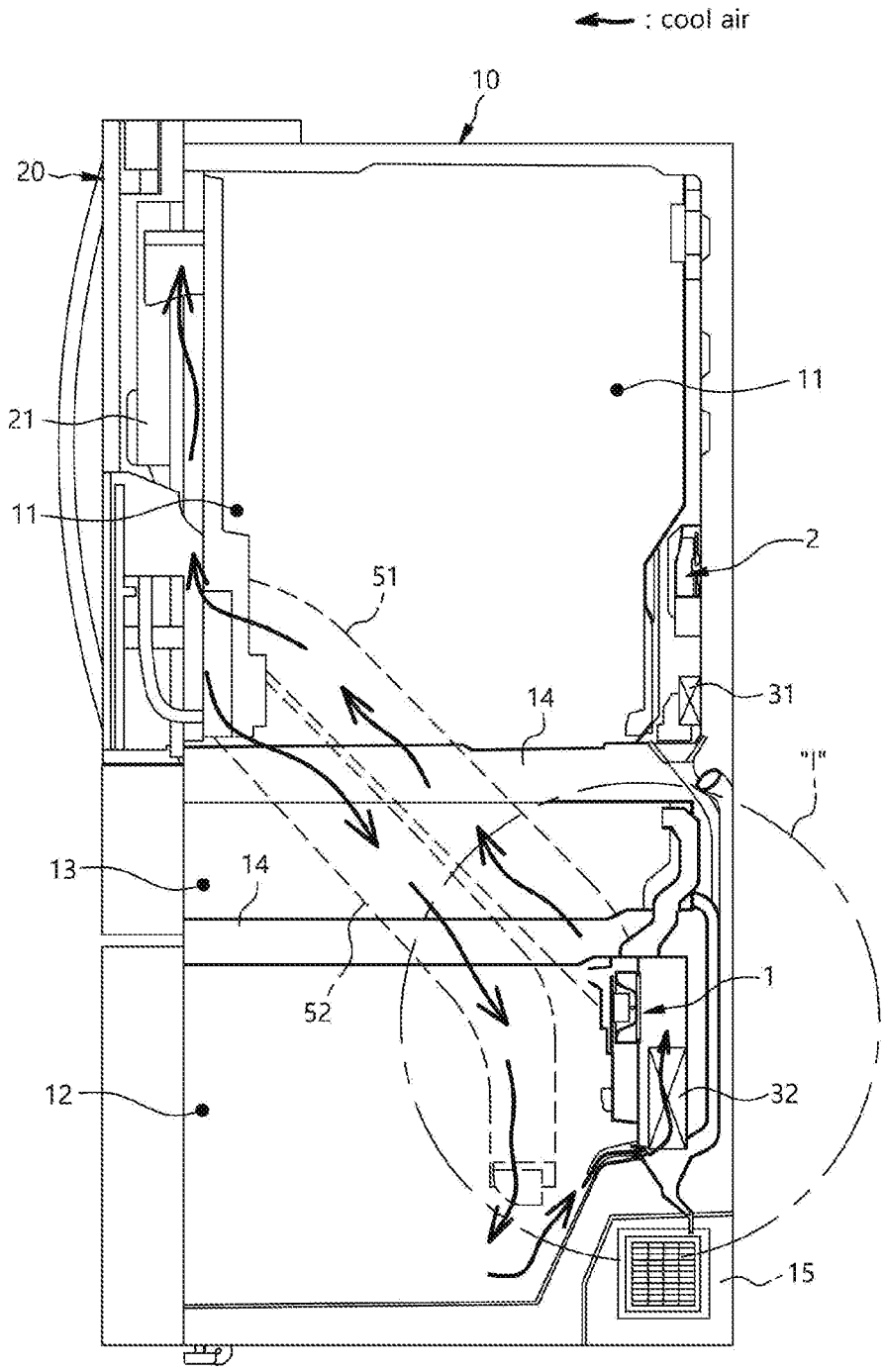
FIG. 52 is a side cross-sectional view showing an example of flow of cool air in the ice making operation for the switch compartment of the refrigerator.
Figure 53:
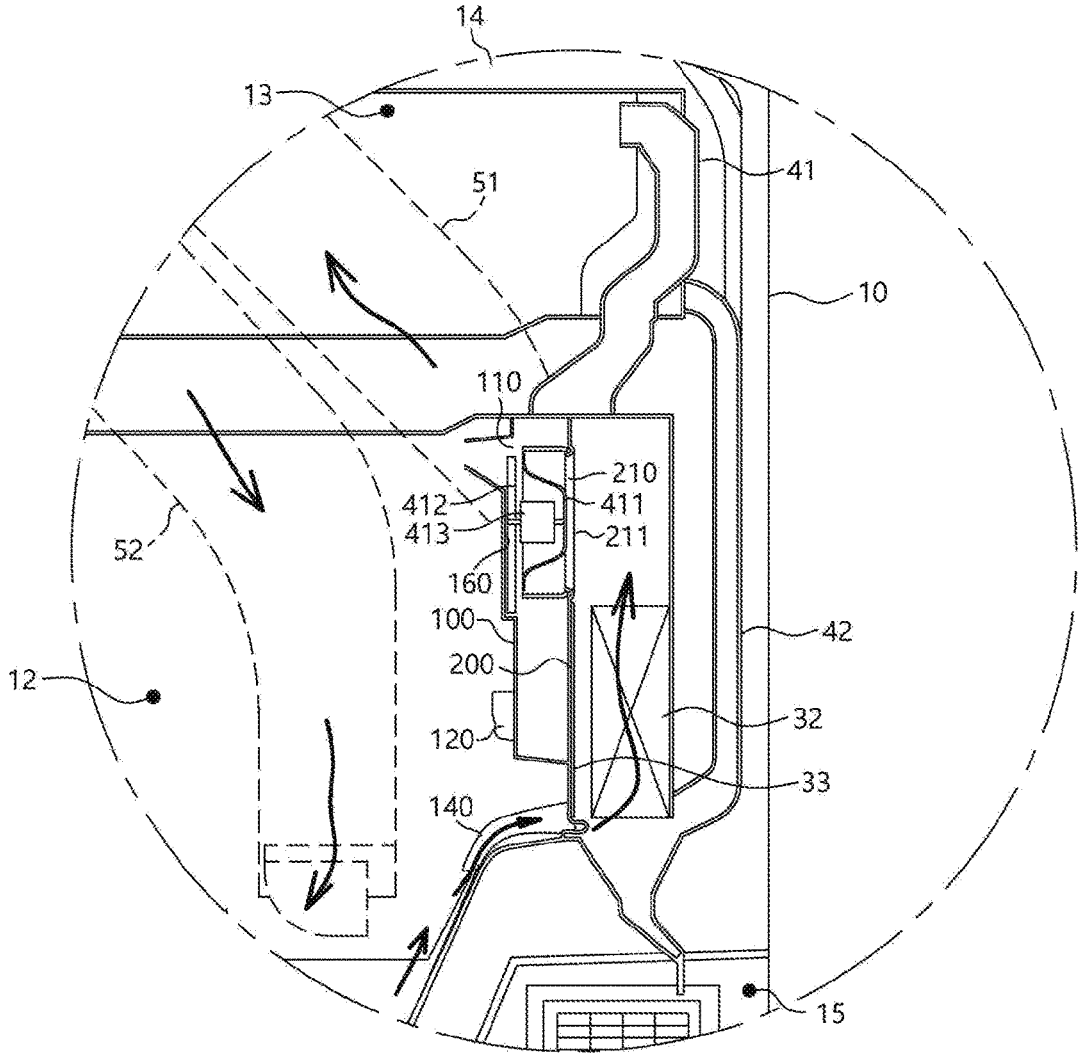
FIG. 53 is an enlarged view of the part "I" of FIG. 52.
Figure 54:
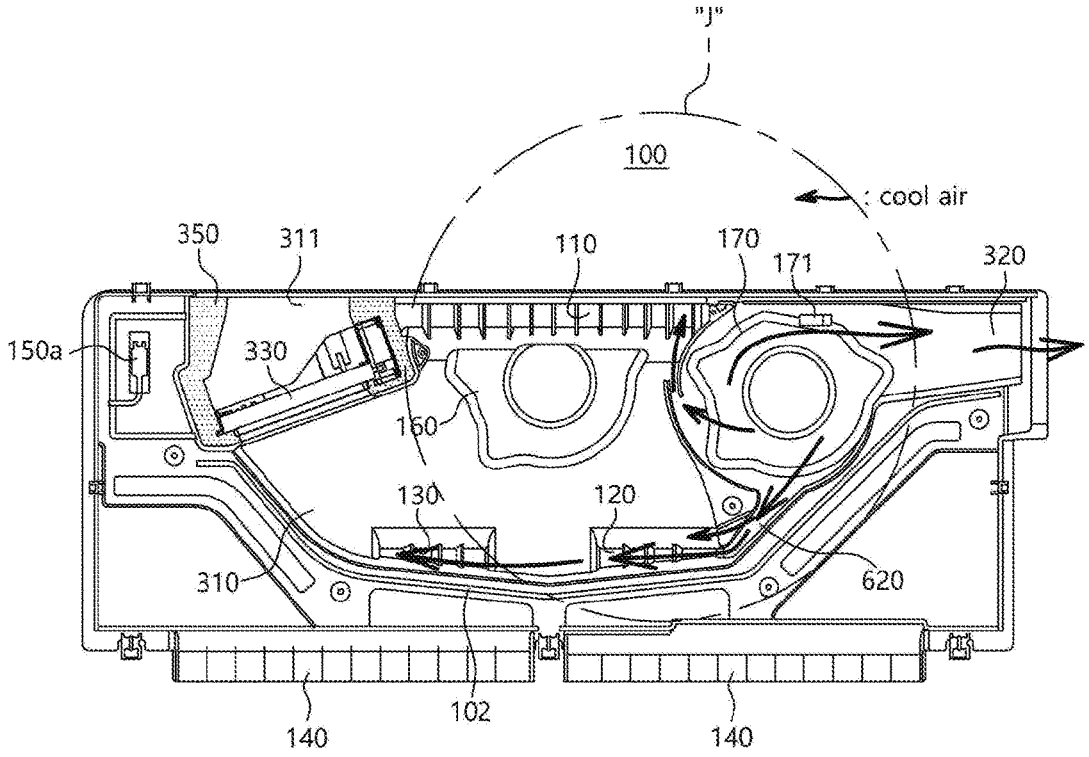
FIG. 54 is a state view showing an example of cool air flow in the grille panel assembly in the ice making operation of the refrigerator.
Figure 55:
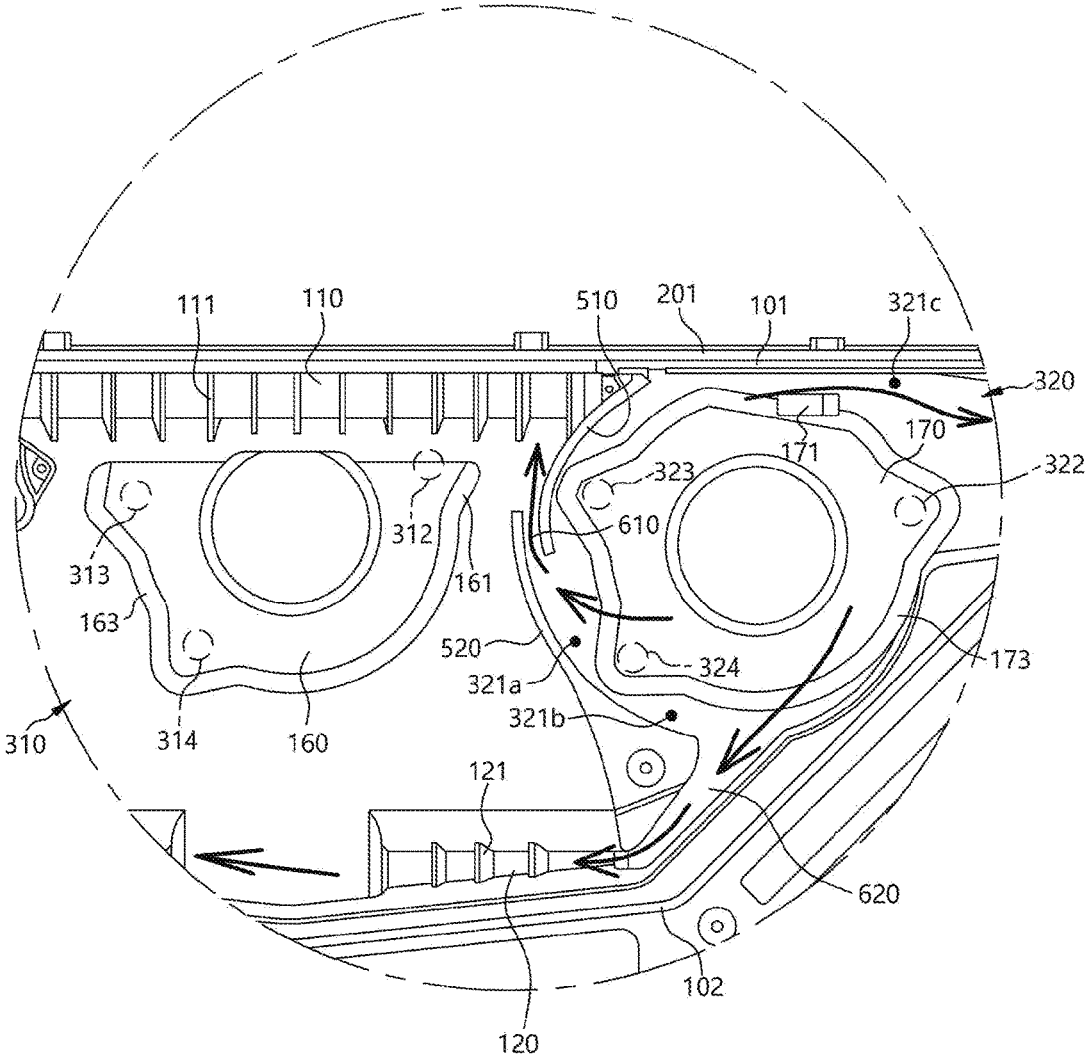
FIG. 55 is an enlarged view of the part "J" of FIG. 54.
Figure 56:
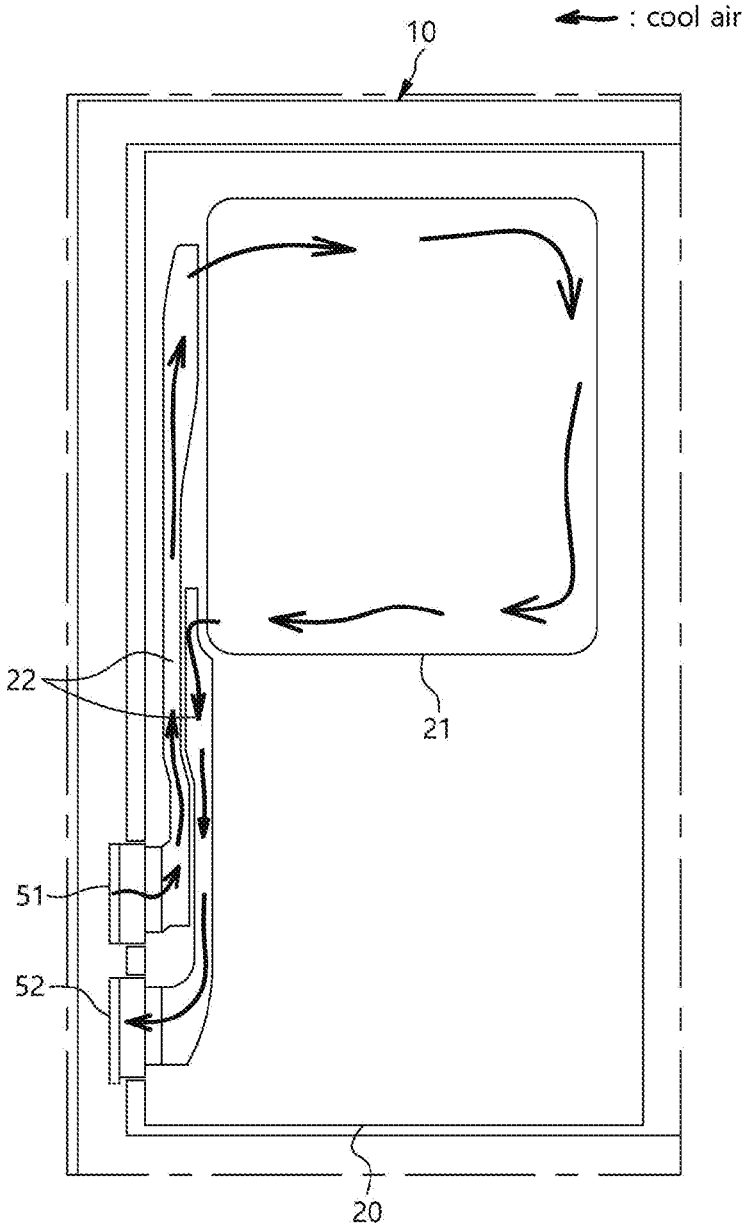
FIG. 56 is a state view showing an example of flow of cool air supplied and returned to the ice making compartment in the ice making operation of the refrigerator.

FIG. 52 is a side cross-sectional view showing the flow of cool air in an ice making operation for the switch compartment of the refrigerator, FIG. 53 is an enlarged view of the part "I" of FIG. 52, FIG. 54 is a state view showing cool air flow in the grille panel assembly in the ice making operation of the refrigerator, FIG. 55 is an enlarged view of the part "J" of FIG. 54, FIG. 56 is a state view showing the flow of cool air supplied and returned to the ice making compartment in the ice making operation of the refrigerator.

Temperature control of the ice making compartment 21 may be performed by the operation of the ice making fan 421 when power is supplied to the ice making fan module 420. In this case, the compressor may be operated or stopped, depending on the operation condition of the freezing compartment 12.

When the ice making fan 421 is operated, the cool air in the freezing compartment 12 may exchange heat through the second evaporator 32 and may keep flow into the first region 321*a*, the second region 321*b*, and the third region 321*c* of the second cool air guide channel 320 through the second intake hole 220 of the shroud 200.

The cool air may be discharged from the second cool air guide channel 320 through the portion communicating with the regions 321*a*, 321*b*, and 321*c*.

The cool air flowing in the first region 321*a* by the operation of the ice making fan 421 may be supplied to the upper space in the first cool air guide channel 310 through the first communicating channel 610, the cool air blown to the second region 321*b* may be supplied to the lower space in the first cool air guide channel 310 through the second communicating channel 620, and the cool air blown to the third region 321*c* may be supplied to the ice making compartment 21 after flowing to the ice making compartment cool air duct 51.

Figure 59:
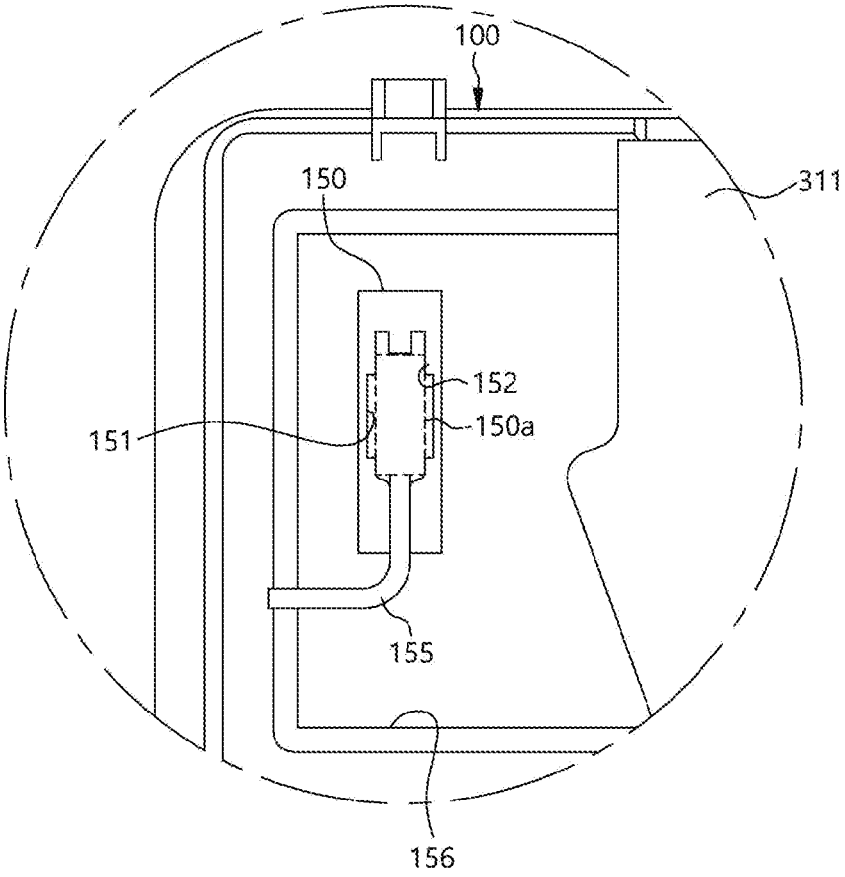
FIG. 59 is an enlarged view showing an example of the temperature sensor installed at the rear of a grille panel.
Figure 60:
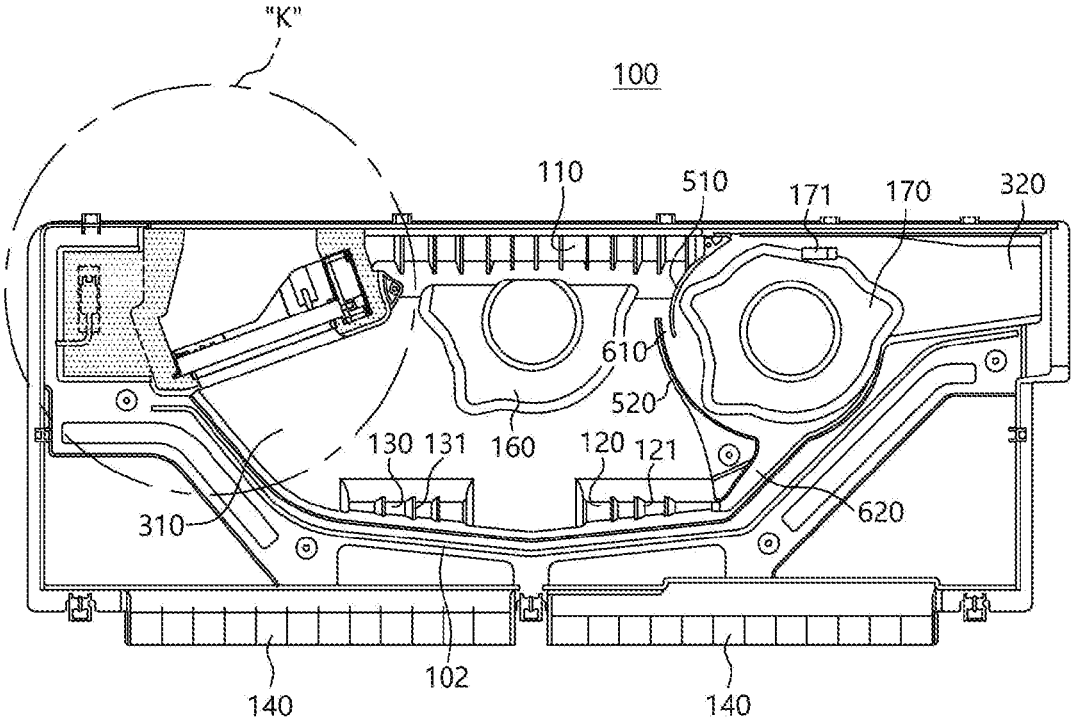
FIG. 60 is a state view showing an example structure for thermal insulation of the temperature sensor.
Figure 61:
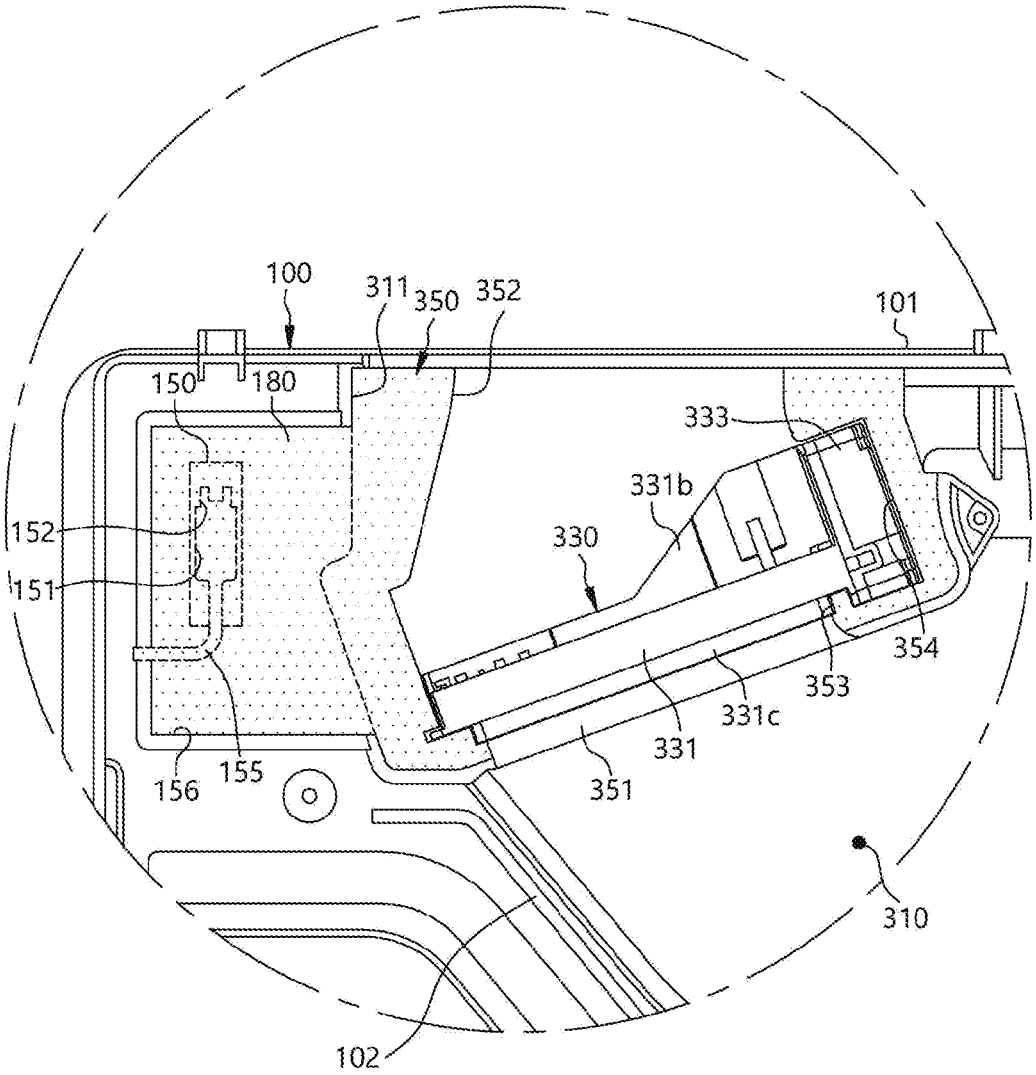
FIG. 61 is an enlarged view of the part "K" of FIG. 60.

The cool air supplied to the first cool air guide channel 310 through the first communicating channel 610 may be supplied to the freezing compartment 12 through the upper cool air discharge port 110 while being blown toward the upper cool air discharge port 110 in the first cool air guide channel 310, and the cool air supplied to the first cool air guide channel 310 through the second communicating channel 620 may be supplied to the first lower cool air discharge port 120 and the second lower cool air discharge port 130 while flowing on the bottom of the first cool air guide channel 310. This configuration is shown in FIGS. 59 and 60.

In particular, the ice making fan 421 may be positioned at any one end of the second cool air guide channel 320 and the ice making compartment cool air duct 51 may be connected to another end of the second cool air guide channel 320. Accordingly, the flow resistance of cool air that may be generated by adjacent arrangement of the cool air intake side and the cool air discharge side of the second cool air guide channel 320 may be very small, so cool air may smoothly flow up to the ice making compartment.

The cool air that has exchanged heat through the second evaporator 32 may flow backward through the second intake hole 220 by flow resistance when it is discharged in the discharge direction of the ice making fan 421 through the second intake hole 220.

However, since the second intake hole 220 may be configured such that the impellers 421*c* of the ice making fan 421 are covered (or covered half or more) by the covering member 222, the cool air discharged from the ice making fan 421 may not flow backward through the second intake hole 220. Further, the cool air has high blowing pressure in comparison to the cool air blown through the first intake hole 210 and the first cool air guide channel 310.

Since the ice making fan 421 may be controlled to rotate at a higher rotational speed than the freezing fan 411, the cool air blown by the ice making fan 421 may have higher blowing pressure.

In particular, the cool air discharged from the third region 321*c* may flow toward the second region 321*b* positioned in the rotational direction of the ice making fan 421. However, considering that the third region 321*c* and the second region 321*b* may be substantially separated from each other by the ice making fan module 420, the cool air discharged to the third region 321*c* all may be guided by the second cool air guide channel 320 to flow toward the cool air outlet end of the second cool air guide channel 320.

Accordingly, the cool air supplied to the ice making compartment 21 may be less than the cool air supplied to the freezing compartment 12, but may be smoothly and sufficiently forcibly sent up to the ice making compartment 21 by high blowing pressure.

The cool air supplied to the ice making compartment 21 may freeze the water (other drinks) in the ice tray while flowing in the ice making compartment 21. This configuration is shown in FIG. 55.

Thereafter, the cool air flowing in the ice making compartment 21 may be guided to return to the freezing compartment 12 by the ice making compartment return duct 52. This configuration is shown in FIGS. 52 and 53.

The cool air returned to the freezing compartment 12 may flow in the freezing compartment 12 and may be guided to return to the air intake side of the second evaporator 32 by the suction guide 140 formed in the grille panel 100.

If the temperature in the ice making compartment 21 is lower than a set temperature, the operation of the ice making fan 421 may be stopped and supply of the cool air to the ice making compartment 21 may be stopped.

Accordingly, the temperature in the ice making compartment 21 may be controlled by repeated circulation of the air (cool air).

In some examples, the cool air flowing in the regions of the second cool air guide channel 320 in the ice making operation may flow to another region by rotational flow due to the operation of the ice making fan 421.

However, since the regions 321*a*, 321*b*, and 321*c* may be substantially separated from each other by the portions where the fastening protrusions 322, 323, and 324 of the ice making fan module 420 are formed, there may be only fine flow of cool air between the regions 321*a*, 321*b*, and 321*c* and the regions may not largely influence the flow of cool air flowing to another region.

A portion of the cool air flowing to the ice making compartment cool air duct 51 through the second cool air guide channel 320 while the ice making operation is performed may provide intensive coldness to the ice maker 12*a* positioned in the freezing compartment 12 through the ice making outlet 171 and the discharge guide pipe 172.

In particular, the ice maker 12*a* may be positioned ahead of the ice making outlet 171 and the discharge guide pipe 172 may be positioned adjacent to the ice maker 12*a*.

Accordingly, since the ice produced in the ice maker 12*a* in the freezing compartment 12 may be produced by sufficient coldness, poor freezing in which the inside of ice remains hollow without being frozen may be prevented.

As a result, the refrigerator may use two fan modules 410 and 420 and may be configured to obtain a large amount of air or a high blowing pressure, depending on the uses of the fan modules 410 and 420, so a fan module may be shared.

Further, according to the refrigerator, by optimizing the installation positions of the fan modules 410 and 420 and the positions of the intake holes 210 and 220 for sending cool air into the fan modules 410 and 420, respectively, cool air may be sufficiently supplied into the freezing compartment 12 and cool air may also be supplied to the relatively far ice making compartment 21.

Further, according to the refrigerator, since the freezing fan module 410 and the ice making fan module 420 may be positioned at the upper portion of the grille panel assembly 1, and the first cool air guide channel 310 and the second cool air guide channel 320 may be formed on the basis of the positions of the freezing fan module 410 and the ice making fan module 420, the vertical height of the entire grille panel assembly 1 may be reduced.

Further, since the refrigerator may be configured such that cool air is supplied to each position through a plurality of regions 321*a*, 321*b*, and 321*c* separately formed in the second cool air guide channel 320, cool air may be prevented from being supplied to the machine room even if cool air flows backward from the first cool air guide channel 310.

Further, since the refrigerator may be configured such that a portion of the cool air supplied to the ice making compartment 21 is continuously sprayed to the ice maker 12*a* in the freezing compartment 12 through the ice making outlet 171, ice may be sufficiently frozen in the ice maker 12*a*.

The refrigerator may not be limited only to the structure of the above implementation.

That is, the grille panel assembly of the refrigerator may be implemented in other various structures different from the above implementation.

These are described in more detail for each implementation.

First, FIGS. 57 to 61 show a grille panel assembly of a refrigerator according to a second implementation.

Figure 57:
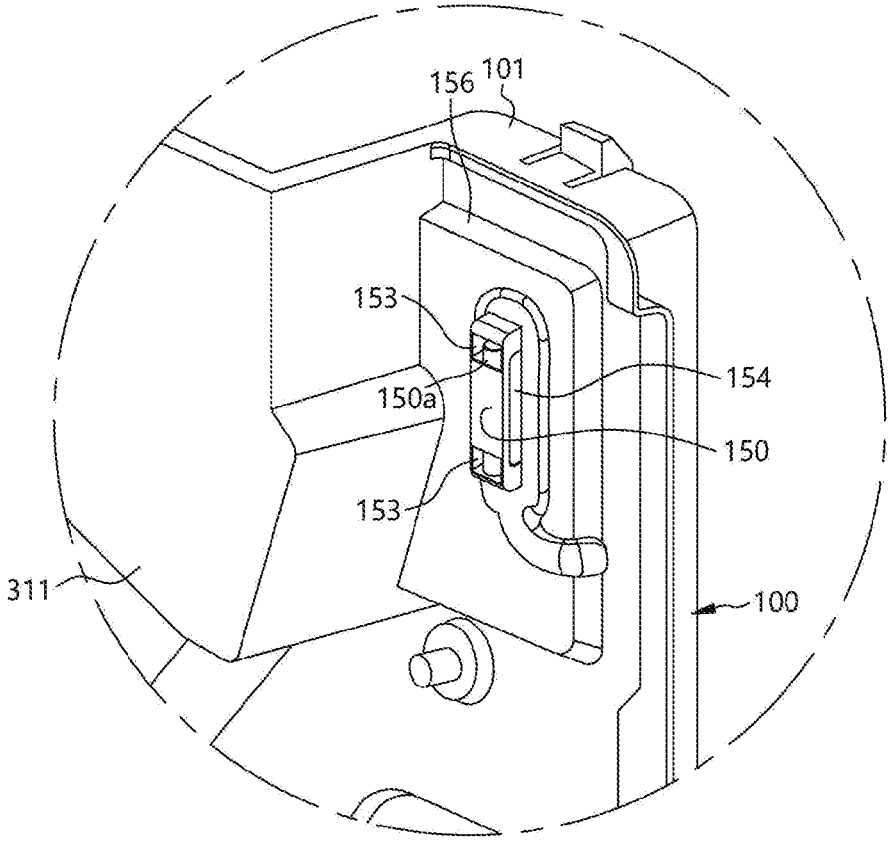
FIG. 57 is a perspective view showing an example of a temperature sensor installed in an example refrigerator.
Figure 58:
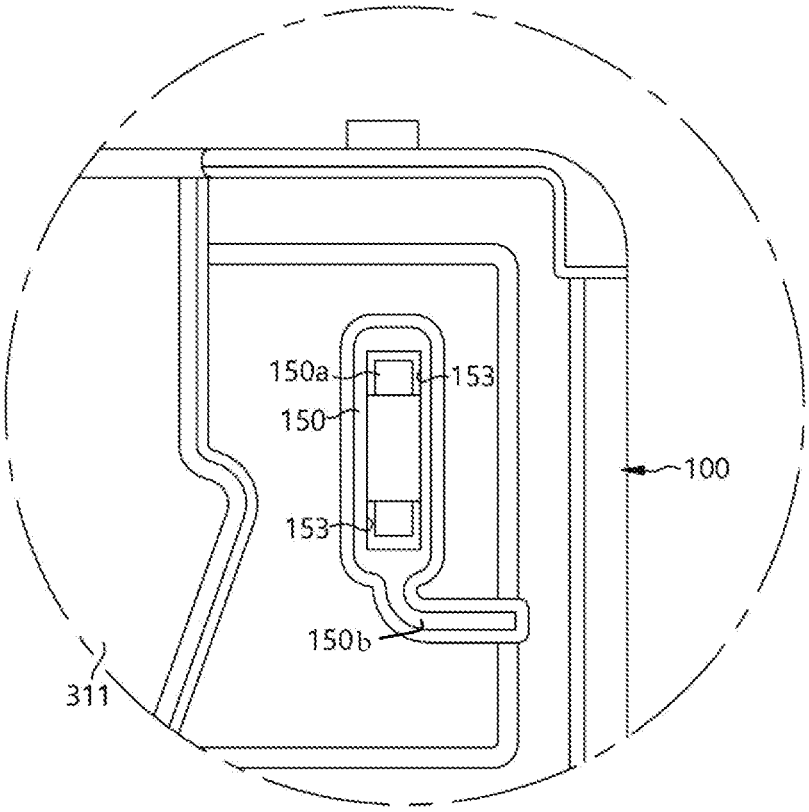
FIG. 58 is an enlarged view showing an example of the temperature sensor installed at the front of a grille panel.

FIG. 57 is a perspective view of main parts showing the state in which a temperature sensor is installed in a refrigerator according to a second implementation, FIG. 58 is an enlarged view of main parts showing the state in which the temperature sensor is installed from the front of a grille panel, and FIG. 59 is an enlarged view of main parts showing the state in which the temperature sensor is installed from the rear of a grille panel.

The grille panel assembly may have a structure that enables a temperature sensor 150*a* to be stably mounted without being influenced by a surrounding second evaporator 32 or accumulator 32*c*.

That is, the temperature sensor 150*a* may be mounted on a mount 150 while being thermally insulated from the second evaporator 32 or the accumulator 32*c* by an insulator 180.

More detailed description is as follows.

First, the mount 150 is formed at the grille panel 100.

The mount 150 may be formed at a side of a mounting stage 311 where the channel opening/closing module 330 is formed of portions of the grille panel 100.

That is, by positioning the mount 150 at the same height as the mounting stage 311, the temperature sensor 150*a* installed on the mount 150 may be maximally spaced apart from the second evaporator 32.

In some examples, a heat blocking plate 33 (see FIG. 5) may be disposed on the front of the second evaporator 32, so an error in measurement of the temperature sensor 150*a* due to the evaporator 32 may be minimized.

The mount 150 may further protrude from the front of the grille panel 100 and may have a mounting groove 151 recessed on the rear thereof. The temperature sensor 150*a* may be accommodated in the mounting groove 151.

A holding stage 152 for retaining the temperature sensor 150*a* may be formed in the mounting groove 151. That is, the temperature sensor 150*a* may be held and fixed to the holding stage 152.

The holding stage 152 may protrude inward from at least any one wall in the mounting groove 151. That is, the holding stage 152 may hold at least any one side of the temperature sensor 150*a* so the temperature sensor 150*a* may be stably fixed in the mounting groove 151.

The holding stage 152 may be formed as two or more pieces, may be formed only any one wall in the mounting groove 151, or may be formed in a plurality of pairs.

Exposing holes 153 and 154 may be formed in the mount 150. That is, the temperature sensor 150*a* in the mounting groove 151 may be exposed to the freezing compartment 12 though the exposing holes 153 and 154. The exposing holes 153 and 154 may be formed as two or more pieces, as shown in FIGS. 57 and 58.

The exposing holes 153 and 154 may include a front exposing hole 153 formed through the front of the mount 150. That is, by forming the front exposing hole 153, the temperature sensor 150*a* may be exposed into the freezing compartment 12 and may accurately sense the temperature of cool air in the freezing compartment 12.

The exposing holes 154 and 154 may include a side exposing hole 154 formed through both sides of the mount 150. That is, by additionally forming the side exposing hole 154, the temperature sensor 150*a* in the mount 150 may accurately recognize the temperature of cool air horizontally flowing in the freezing compartment 12.

A wire accommodation groove 155 (see FIG. 59) may be formed in the mount 150.

The wire accommodation groove 155 may be a groove formed to accommodate a power line 150*b* of the temperature sensor 150*a*. That is, the power line 150*b* may be accommodated and fixed in the wire accommodation groove 155, thereby preventing disconnection from the temperature sensor 150*a* that may be caused by unexpected movement of the power line 150*b*.

The wire accommodation groove 155 may extend downward from the bottom of the mounting groove 151 and then may bend to any one side, whereby disconnection of the power line 150*b* from the temperature sensor 150*a* may be prevented and the power line 150*b* may be easily drawn out.

Next, the grille panel 100 may have the insulator 180.

The insulator 180 may protect the temperature sensor 150*a* installed on the grille panel 100 and may thermally insulate the portion where the temperature sensor 150*a* is installed from the shroud 200.

That is, since the temperature sensor 150*a* is embedded in the mounting groove 151, the temperature sensor 150*a* may be exposed rearward through the open portion of the mounting groove 151. In some examples, the rear of the grille panel 100 may be covered when the shroud 200 to be described below is combined. However, when low-temperature heat generated by the second evaporator 32 positioned behind the shroud 200 transfers to the shroud 200 and the temperature sensor 150*a* is influenced by the low-temperature heat, poor sensing that determines wrong the temperature of the freezing compartment 12 may occur.

In particular, the temperature sensor 150*a* may be positioned over the second evaporator 32, but the accumulator 32*c* may be positioned at a position corresponding to the position of the temperature sensor 150*a* (see FIG. 15) and the accumulator 32*c* may be lower in temperature than that of the freezing compartment 12. Accordingly, the temperature sensor 150*a* may generate an error when sensing the temperature of the freezing compartment 12 due to the accumulator 32*c*.

Considering this problem, even if low-temperature heat transfers from the second evaporator 32 to the shroud 200, the low-temperature heat may be blocked to the temperature sensor 150*a* by the insulator 180 and the low-temperature heat from the accumulator 32*c* may be blocked to the temperature sensor 150*a*, whereby the temperature of the freezing compartment 12 may be more accurately sensed.

The insulator 180 may be a plate covering the portion where the mounting groove 151 is formed on the rear of the grille panel 100.

In particular, the insulator 180 may have a larger width than the mounting groove 151. Accordingly, heat transfer to the surrounding of the temperature sensor 150*a* may be reduced, whereby the reliability of the sensing value by the temperature sensor 150*a* may be improved.

Figure 65:
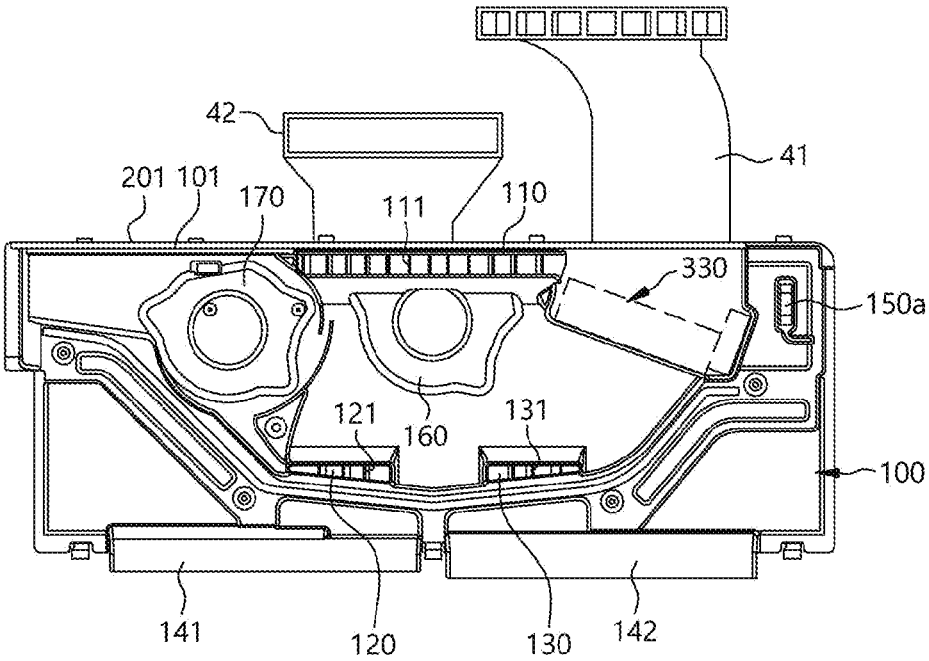
FIG. 65 is a front view showing an example of a suction guide of the refrigerator.
Figure 66:
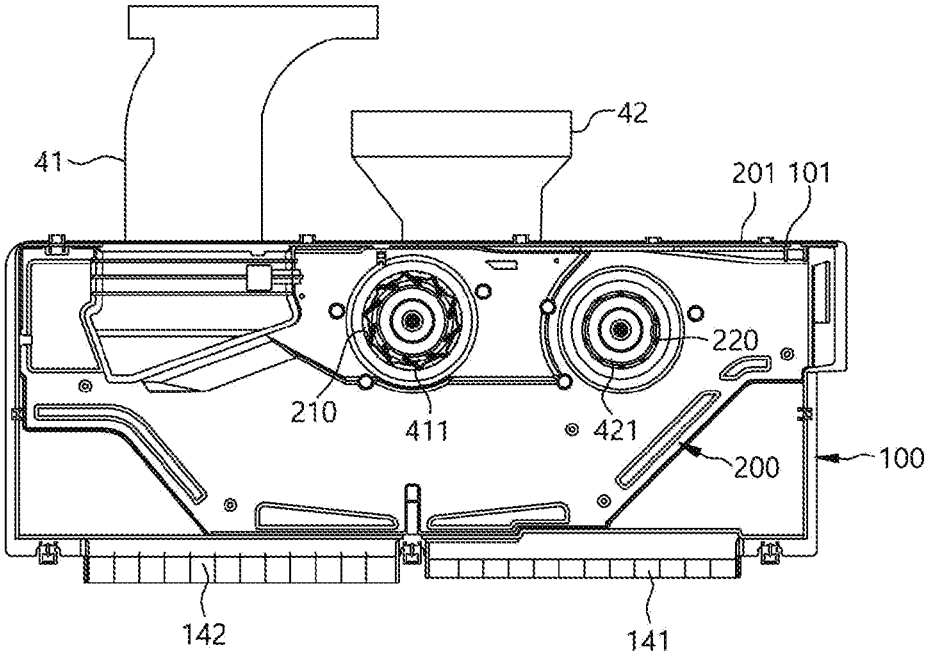
FIG. 66 is a rear view showing the suction guide of the refrigerator.

The insulator 180 may be integrated with the damper cover 350. This configuration is shown in FIGS. 65 and 66. That is, the damper cover 350 may be installed on the grille panel 100 or the shroud 200, whereby the insulator 180 may cover the mounting groove 151.

The insulator 180 may be made of the same insulating material as the damper cover 350 (Styrofoam, rubber, silicon, or foaming rubber).

If the damper cover 350 is divided forward and rearward, the insulator 180 may be integrated with the front damper cover installed at the grille panel 100 or may be integrated with the rear damper cover installed at the shroud 200.

However, considering that the mounting groove 151 in which the temperature sensor 150*a* is mounted may be formed at the grille panel 100, the insulator 180 may be integrated with the front damper cover mounted at the grille panel 100.

In particular, the insulator 180 may protrude from a side of the damper cover 350.

That is, the insulator 180 may extend toward a side from the damper cover 350, whereby the insulator 180 may easily cover the mounting groove 151 of the mount 150 positioned in parallel with the mounting stage 311.

An insulator accommodation groove 156 for accommodating the insulator 180 may be formed at the portion where the mounting groove 151 is formed on the rear of the grille panel 100.

That is, the insulator accommodation groove 156 may be additionally formed to accommodate the insulator 180, whereby the insulator 180 may be easily installed in position.

In some examples, the insulator 180 may be separately provided from the damper cover 350 and may be configured to protect the temperature sensor 150*a*. However, if the insulator 180 is separately provided from the damper cover 350, a separate structure may be provided for fixing the insulator at a specific position until the grille panel 100 and the shroud 200 are completely assembled, and there may be a need for work for the separate structure.

Considering this, since the insulator 180 may be integrated with the damper cover 350, it may be possible to prevent an increase in manufacturing cost and inconvenience for assembly due to separate manufacturing of the insulator 180.

As described above, according to the refrigerator of the second implementation, a temperature sensing error due to the second evaporator 32 and the accumulator 32*c* may be prevented by the insulator 180 covering the temperature sensor 150*a*, whereby it may be possible to accurately control the temperature of the freezing compartment 12.

In particular, according to the refrigerator of the second implementation, since the insulator 180 may be integrated with the damper cover 350, manufacturing may be easy and assembly may be easy.

Figure 62:
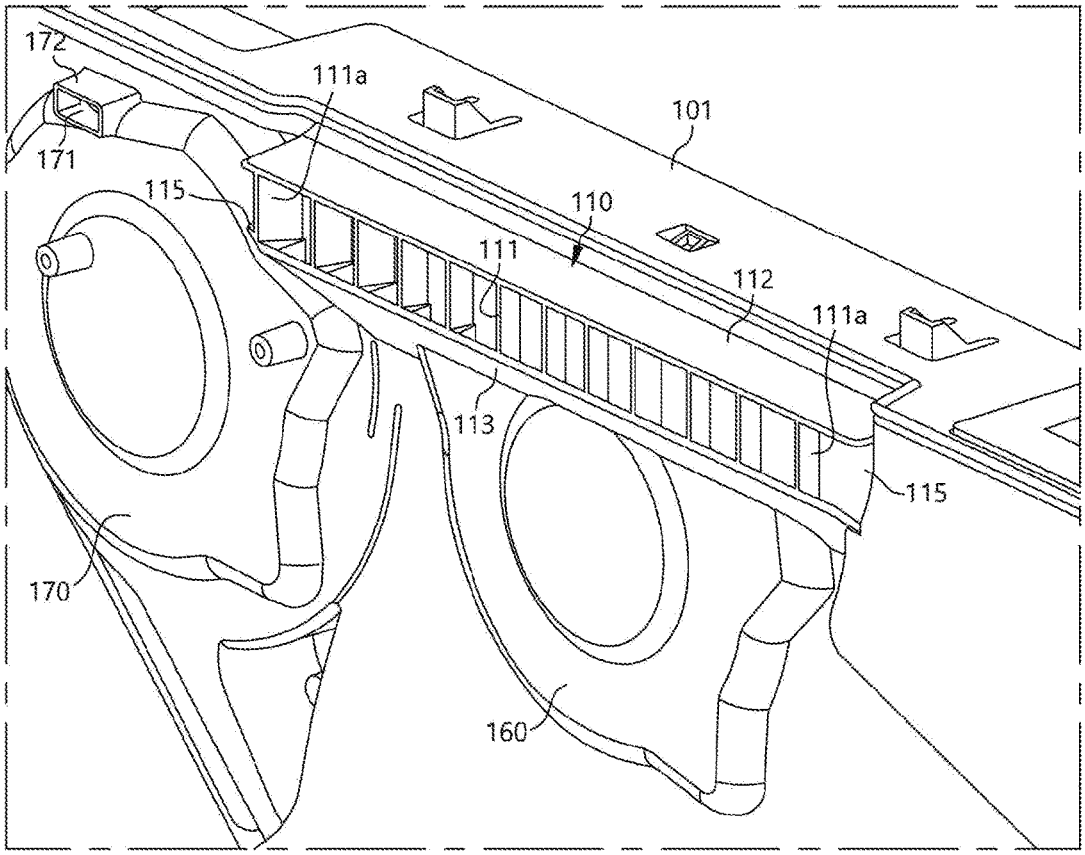
FIGS. 62 and 63 are state views showing examples of an upper cool air discharge port of an example refrigerator.
Figure 63:
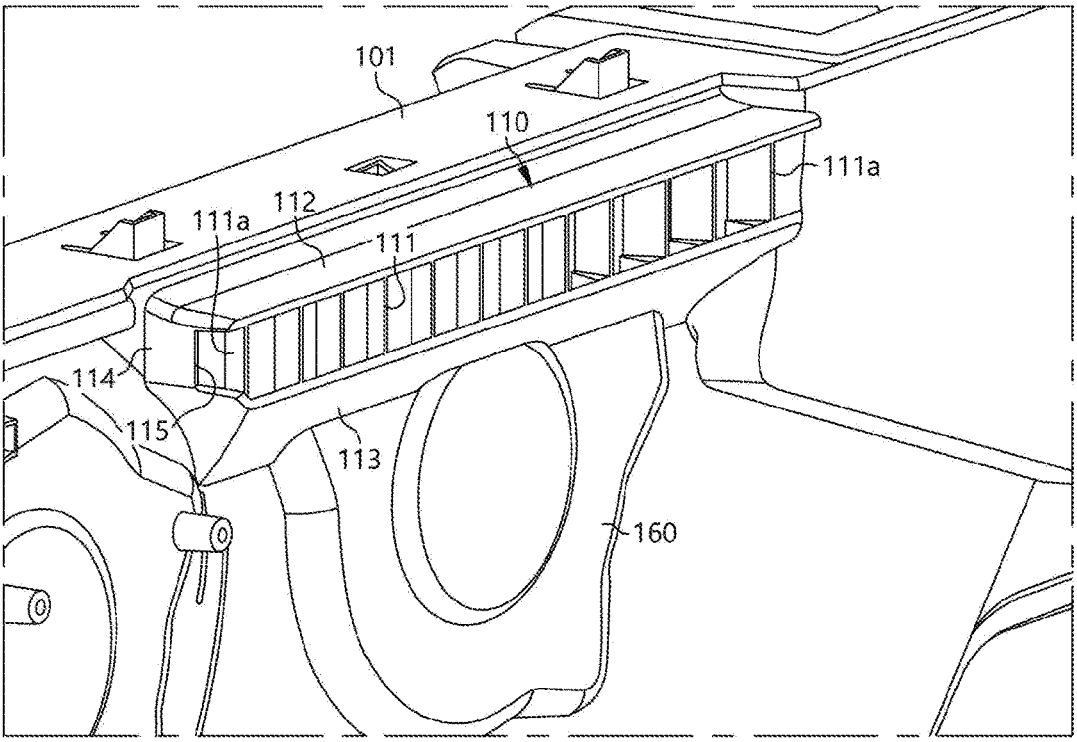

Next, FIGS. 62 and 63 show a grille panel assembly of a refrigerator according to a third implementation.

It may be exemplified that the grille panel assembly of the refrigerator may further has cuts 115*a* formed at two side walls 114 of the upper cool air discharge port 110.

That is, cool air may be discharged from both sides of the upper cool air discharge port 110, whereby even if the left-right length of the upper cool air discharge port 110 is smaller than the left-right width of the freezing compartment 12, cool air may be sufficiently supplied to the rears of both walls in the freezing compartment 12 (adjacent to the grille panel assembly).

The cuts 115 may be formed only at portions of the side walls 114. That is, when the cuts are formed such that the side walls 114 are excessively open (or the side walls are removed), cool air may be directly discharged without being guided by the grille rib at the most end (end grille rib) 111*a*, so the flow speed may rapidly decrease, whereby cool air may not be sufficiently 10 supplied even to the side walls in the freezing compartment 12.

In some cases, when the cuts 115 are excessively large, supporting by the top wall 112 and the bottom wall 113 is unstable, so shaking or damage may occur.

Considering this, the cuts 115 may be formed only at portions of the side walls 114 such that cool air passing through the cuts 115 is guided by the grille ribs 111.

The end grille ribs 111*a* most adjacent to the side walls 114 of the grille ribs 111 may be inclined at an angle such that cool air guided by them may flow toward the cuts 115.

The cuts 115 may be formed to the open front of the upper cool air discharge port 110. That is, the cool air flowing in the upper cool air discharge port 110 may be discharged through the cuts 115 after flowing along the side walls 114 of the upper cool air discharge port 110.

In particular, the cuts 115 may be open to a distance such that the end grille ribs 111*a* may be fully exposed when seen from a side.

That is, the open length of the cuts 115 is optimized such that the cool air guided to the end grille ribs 111*a* may be smoothly discharged without interference by the side walls 114.

In some examples, the side walls 114 of the upper cool air discharge port 110 may be formed to have a length such that it may guide cool air to the end grille ribs 111*a*.

The inclination angle of the end grille ribs 111*a* may be determined in consideration of the left-right length of the upper cool air discharge port, the positions of the end grille ribs 111*a*, the supply position of cool air, etc.

Considering that the upper cool air discharge port 110 may be a tube protruding forward, the cool air rotating in the circumferential direction of the freezing fan module 410 may be guided to be discharged forward by the upper cool air discharge port 110.

Accordingly, the cool air guided by the end grille ribs 111*a* of the cool air passing through the grille ribs 111 of the upper cool air discharge port 110 may be supplied to both side walls in the freezing compartment 12 through the cuts 115, so cool air may be smoothly supplied to both side wall in the freezing compartment 12 in comparison to a structure without the cuts 115.

When there are the cuts 115, and the ice maker 12*a* is positioned at the right side, cool air may be sufficiently supplied to the sides of the ice maker 12*a*.

As a result, according to the refrigerator of the third implementation, the cuts 115 may be formed at the side walls 114 of the upper cool air discharge port 110 and cool air passing through the cuts 115 may be guided by the end grille ribs 111*a* to be smoothly supplied to both side walls in the freezing compartment 12.

According to the refrigerator of the third implementation, since the grille ribs 111 formed a the upper cool air discharge port 110 may be disposed at an angle considering the flow of cool air flowing in the circumferential direction of the freezing fan module 410, flow resistance of cool air passing through the upper cool air discharge port 110 may be reduced, whereby cool air may be uniformly supplied throughout the inside of the freezing compartment 12.

Figure 64:
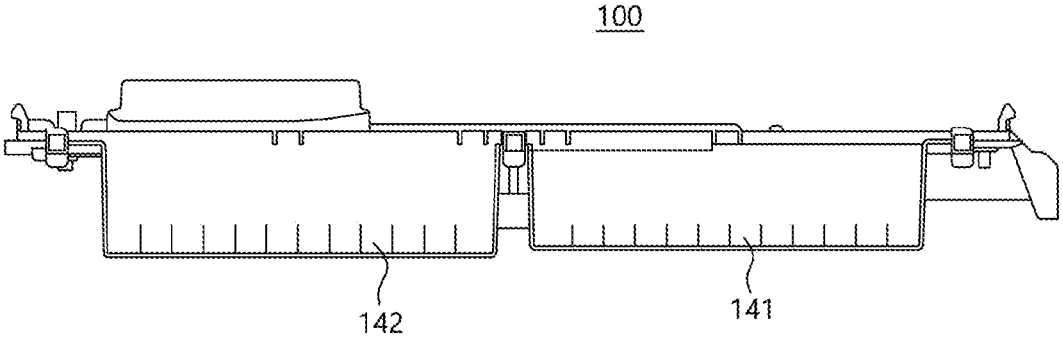
FIG. 64 is a bottom view of an example of a grille panel assembly of an example refrigerator.

Next, FIGS. 64 to 66 show a grille panel assembly of a refrigerator according to a fourth implementation.

According to the refrigerator of the fourth implementation, the suction guides 141 and 142 may be positioned at both sides with respect to the center of the grille panel 100 and may have different sizes.

That is, considering that two fan modules 410 and 420 may be provided to the grille panel assembly 1 and the ice making fan module 420 of the two fan modules 410 and 420 may be positioned close to any one side of the grille panel 100, the pressure distribution when the two fan modules 410 and 420 are simultaneously operated is made such that larger negative pressure may be generated at the side where the ice making fan module 420 is positioned.

Accordingly, when the two fan modules 410 and 420 are simultaneously operated, non-uniform flow in which cool air flows much more toward the side where the ice making fan module 420 is positioned than the opposite side may occur. Further, the air guided to pass through the second evaporator 32 by the two suction guides 141 and 142 may be biased to any one side of the second evaporator 32, so the evaporation performance of the second evaporator 32 may be deteriorated.

Considering this, the suction guide (second suction guide) at the opposite side may be formed larger than the suction guide (first suction guide) at the side where the ice making fan module 420 is formed. This configuration is shown in FIGS. 56 and 57.

That is, the second suction guide 142 may receive much cool air than the first suction guide 141, so even if the two fan modules 410 and 420 are simultaneously operated, cool air may uniformly flow into the entire second evaporator 32.

The size of the first suction guide 141 may be designed on the basis of the intake amount of cool air when only the freezing fan module 410 is independently operated, and the second suction guide 142 may be designed in a larger size than the first suction guide 141.

As described above, according to the refrigerator of the fourth implementation, since the sizes of the two suction guides 141 and 142 may be different, even if a plurality of fan modules 410 and 420 are provided and simultaneously operated, cool air returning to the second evaporator 32 from the freezing compartment 12 may not be biased to any one side of the second evaporator 32 (the side where the ice making fan module is positioned) and may smoothly exchange heat without deteriorating the evaporation performance while uniformly passing through the entire second evaporator 32.

Not only a refrigerator according to the present disclosure may have the various implementations of the structure described above, but various implementations of the operation control method may be provided.

For example, the ice making operation of the operation control method of the refrigerator according to the present disclosure may be performed in various ways, depending on the normal situation and the full-ice situation. That is, the ice making compartment 21 may be controlled in accordance with each situation.

In the operation control method according to another implementation, the ice making operation (S300) may include an ice making mode operation (S310) and a full-ice mode operation (S320).

The operation for each mode in the ice making operation (S300) is described in more detail with reference to the flowchart of FIG. 67.

First, the ice making mode operation (S310), which is an operation that may be performed for making ice, may be performed when it corresponds to a performing condition of the ice making operation. That is, when the performing condition of the ice making operation is satisfied by checking the performing condition of the ice making operation (S301), the ice making mode operation (S310) may be performed.

The performing condition of the ice making operation, which is a condition requiring ice making, may be the case in which ice making is being performed or the case in which a request for making ice is generated by a user.

When the performing condition of the ice making operation is satisfied by checking the performing condition of the ice making operation (S301), whether the ice storage is full with ice may be checked (S302).

Whether the ice storage is full with ice may be checked by measuring the height of ice in the ice storage or may be checked by measuring the weigh to the ice storage.

When the ice storage is not full with ice by checking whether the ice storage is full with ice (S302), the ice making mode operation (S310) is performed.

In the ice making mode operation (S310), the ice making fan 421 may supply cool air to the ice making compartment 21 while operating at a predetermined rotational speed for a predetermined time.

That is, when the ice making fan 421 is operated, the air in the freezing compartment 12 may be suctioned to the portion where the second evaporator 32 is positioned and then may pass through the second evaporator 32. Further, the air may flow into the second cool air guide channel 320 through the second intake hole 220 of the shroud 200 and then may be supplied to the ice making compartment 21 through the ice making compartment cool air duct 51 connected to the second cool air guide channel 320.

In particular, the rotational speed of the ice making fan 421 in the ice making mode operation (S310) may be controlled to be higher than the rotational speed of the freezing fan 411 in the freezing operation (S100) or the switch compartment operation (S200).

That is, since the freezing fan 411 may supply cool air to the freezing compartment 12 positioned ahead of the freezing fan 411, the freezing fan 411 may rotate at a rotational speed where it may provide a large amount of cool air. However, since the ice making compartment 21 may be positioned far in comparison to the freezing compartment 12 or the switch compartment 13, the ice making fan 421 may forcibly send air up to the ice making compartment 21 while operating at a higher rotational speed than the freezing fan 411.

Accordingly, the wall (or other drinks) in the ice tray in the ice making compartment 21 may be smoothly frozen by the cool air supplied into the ice making compartment 21.

The cool air flowing in the ice making compartment 21 may flow to the ice making compartment return duct 52 and then may be guided to return to the freezing compartment 12 by the ice making compartment return duct 52. This configuration is shown in FIGS. 39 and 40.

Thereafter, the cool air returned to the freezing compartment 12 may flow in the freezing compartment 12 and may be guided to return to the air intake side of the second evaporator 32 by the suction guide 140 formed in the grille panel 100.

When the ice making mode operation (S320) is performed, the air in the freezing compartment 12 may flow backward to the second cool air guide channel 320.

That is, when the freezing fan 411 is not operated and only the ice making fan 421 is operated, a pressure difference is generated between the first cool air guide channel 310 and the second cool air guide channel, so the cool air in the freezing compartment may pass backward through the first cool air guide channel 310 and the first intake hole 210 and may flow into the second intake hole 220 and the second cool air guide channel 320.

However, the cool air flowing into the second cool air guide channel 320 in the ice making mode operation (S320) may flow into the first region 321*a*, the second region 321*b*, and the third region 321*c* of the second cool air guide channel and then a portion of the cool air may be supplied to the first cool air guide channel 310.

That is, the cool air flowing in the first region 321*a* by the operation of the ice making fan 421 may be supplied to the first cool air guide channel 310 through the first communicating channel 610, the cool air blown to the second region 321*b* may be supplied to the first cool air guide channel 310 through the second communicating channel 620, and the cool air blown to the third region 321*c* may be supplied to the portion connected with the ice making compartment cool air duct 51.

Accordingly, the inside of the first cool air guide channel 310 (or the freezing compartment) may be maintained at pressure similar to the pressure of the ice making compartment 21 by the cool air supplied from the second cool air guide channel 320. That is, since the pressures of the freezing compartment 12 and the ice making compartment 21 are substantially equilibrium, even if only the ice making fan 421 is operated for the ice making operation, the cool air in the freezing compartment 12 may be prevented (minimized) from passing backward through the first cool air guide channel 310 and the first intake hole 210 and flowing into the second intake hole 220 and the channel opening/closing module 330.

While the ice making mode operation (S320) described above is performed, the controller may continuously check the temperature of the ice making compartment 21 and the cool air supply time.

In this case, when it is determined that the temperature in the ice making compartment 21 is lower than a predetermined temperature and cool air has been supplied for a predetermined time, the controller may control the ice formed in the ice tray to be supplied to the ice storage. That is, when the end condition of the ice making operation is checked (S303) and the end condition of the ice making operation is satisfied, the ice making operation may be controlled to be ended (S304).

The controller may make new water be supplied to the ice tray and then may repeat the ice making mode operation for a predetermined time.

If the ice storage is full with the ice supplied therein, the controller recognizing this fact may end the ice making mode operation (S310) and may perform the full-ice mode operation (S320).

It may be possible to check whether the ice storage is full with ice in various ways. For example, it may be possible to check the full-ice state on the basis of the height of the storage ice or the weight of the ice storage.

When the ice making mode operation (S310) is ended and the full-ice mode operation (S320) is performed, the controller may control the ice making fan 421 to operate with the operation of the freezing fan 411.

That is, when the freezing fan 411 is not operated and the compressor is also not operated, the ice making fan 421 may also be controlled not to operate. When the freezing fan 411 is operated and the compressor is also operated, the ice making fan 421 may also be controlled to operate.

The full-ice mode operation (S320) has only to be maintained (maintained at substantially −3° C. or less) such that the ice in the ice storage is not melted, so when the compressor is operated only for the full-ice mode operation (S320), excessive power may be unavoidably consumed to keep the ice.

Accordingly, by controlling the ice making fan 421 to operate when the compressor is operated by operation of the freezing fan, it may be possible to reduce the entire power consumption.

The rotational speed of the ice making fan 421 in the full-ice mode operation (S320) may be controlled lower than the rotational speed of the ice making fan 421 in the ice making mode operation (S310).

That is, it may be possible to further reduce the power consumption by enabling the full-ice mode operation (S320) to be performed with lower efficiency than the ice making mode operation (S310).

In some examples, the rotational speed of the ice making fan 421 in the full-ice mode operation (S320) may be controlled to be higher than the rotational speed of the freezing fan 411 in the freezing operation (S100). This may be for enabling cool air to be smoothly supplied up to the ice making compartment.

The operation of the ice making fan 421 in the full-ice mode may be selectively performed even in accordance with the temperature condition of the ice making compartment 21 in addition to whether the freezing fan 411 is operated.

That is, when the temperature of the ice making compartment 21 increases up to a predetermined temperature range (a temperature that may melt ice, for example, −3° C. or higher), the compressor may be operated and the ice making fan 421 may be operated regardless of whether the freezing fan 411 is operated in order to reduce the temperature of the ice making compartment 21.

The controller may check whether the temperature reaches a predetermined temperature set as the ice making operation end condition on the basis of the temperature of the ice making compartment 21 (S303), and when the it corresponds to the ice making operation end condition, the controller may stop supplying cool air to the ice making compartment 21 by stopping the operation of the ice making fan 421 (S304).

Accordingly, the temperature in the ice making compartment 21 may be controlled by repeated circulation of the air (cool air).

As described above, the operation control method in the ice making operation according to another implementation may separately control the ice making operation into the ice making mode operation (S310) and the full-ice mode operation (S320), whereby the ice making compartment 21 may be controlled for each situation.

In particular, the operation control method of the refrigerator may make the full-ice mode operation (S320) be performed with lower efficiency than the ice making mode operation (S310), whereby it may be possible to remarkably reduce power consumption.

As described above, a refrigerator may be implemented in various ways, as in the implementations described above, and may be implemented in other ways not shown.

What is claimed is:

1. A refrigerator comprising:

a cabinet comprising a refrigerating compartment and a freezing compartment disposed below the refrigerating compartment;

an ice making compartment disposed at a side of the refrigerating compartment;

an evaporator that faces the freezing compartment and is configured to cool air;

a shroud disposed at a front side of the evaporator, the shroud defining a first intake hole and a second intake hole spaced apart from each other;

a grille panel that is coupled to a front surface of the shroud and defines a cool air discharge port configured to discharge cool air into the freezing compartment;

a first cool air guide channel defined between the grille panel and the shroud and configured to guide cool air from the first intake hole to the cool air discharge port;

a second cool air guide channel defined between the grille panel and the shroud and configured to guide cool air from the second intake hole to the ice making compartment;

a partition rib that protrudes from an inner surface of the grille panel facing the front surface of the shroud and that is disposed between the first cool air guide channel and the second cool air guide channel, the partition rib defining a communicating channel configured to guide cool air from the second cool air guide channel to the first cool air guide channel;

a freezing fan module disposed between the grille panel and the shroud and configured to supply cool air to the first cool air guide channel, the freezing fan module being disposed at a first side of the partition rib; and an ice making fan module disposed between the grille panel and the shroud and configured to supply cool air to the second cool air guide channel, the ice making fan module being disposed at a second side of the partition rib opposite to the first side of the partition rib, wherein the communicating channel is positioned closer to the cool air discharge port than to the first intake hole.

2. The refrigerator of claim 1, wherein the partition rib comprises a first partition rib and a second partition rib that are disposed between the first cool air guide channel and the second cool air guide channel and that extend away from each other, and wherein the communicating channel is defined between end portions of the first partition rib and the second partition rib that are spaced apart from and face each other.

3. The refrigerator of claim 2, wherein the end portions of the first partition rib and the second partition rib extend parallel to each other, and wherein the communicating channel is an air passage.

4. The refrigerator of claim 1, wherein the cool air discharge port comprises:

an upper cool air discharge port defined above a center of the grille panel; and a lower cool air discharge port defined below the upper cool air discharge port.

5. The refrigerator of claim 4, wherein the communicating channel comprises a first communicating channel configured to guide cool air toward the upper cool air discharge port.

6. The refrigerator of claim 5, wherein the communicating channel further comprises a second communicating channel configured to guide cool air toward the lower cool air discharge port.

7. The refrigerator of claim 6, wherein the second communicating channel is positioned below the ice making fan module.

8. A refrigerator comprising:

a cabinet comprising a refrigerating compartment and a freezing compartment disposed below the refrigerating compartment;

an ice making compartment disposed at a side of the refrigerating compartment;

an evaporator that faces the freezing compartment and is configured to cool air;

a shroud that is disposed at a front side of the evaporator and defines a first intake hole and a second intake hole spaced apart from each other;

a grille panel that is coupled to a front surface of the shroud and defines a cool air discharge port configured to discharge cool air into the freezing compartment;

a first cool air guide channel defined between the grille panel and the shroud and configured to guide cool air from the first intake hole to the cool air discharge port;

a second cool air guide channel defined between the grille panel and the shroud and configured to guide cool air from the second intake hole to the ice making compartment;

a partition rib that protrudes from an inner surface of the grille panel facing the front surface of the shroud and separates the first cool air guide channel and the second cool air guide channel from each other;

a freezing fan module disposed between the grille panel and the shroud and configured to supply cool air to the first cool air guide channel, the freezing fan module being disposed at a first side of the partition rib; and an ice making fan module disposed between the grille panel and the shroud and configured to supply cool air to the second cool air guide channel, the ice making fan module being disposed at a second side of the partition rib opposite to the first side of the partition rib, wherein a diameter of the second intake hole is less than a diameter of the first intake hole.

9. The refrigerator of claim 8, wherein the ice making fan module comprises an ice making fan, and the freezing fan module comprises a freezing fan, and where a size and a shape of the ice making fan are identical to a size and a shape of the freezing fan, respectively.

10. The refrigerator of claim 9, wherein the ice making fan is configured to rotate at a higher speed than the freezing fan.

11. The refrigerator of claim 8, wherein the shroud comprises a covering member that extends along an inner circumferential surface of the second intake hole such that the diameter of the second intake hole is less than the diameter of the first intake hole.

* * * * *